350-336 SR
PWE35 XR 4,212,159

United States Patent [19]
Noble et al.

[11] 4,212,159
[45] Jul. 15, 1980

[54] ELECTRONIC TIMEPIECE

[75] Inventors: Robert T. Noble, Dallas; Perry A. Penz; Burton W. Marks, both of Richardson, all of Tex.

[73] Assignee: Texas Instruments Incorporated, Dallas, Tex.

[21] Appl. No.: 877,041

[22] Filed: Feb. 13, 1978

[51] Int. Cl.[2] ..... G04B 19/30; G04B 19/06
[52] U.S. Cl. ..... 368/82; 368/132
[58] Field of Search ..... 58/23 R, 50 R, 127 R, 58/128; 340/753, 784, 789; 350/332, 330

[56] References Cited

U.S. PATENT DOCUMENTS

| | | | |
|---|---|---|---|
| 3,456,152 | 7/1969 | Andersen | 58/50 R |
| 3,772,874 | 11/1973 | Lefkowitz | 58/50 R |
| 3,889,458 | 6/1975 | Kashio | 58/4 A |
| 3,959,963 | 6/1976 | Murrell | 58/50 R |
| 3,969,887 | 7/1976 | Fukumoto | 58/50 R |
| 3,987,617 | 10/1976 | Slob | 58/50 R |
| 4,079,369 | 3/1978 | Fukumoto | 340/573 |
| 4,095,405 | 6/1978 | Tanaka | 58/50 R |
| 4,095,413 | 6/1978 | Reich | 58/50 R |

*Primary Examiner*—Vit W. Miska
*Attorney, Agent, or Firm*—Stephen S. Sadacca; Mel Sharp

[57] ABSTRACT

Improved timekeeping apparatus, such as a watch or clock with an electro-optic display simulating a conventional mechanical analog timepiece. Electro-optical material, e.g., liquid crystal material, is activated in selected areas to change its appearance to simulate movement of the hands.

8 Claims, 63 Drawing Figures

HOURS – MINUTES
(2 : 30)

MINUTES – SECONDS
30 MIN 45 SEC

CALENDAR
(FRI THE 25TH)

TIME ZONE
(4:30)

E.T. HOURS – MIN
(1 HOUR 25 MIN)

E.T. MIN – SECONDS
25 MIN – 39 SEC

E.T. SECONDS – TENTHS
39 AND 3/10 SECS

RESULTANT RMS VOLTAGES $\begin{cases} V_{ON} \cong 0.79\ V_B \\ V_{OFF} \cong 0.35\ V_B \end{cases}$

| | |
|---|---|
| Fig. 15 | Fig. 16 |

Fig. 17

Fig. 18

| | | |
|---|---|---|
| Fig. 21 | Fig. 22 | Fig. 23 |
| Fig. 24 | Fig. 25 | Fig. 26 |
| Fig. 27 | Fig. 28 | Fig. 29 |

| | | |
|---|---|---|
| Fig. 30 | Fig. 31 | Fig. 32 |
| Fig. 33 | Fig. 34 | Fig. 35 |
| Fig. 36 | Fig. 37 | Fig. 38 |

Fig. 19

Fig. 20

| | | |
|---|---|---|
| Fig. 39 | Fig. 40 | Fig. 41 |
| Fig. 42 | Fig. 43 | Fig. 44 |
| Fig. 45 | Fig. 46 | Fig. 47 |

FEB
59
58
99
95
98
94
DATE COUNTER 87
115
103
116
105

FLASH
TK
DATA MULTIPLEXER
55
122'
SEC
MIN
HR
MO
DATE
DAY
TENTHS
SWS
SWM
SWH
HRZ
61
60
66
66
107
106
88
MONTH COUNTER
89
TIME ZONE HOURS
A
B
C
D

DE
SE
SLE
GE
A1
A6
A9
A17
A19
A20
A66
A69
FS
CLP
As
Ās
Bs
B̄s
Cs
C̄s
67
DT
66
D U B A
1Hz
FS
32Hz
64Hz
128Hz
173
172
123
43

174
175
171
122
176
67
1/10 DAY
DT
2 Hz
TENTHS
GL
B34
B11
B56
B46
B36
B23
B12
B1
B47
B37
B35
B24
B3
B2
S18
G18
S29
G29
S19
G19
S20
G20
S10
G10
D18
D29
D19
D20
D10
18
29
19
20
10
B1
B2/B4

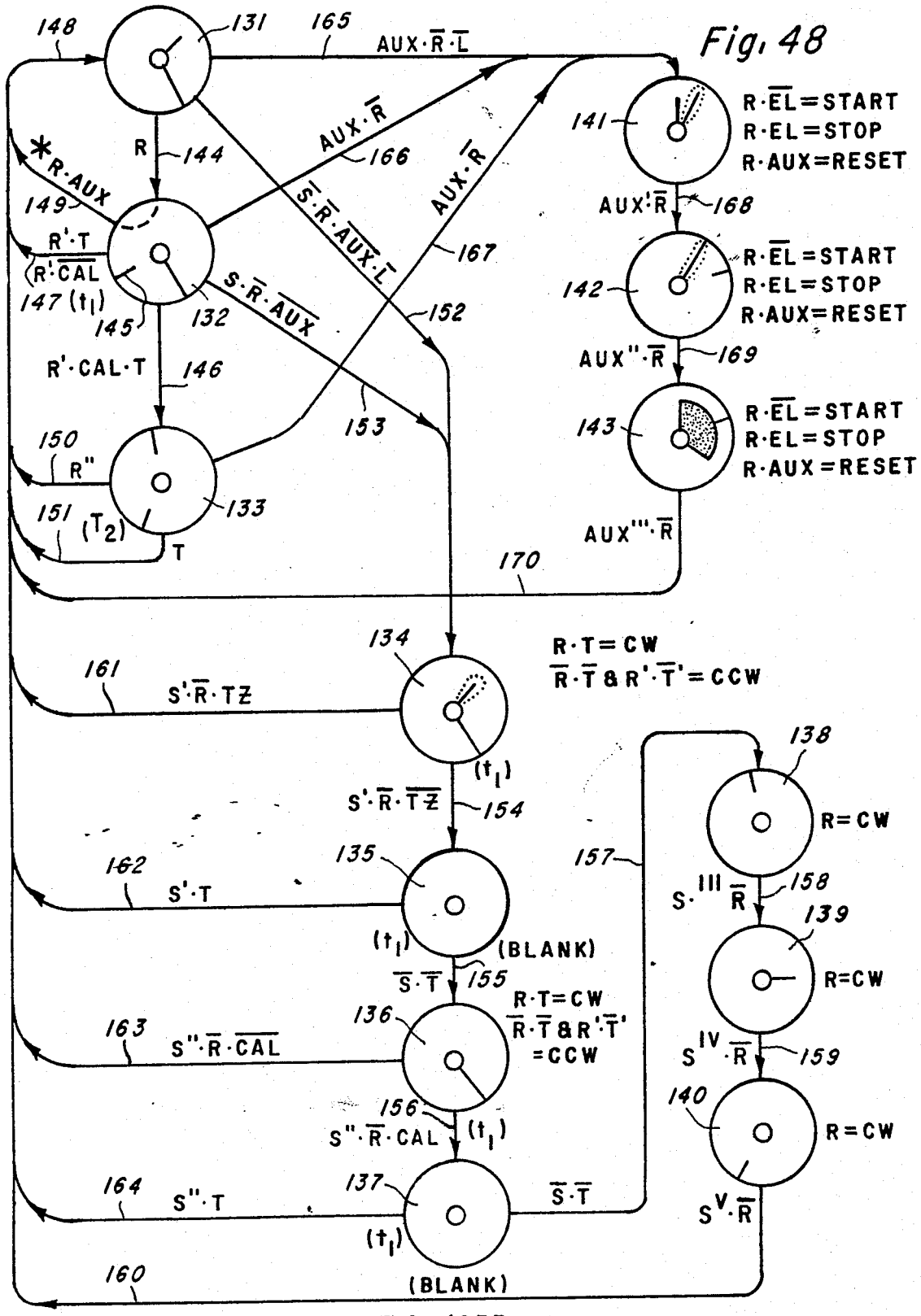
Fig. 48
148
131
165
AUX·R̄·L̄
R·ĒL=START
R·EL=STOP
R·AUX=RESET
141
AUX·R̄
166
AUX·R̄
*R·AUX
R
144
149
S'·R̄·AUX·L̄
AUX'·R̄
168
R'·T
(R'·CAL
147 (t1)
145
132
S·R̄·AUX
167
152
142
R·ĒL=START
R·EL=STOP
R·AUX=RESET
AUX''·R̄
169
R'·CAL·T
146
153
143
R·ĒL=START
R·EL=STOP
R·AUX=RESET
150
R''
151
(T2)
133
T
AUX'''·R̄
170
134
R·T=CW
R̄·T̄ & R'·T̄'=CCW
161
S'·R̄·TZ
(t1)
138
S'·R̄·TZ̄
154
R=CW
157
135
162
S'·T
S·III R̄
158
139
(t1)
(BLANK)
S̄·T̄
155
R=CW
R·T=CW
R̄·T̄ & R'·T̄'
=CCW
136
163
S''·R̄·CAL
S·IV·R̄
159
156
S''·R̄·CAL
(t1)
140
R=CW
164
S''·T
137
S̄·T̄
S·V·R̄
(t1)
160
(BLANK)
* TIME ZONE TOGGLE ON/OFF

Fig. 50

| SEGMENTS | PLANES | SHORT $\theta_1$ | LONG ONLY $\theta_2$ | (NOT USED) $\theta_3$ | TENTHS $\theta_4$ | OFF $\theta_0$ |
|---|---|---|---|---|---|---|
| SHORT ONLY | $\phi_\alpha$ | X | | | X | |
| OR SHORT AND LONG LONG AND OLP | $\phi_\beta$ | X | X | | | |
| LONG ONLY | $\phi_\gamma$ | | X | X | | |
| OFF | $\phi_\delta$ | | | X | X | |

Fig. 51

| TYPE OF SIGNAL DESIRED | SIGNAL INPUT TO DRIVER | GATE INPUT TO DRIVER |
|---|---|---|
| $\theta_1$ | 32 HZ | HIGH |
| $\theta_2$ | 32 HZ $\oplus$ *64HZ | HIGH |
| $\theta_4$ | $\overline{\theta_2}$ | HIGH |
| $\theta_0$ | DO NOT CARE | LOW |
| $\phi_\alpha$ | $\overline{32\ HZ}$ | 64 HZ |
| $\phi_\beta$ | $\overline{32\ HZ}$ | $\overline{64\ HZ}$ |
| $\phi_\gamma$ | 32 HZ | 64 HZ |
| $\phi_\delta$ | 32 HZ | $\overline{64\ HZ}$ |

* EXCLUSIVE – OR FUNCTION

ELECTRONIC TIMEPIECE

This invention relates to horology and more particularly to timepieces having a simulated analog display.

Electronic timepieces with simulated analog displays have heretofore been proposed, illustrative of which are those depicted in U.S. Pat. Nos. 3,540,209 granted to N. C. Zatsky et al on Nov. 17, 1970; U.S. Pat. No. 3,959,963 granted to Nicholas J. Murrell on June 1, 1976 and U.S. Pat. No. 3,969,887 granted to Skigeru Fukumoto on July 20, 1976.

While the proposals of the foregoing patents and other related prior art have constituted substantial advances toward the achievement of attractive, economic and reliable timepieces, certain problems have arisen in applying their teachings to practical embodiments. These include the requirement for excessive numbers of connections to the analog display and attendant circuitry, and the representation of time by forms or shapes other than counterparts of the hands found on conventional mechanical analog timepieces (thereby resulting in unfamiliarity with the symbol and consequent lack of attraction to potential purchasers). Other disadvantages also include difficulty in manufacture with excessive costs and insufficient yields. There has, therefore, been a continuing need for electronic analog timepieces which are lower in cost, more reliable, require fewer connections and present a more attractive aesthetic appearance to potential purchasers.

Accordingly, it is one general object of this invention to improve analog electronic timepieces.

It is another object of this invention to reduce the number of electrical connections required to electronic analog timekeeping displays.

It is yet another object of this invention to produce an electronic analog timekeeping display which more nearly simulates the visual and aesthetic appearance to the conventional mechanical analog display.

It is still a further object of this invention to effectuate higher resolution and contrast in electronic displays of the analog type thereby contributing to purchaser appeal.

Accordingly, in accordance with one feature of the invention, liquid crystal material is disposed in sandwiched form between sets of electrically conductive elements in a particularly efficacious geometric pattern, thereby permitting activation of the liquid crystal material is discrete areas to present progressive indications of time closely simulating those of the conventional mechanical analog timepiece.

In accordance with another feature of the invention, the interconnections to and within the display are advantageously coordinated with the associated circuitry to provide improved characteristics.

In accordance with another feature of the invention, sets of interconnections are disposed in a meandering path pattern to interconnect selected ones of said elements in a particularly efficacious manner to reduce the number of external connections required, thereby simplifying such connections, reducing cost and increasing reliability of assembly and use.

In accordance with another feature of the invention, electrical signals are applied to the connections in an improved time shared (phased) relationship, thereby providing enhanced contrast and appearance in certain embodiments, and in other embodiments, permitting the inclusion of additional features e.g., displays of seconds and tenths of seconds.

These and other objects and features of the invention will be evident from the following detailed description, with reference to the drawings in which.

Figure 3A:
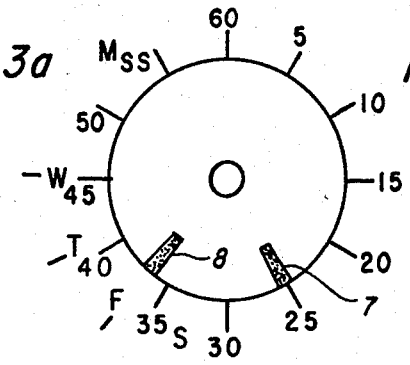
Figure 3B:
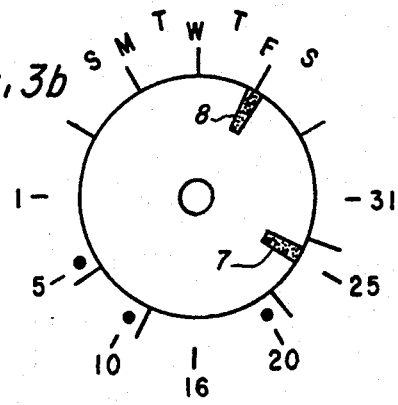
Figure 4:
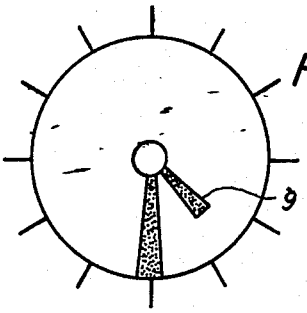
Figure 5:
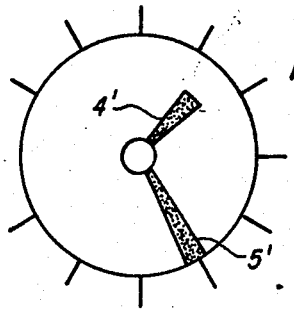
Figure 6:
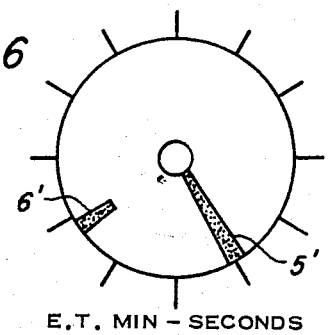
Figure 7:
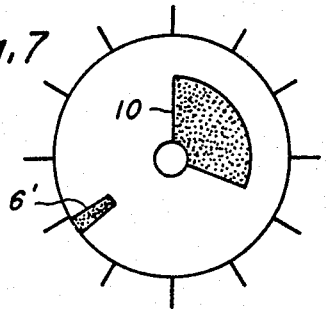
Figure 8:
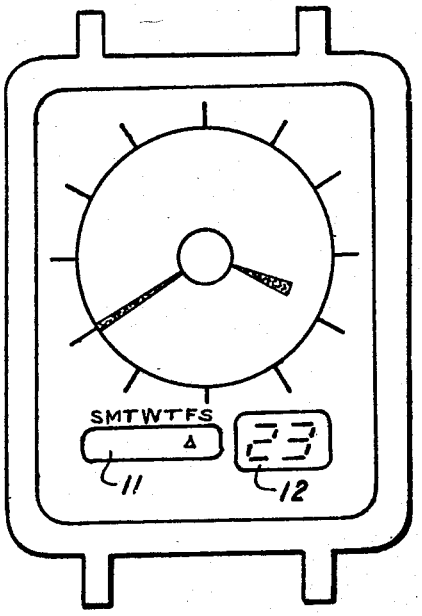
Figure 9:
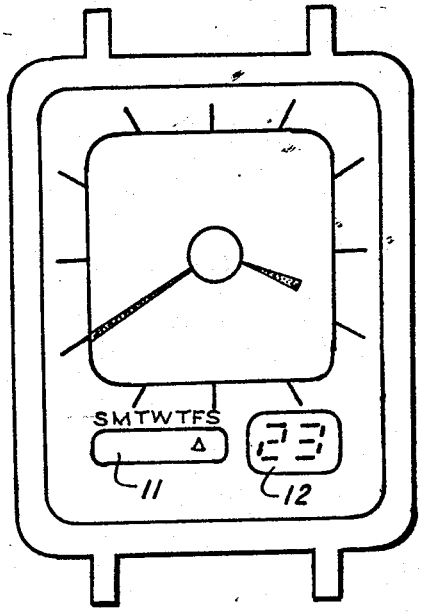
Figure 11:
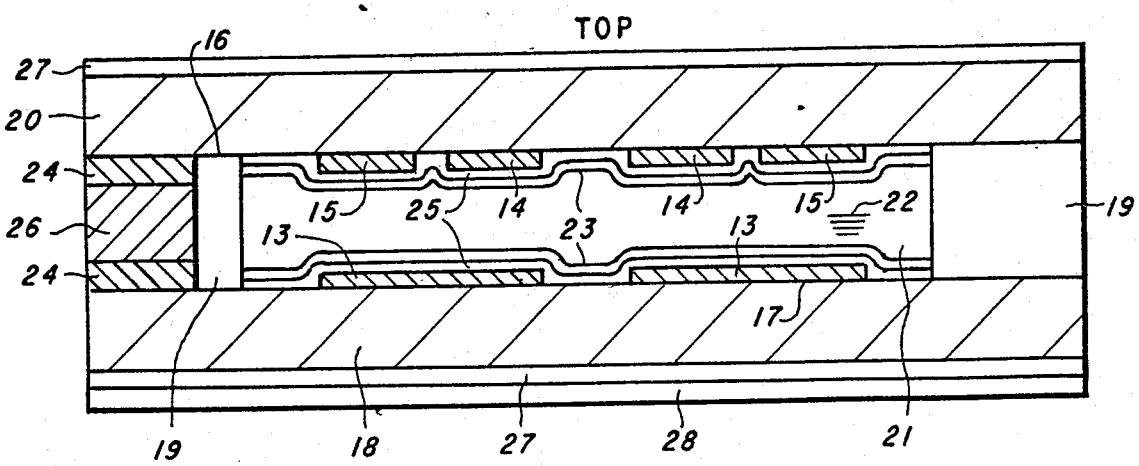
Figure 10:
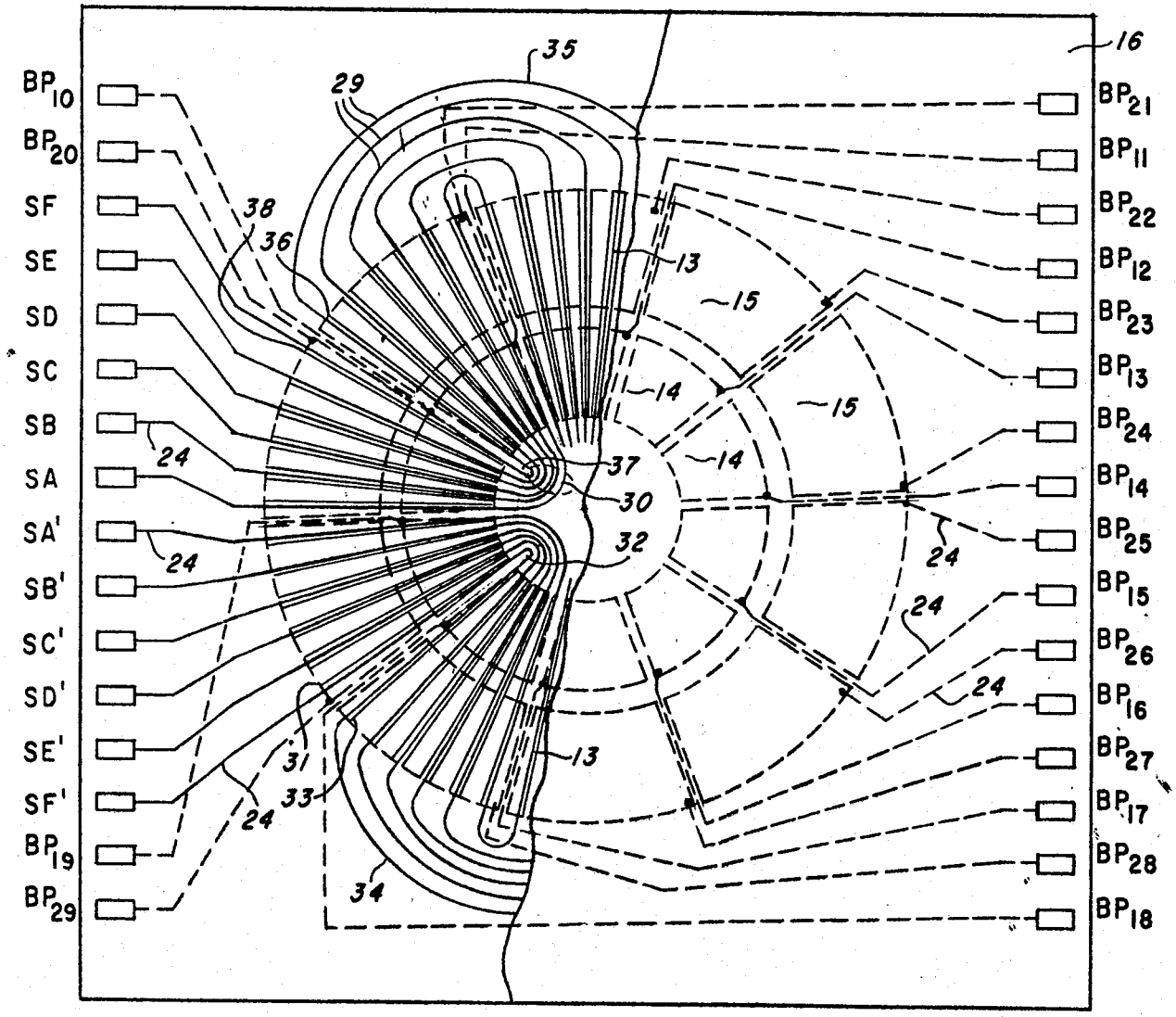
Figure 12:
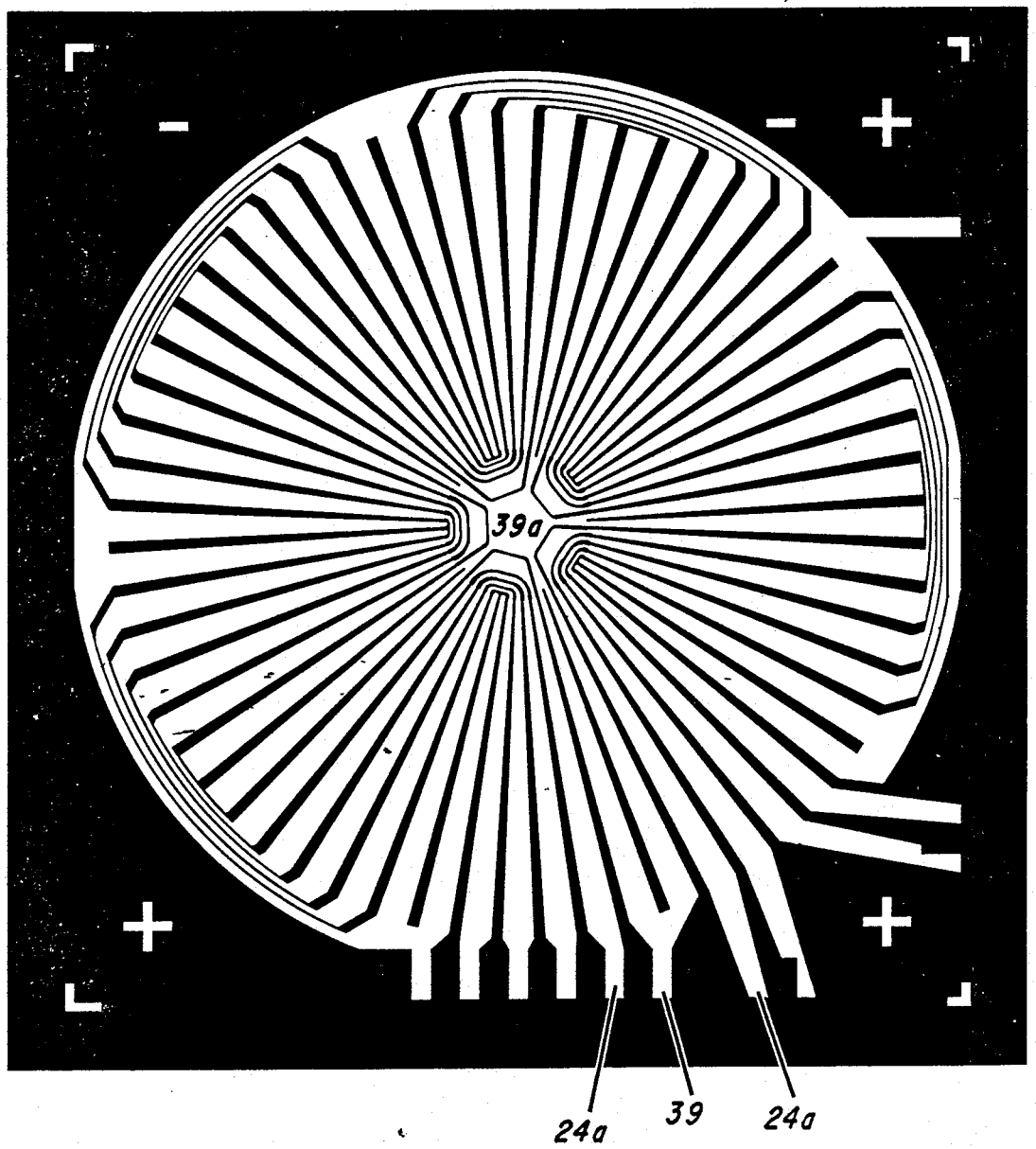
Figure 13:
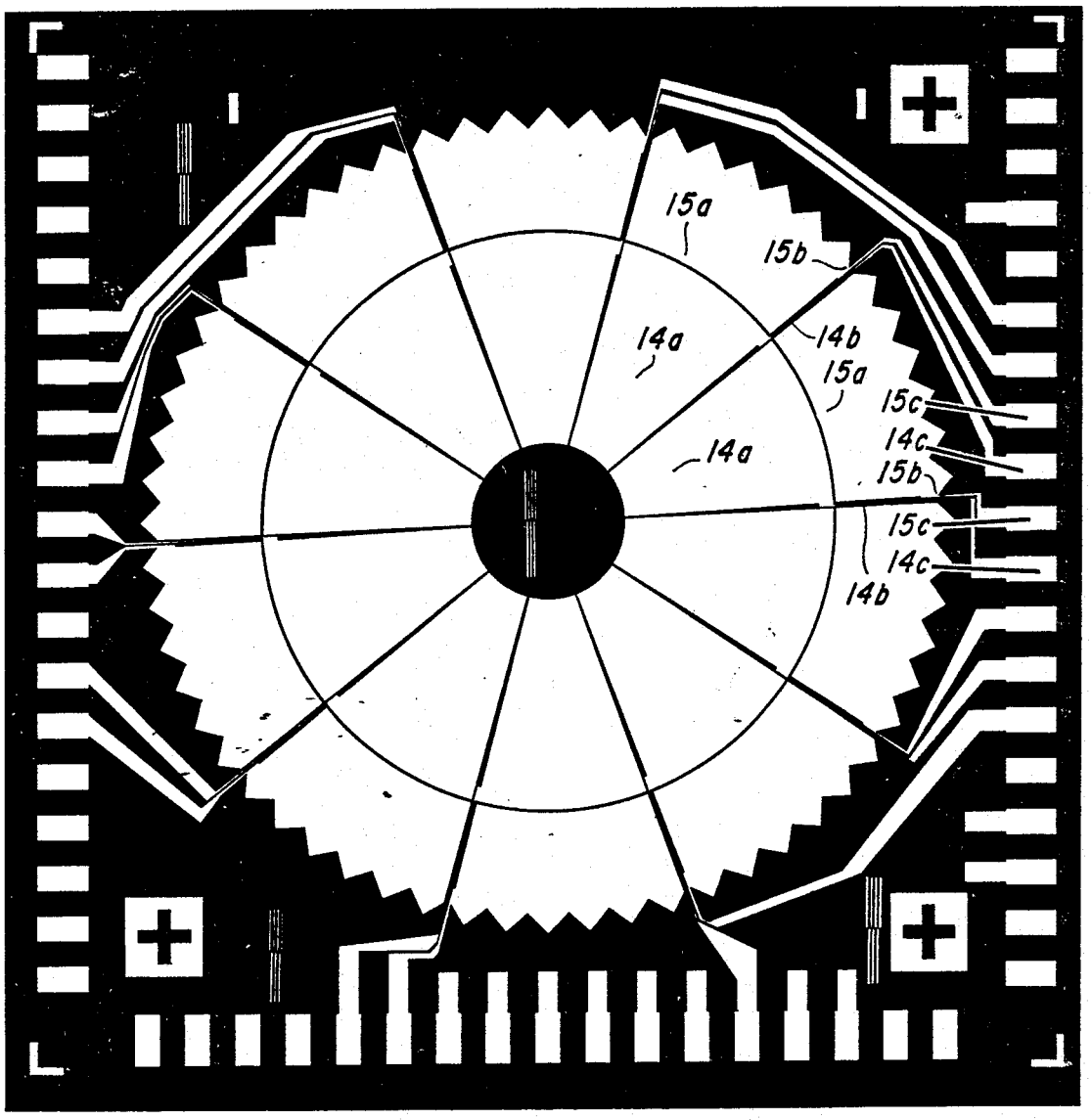
Figures 14A, 14I:
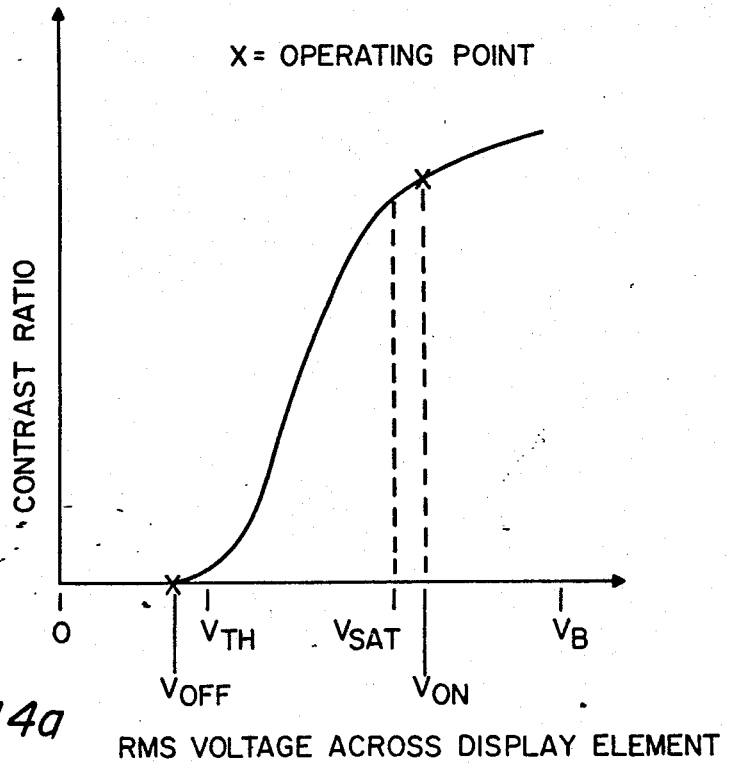
Figure 14:
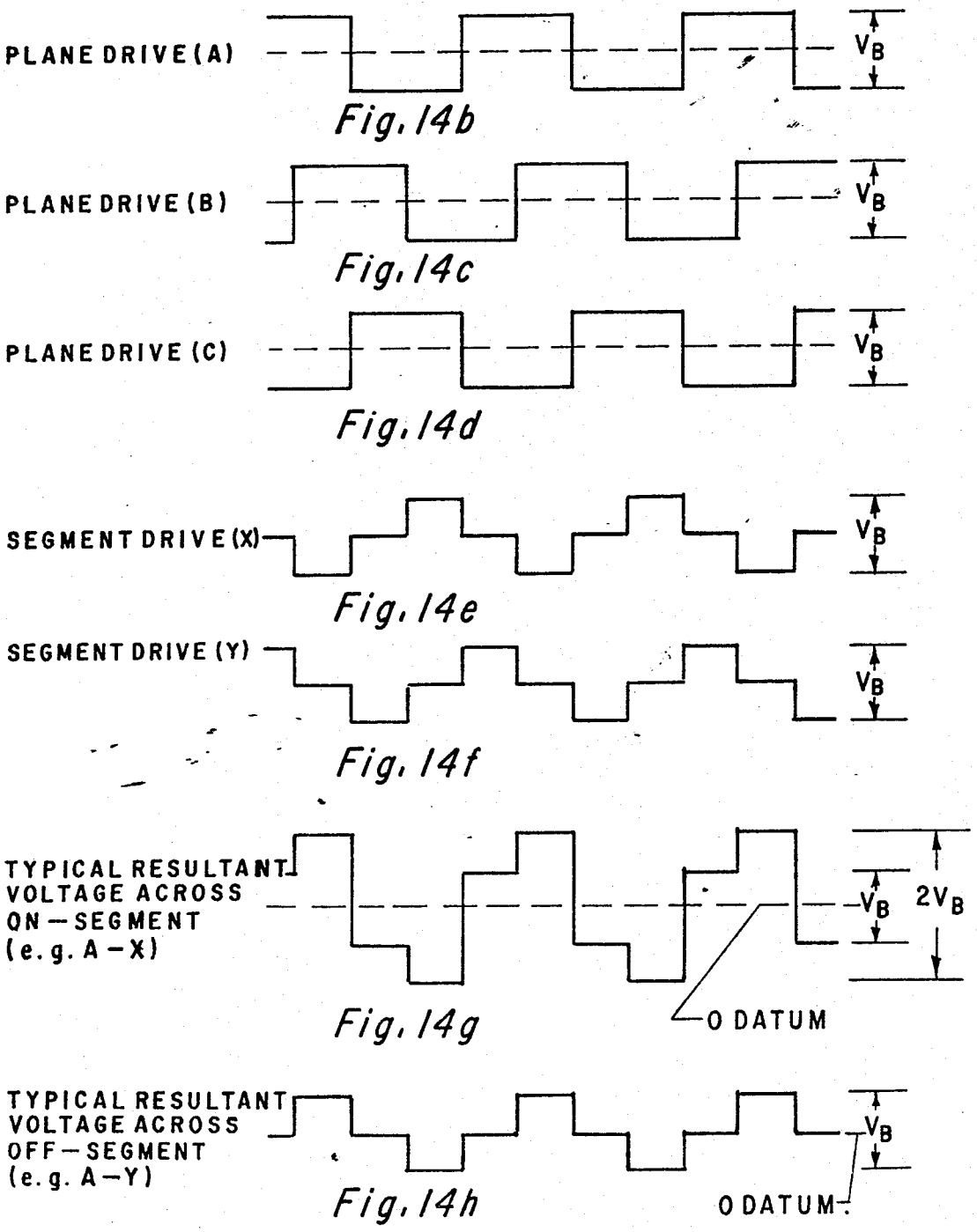
Figure 15:
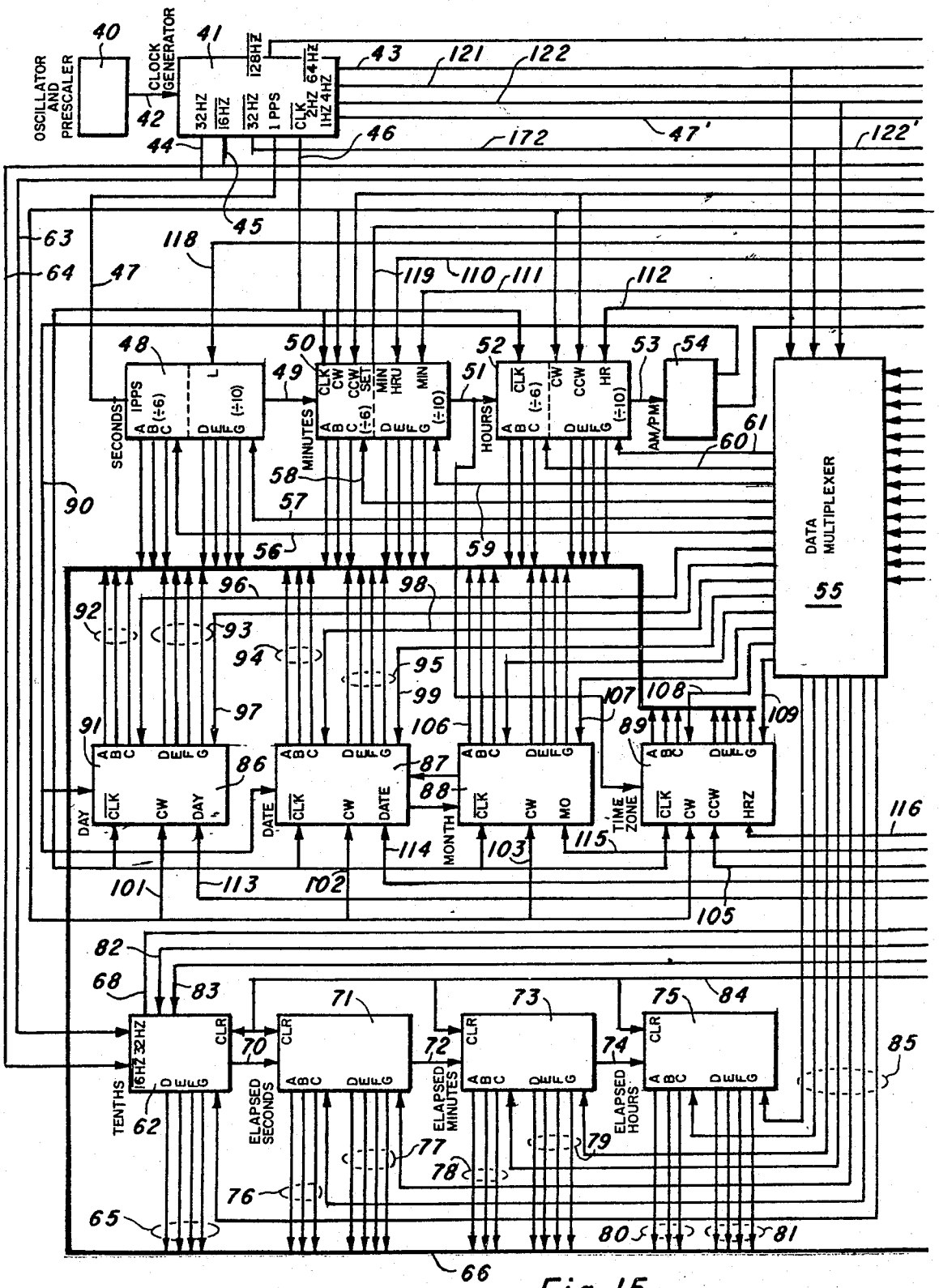
Figure 16:
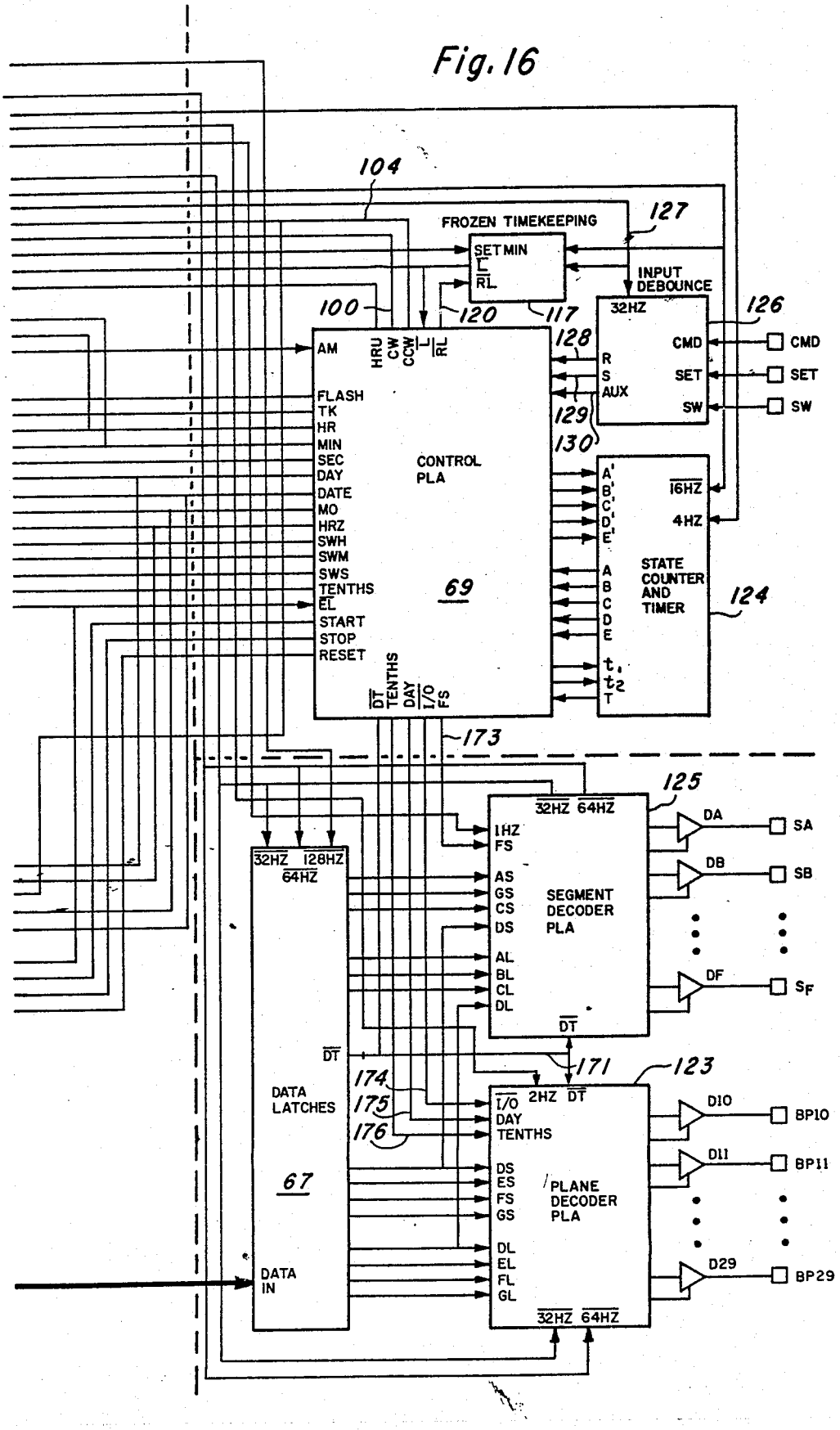
Figure 21:
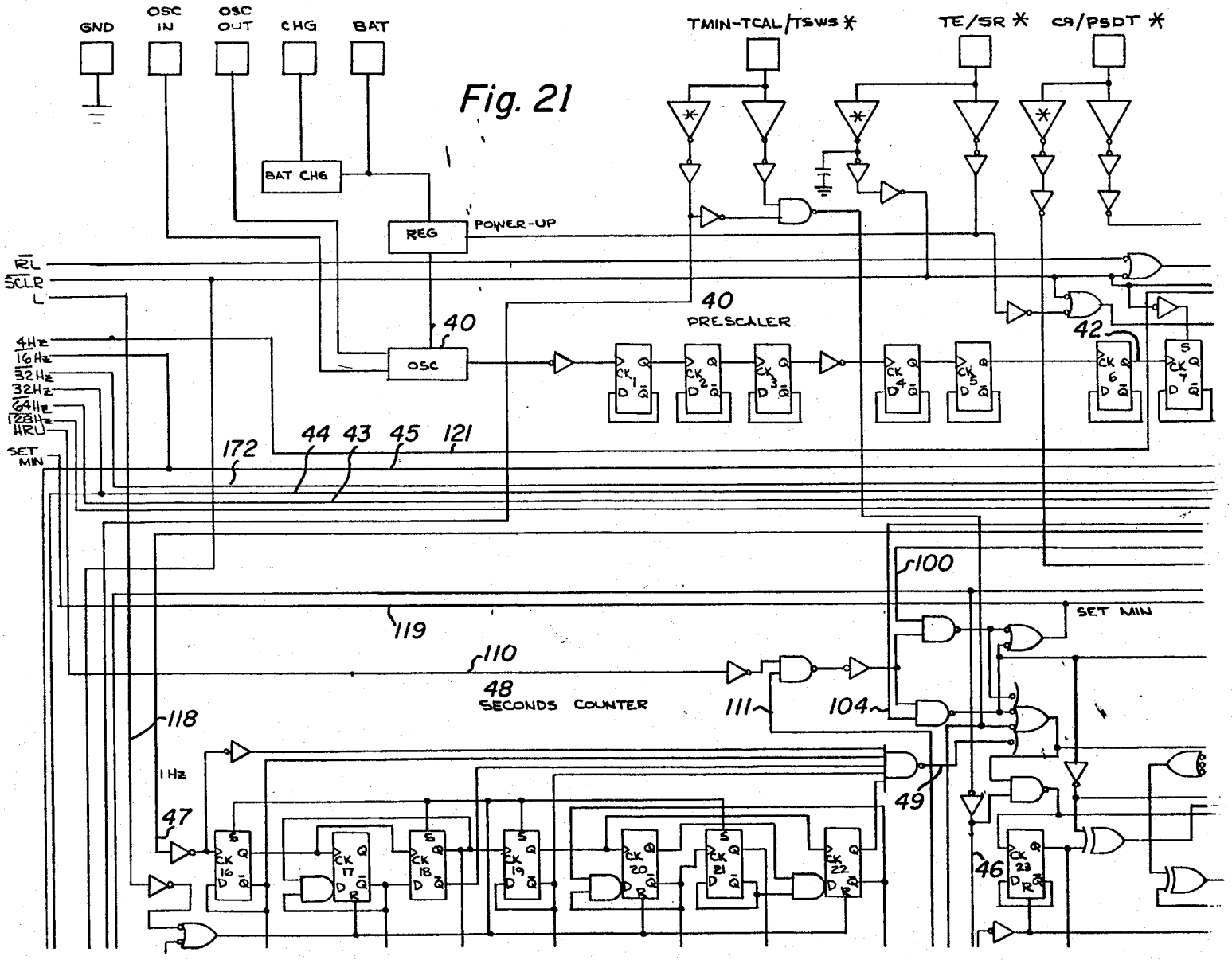
Figure 22:
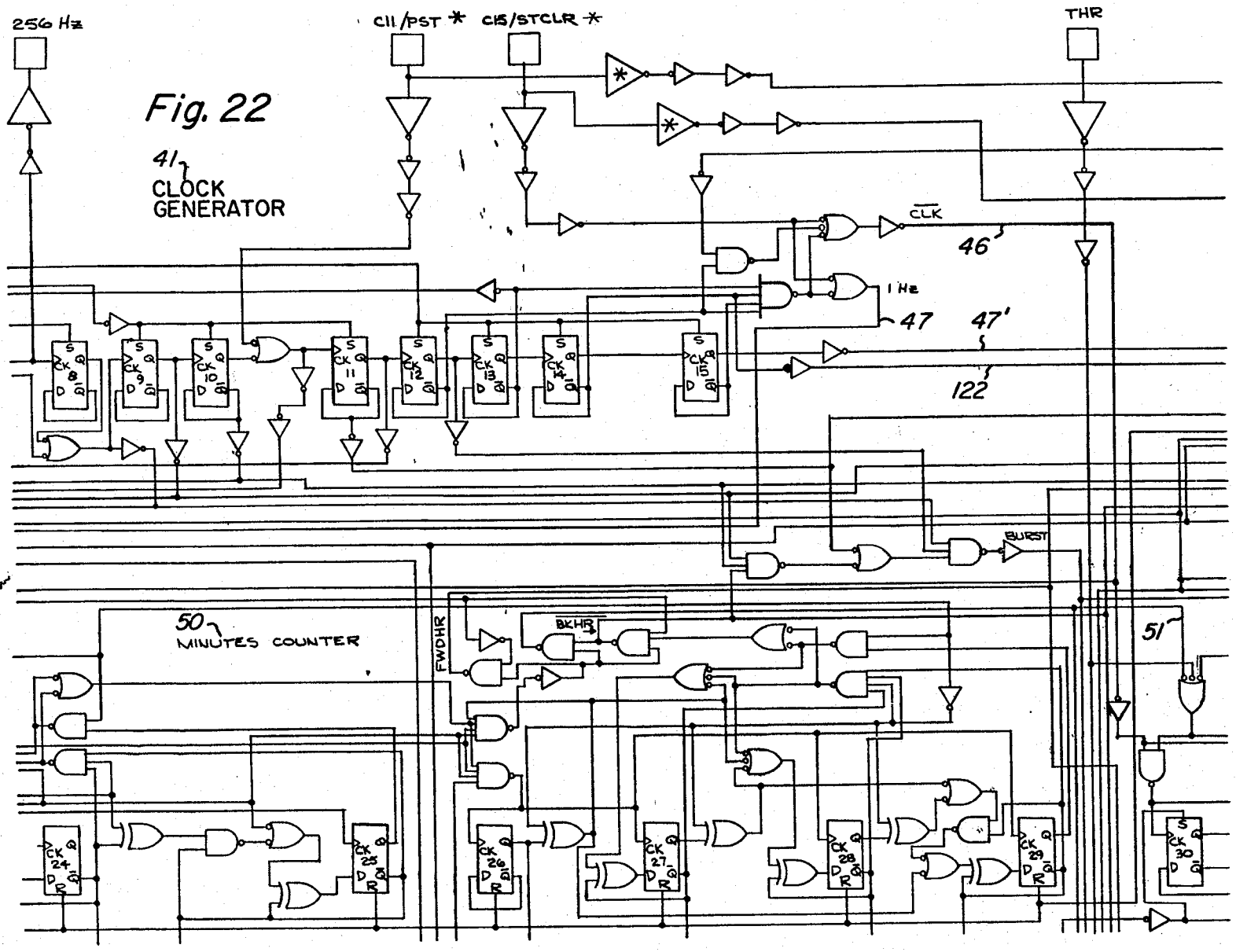
Figure 23:
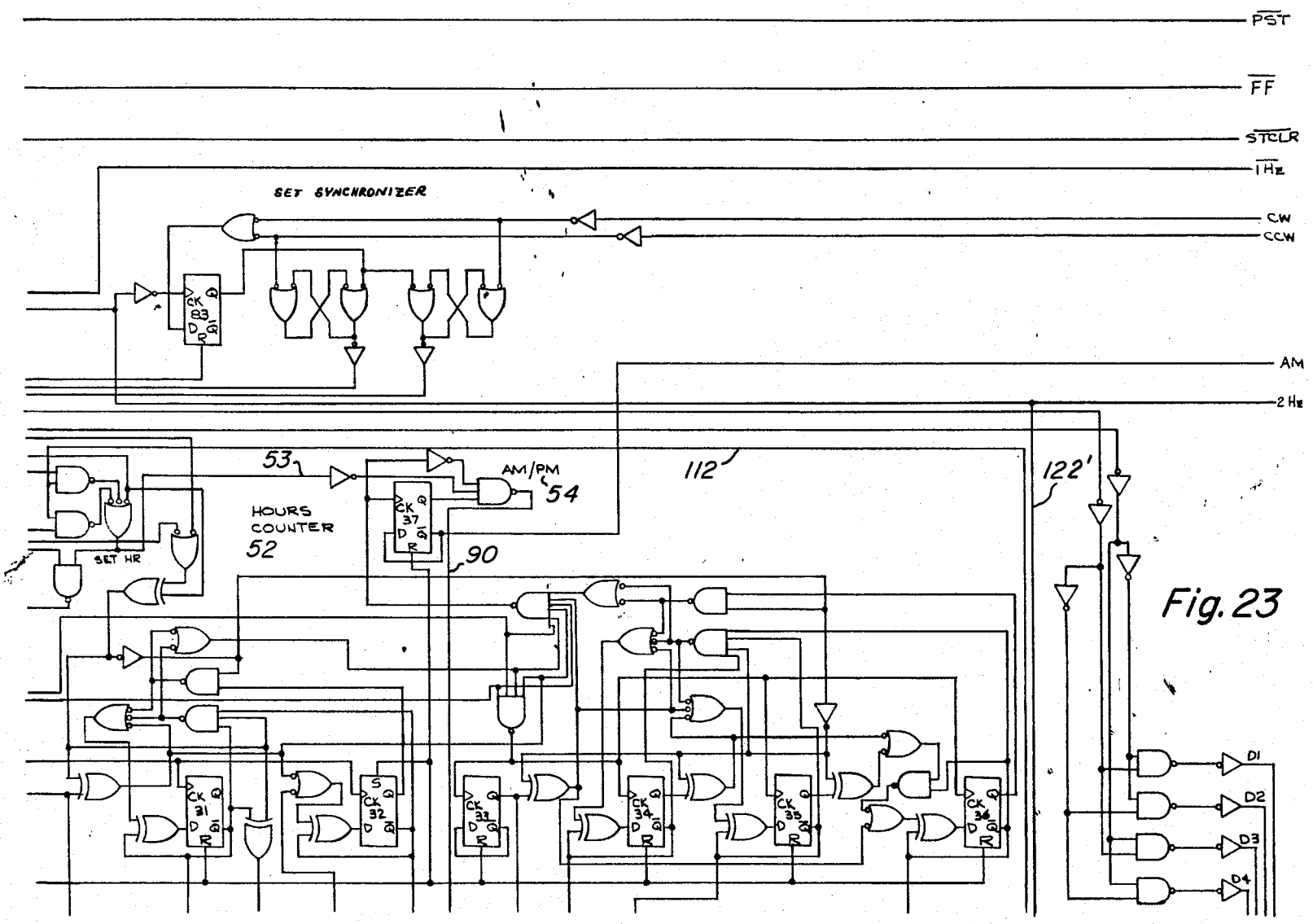
Figure 24:
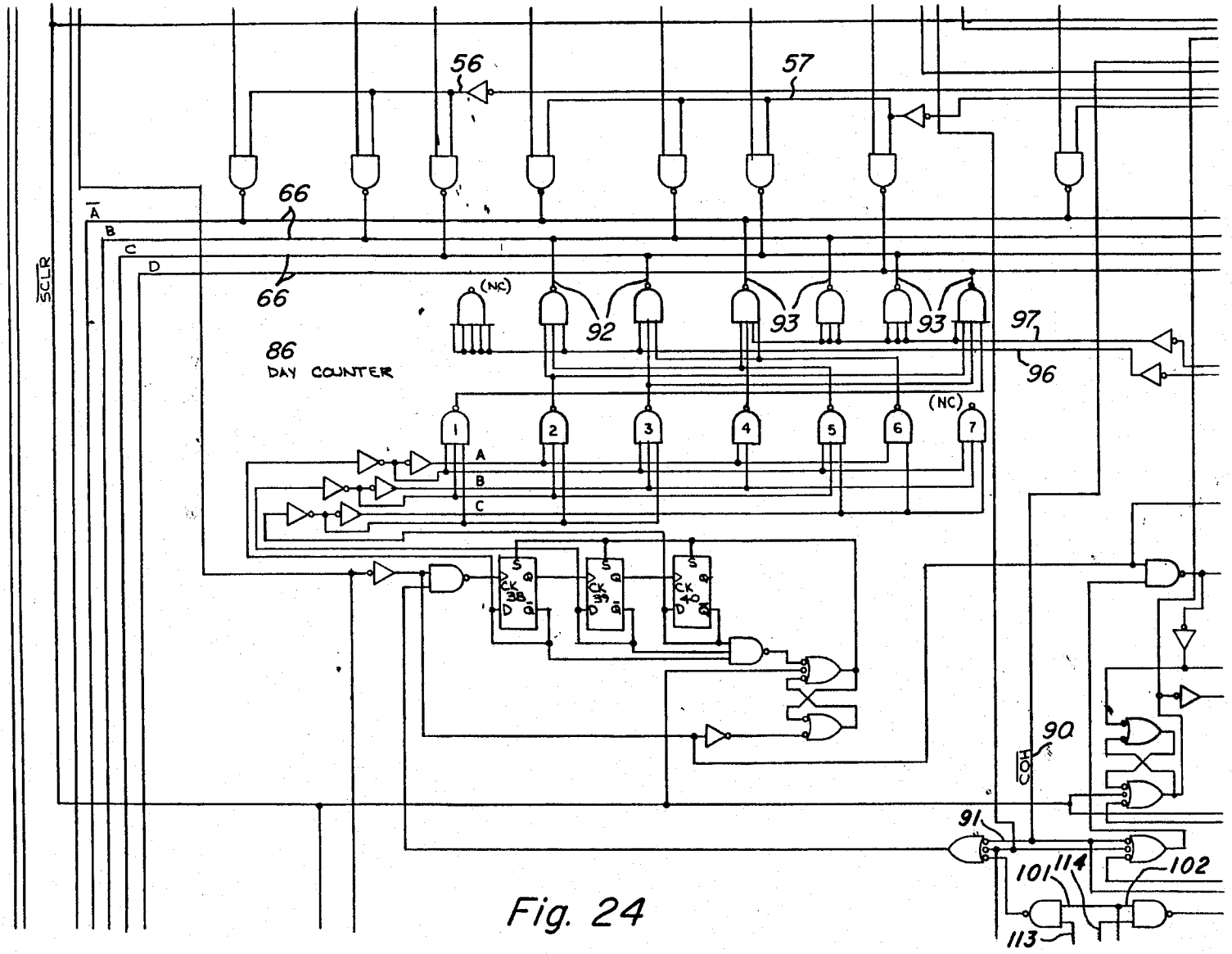
Figure 25:
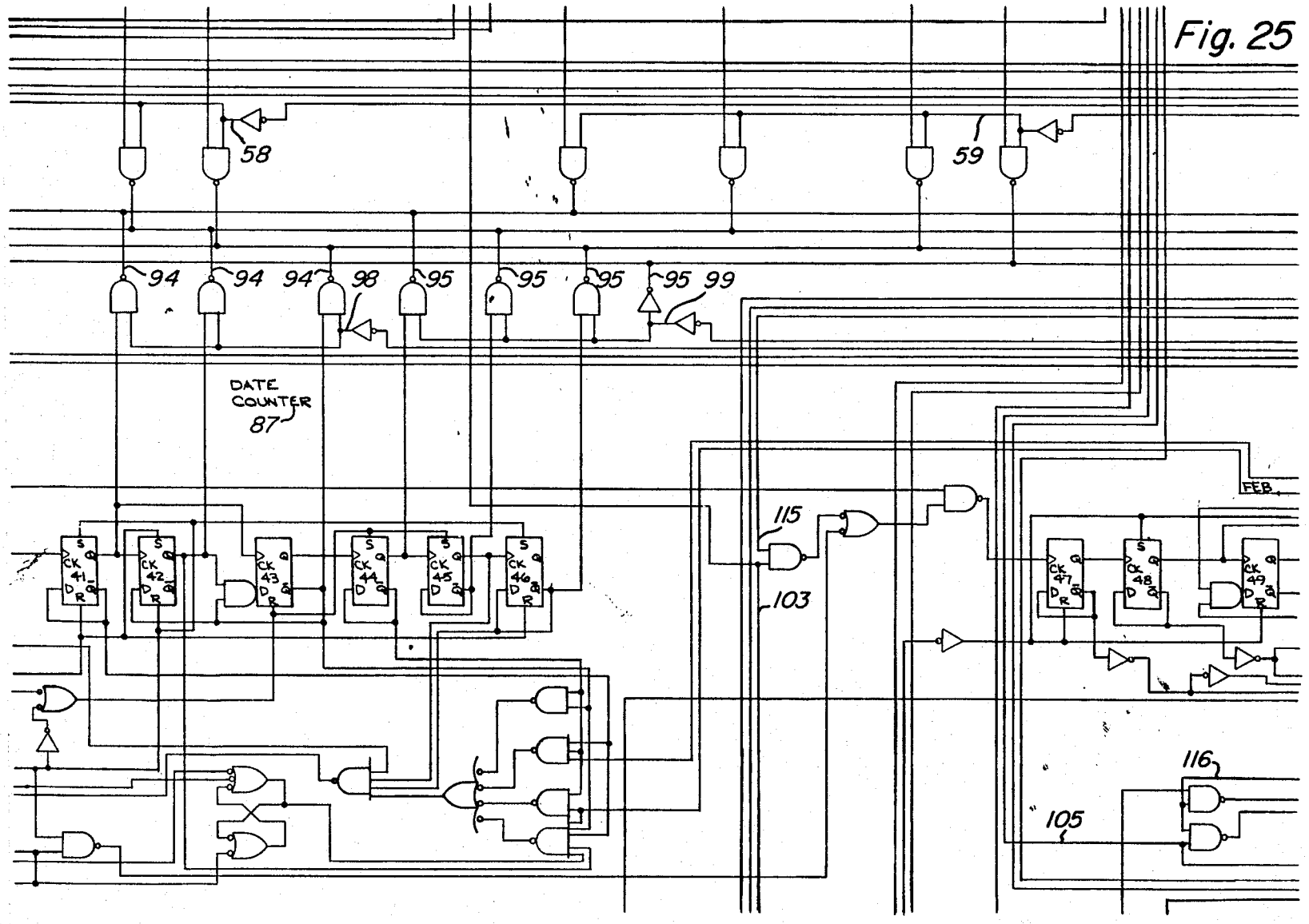
Figure 26:
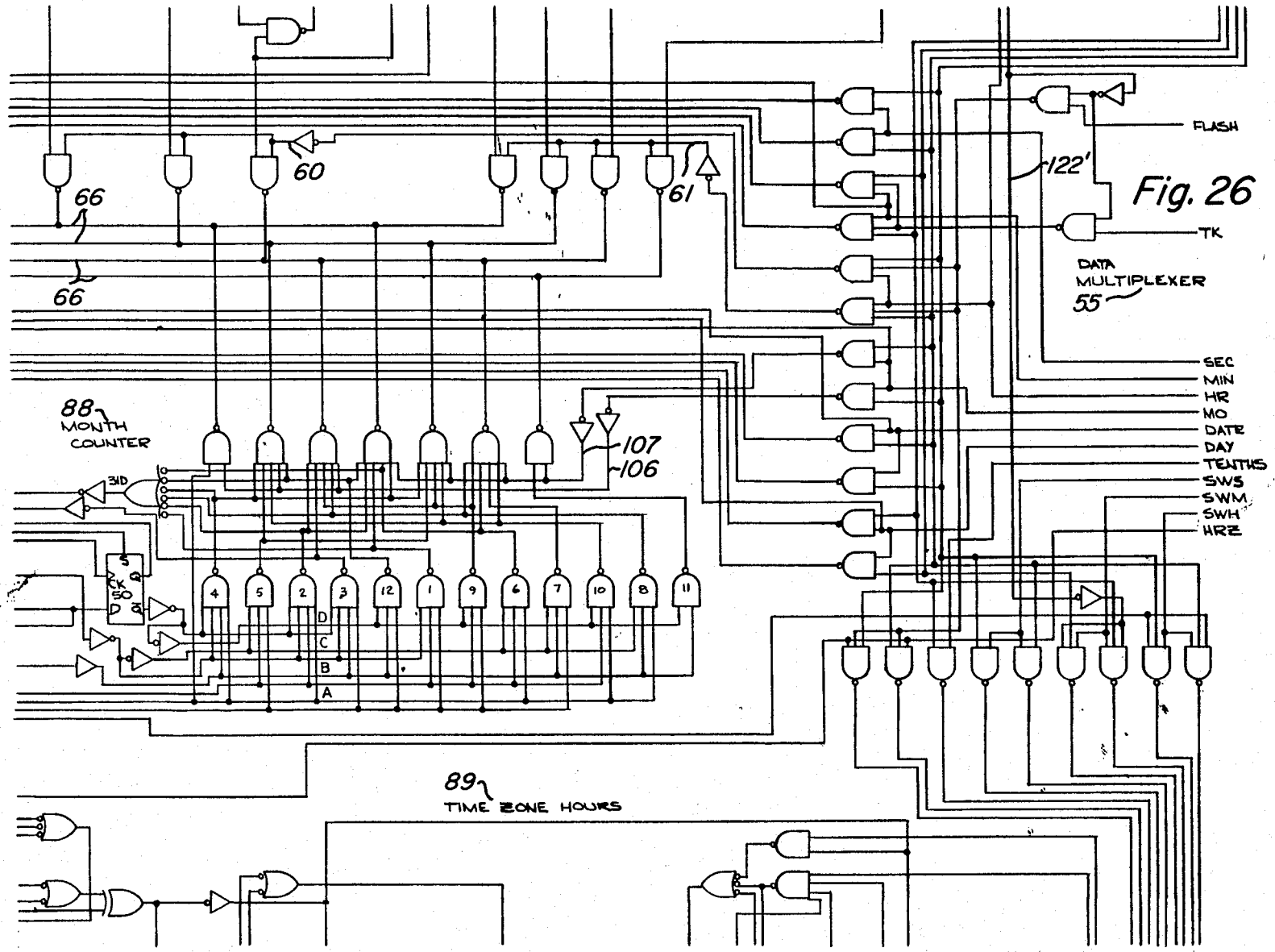
Figure 27:
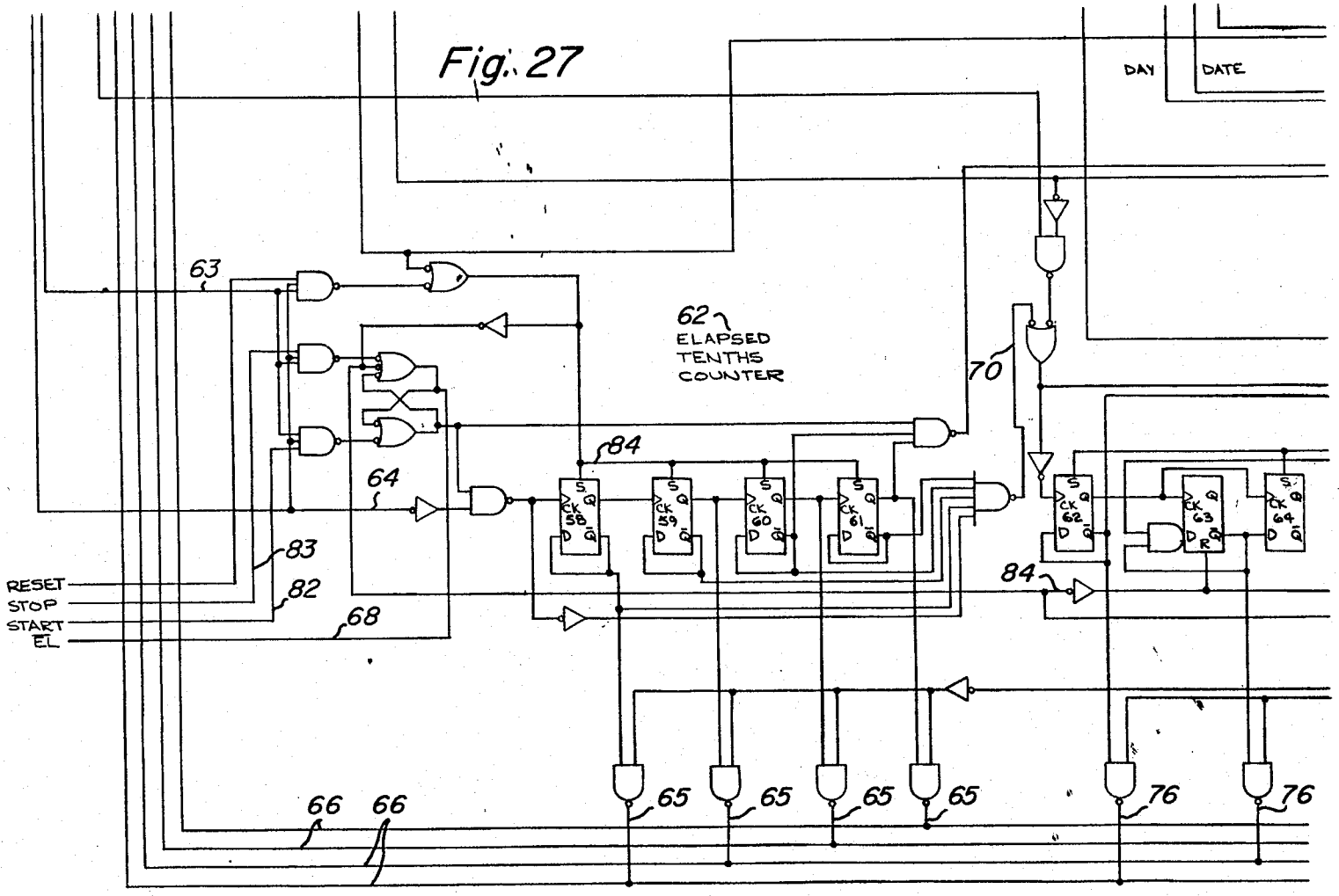
Figure 28:
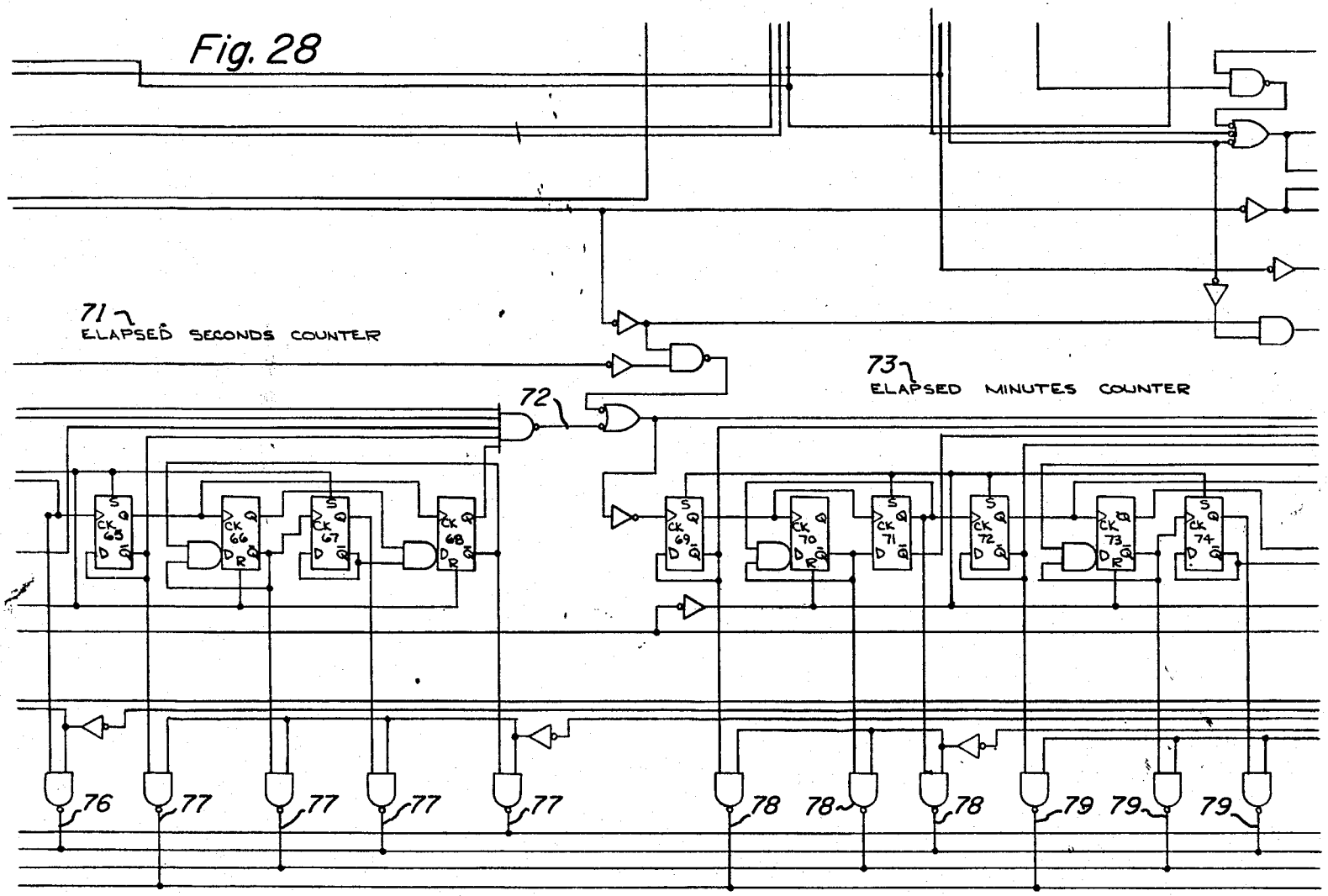
Figure 29:
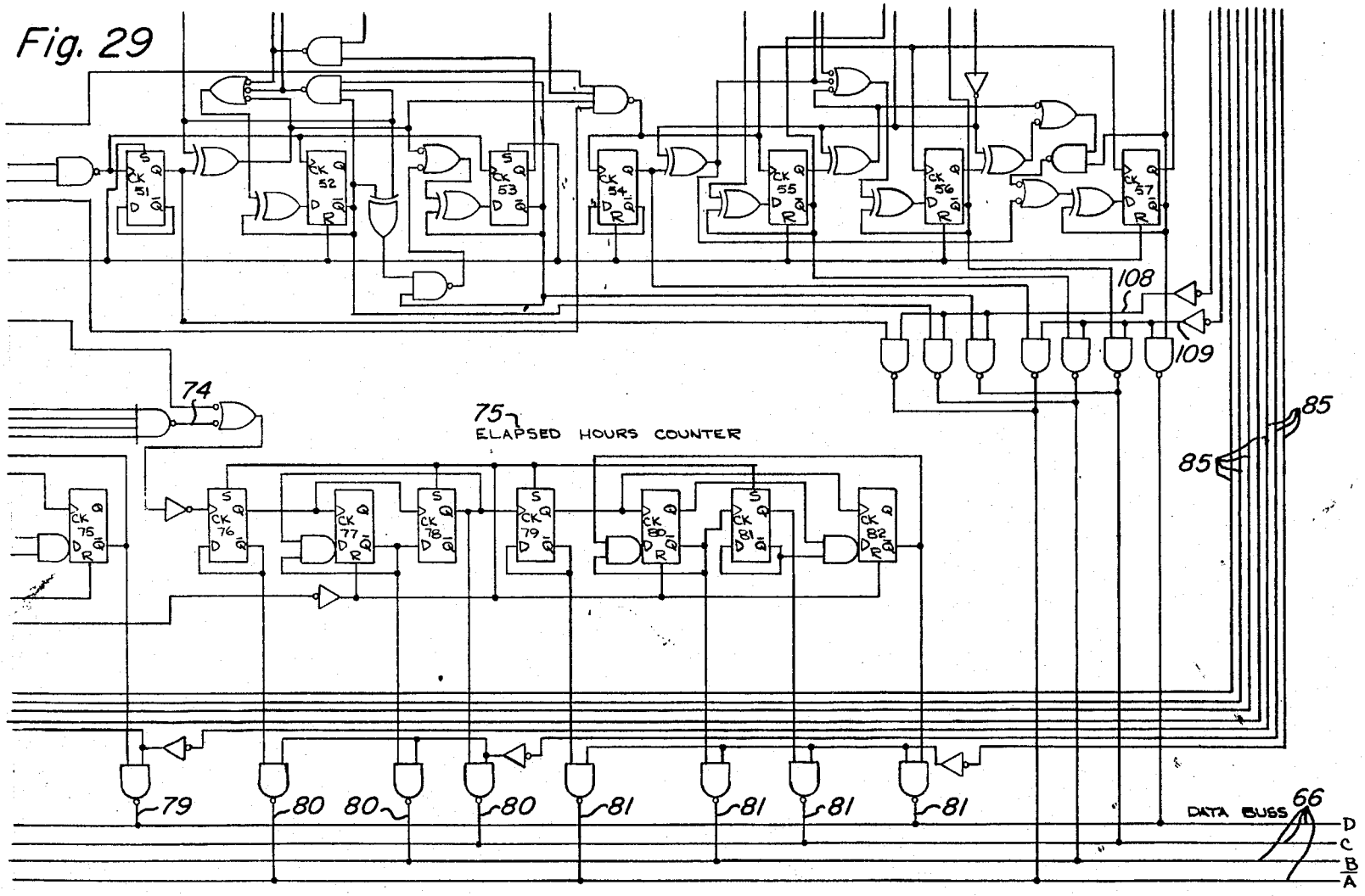
Figure 30:
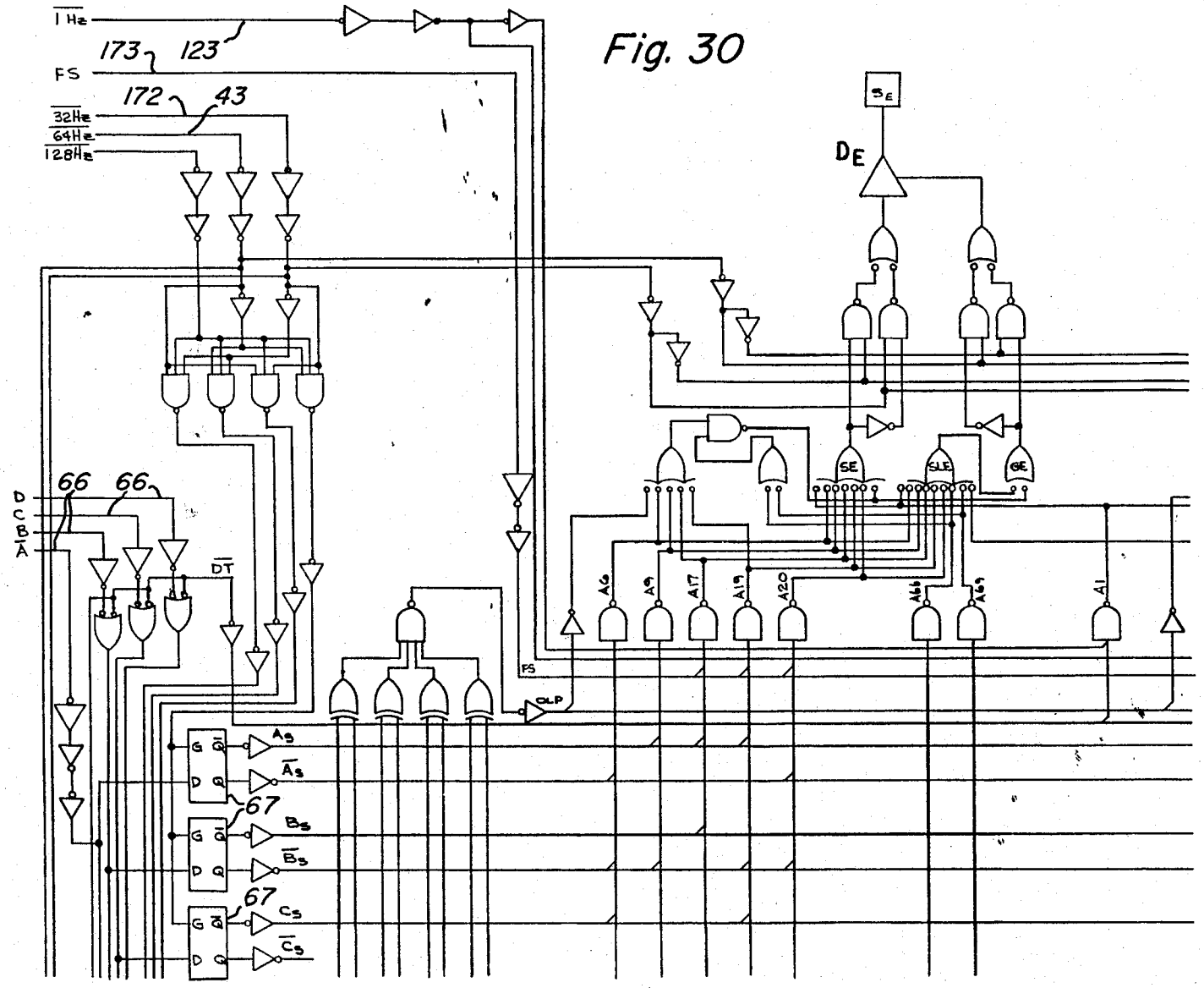
Figure 31:
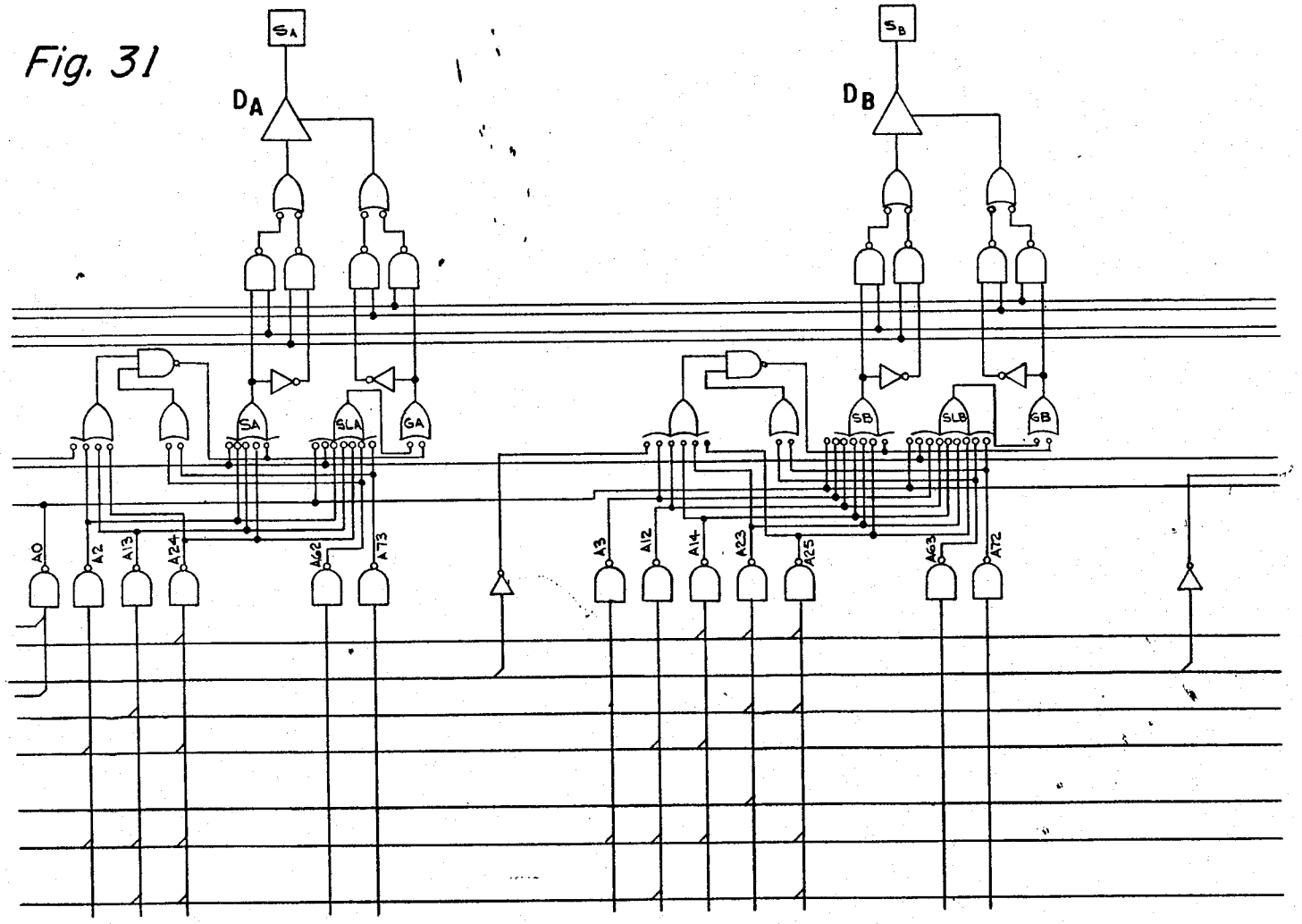
Figure 32:
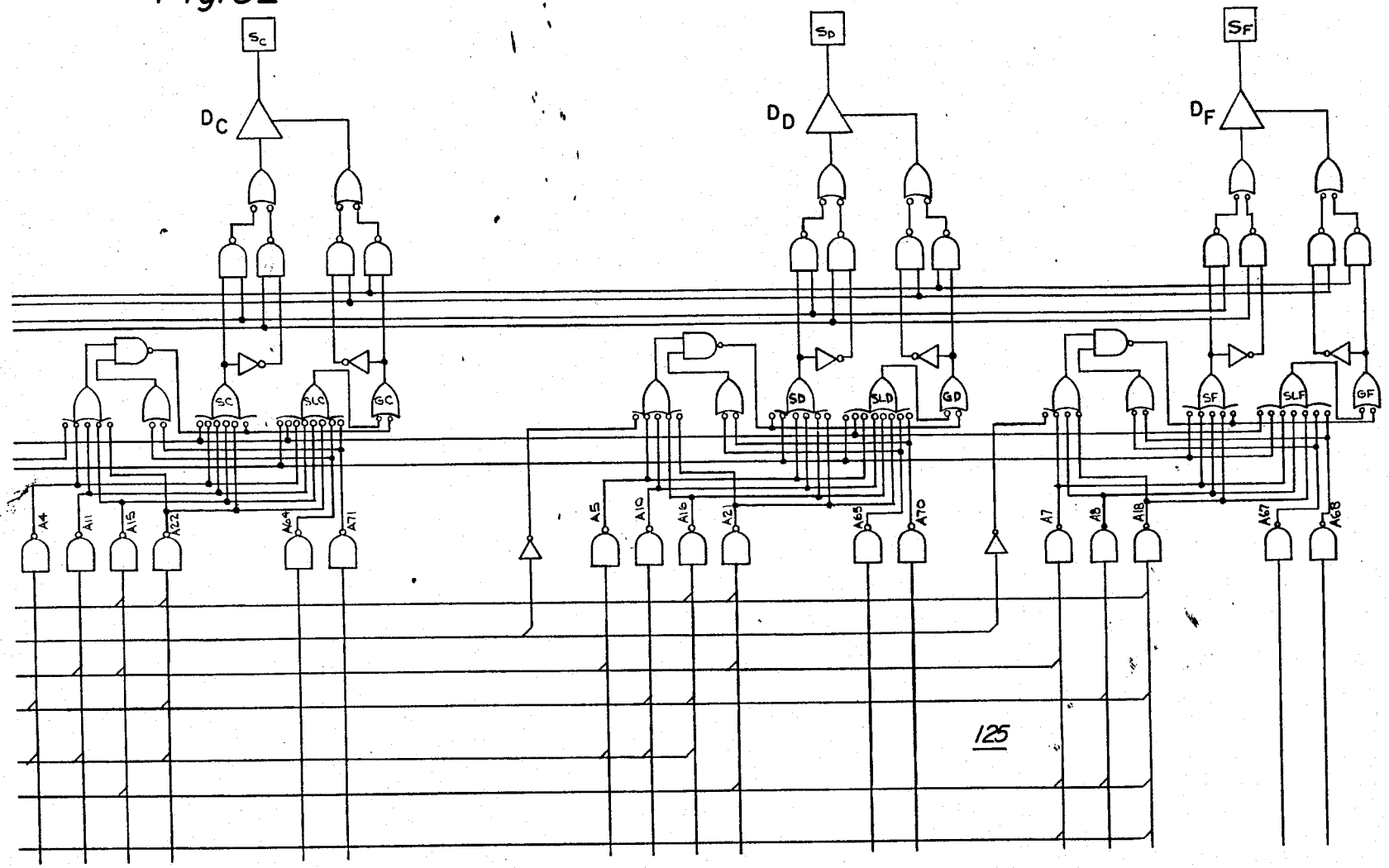
Figure 33:
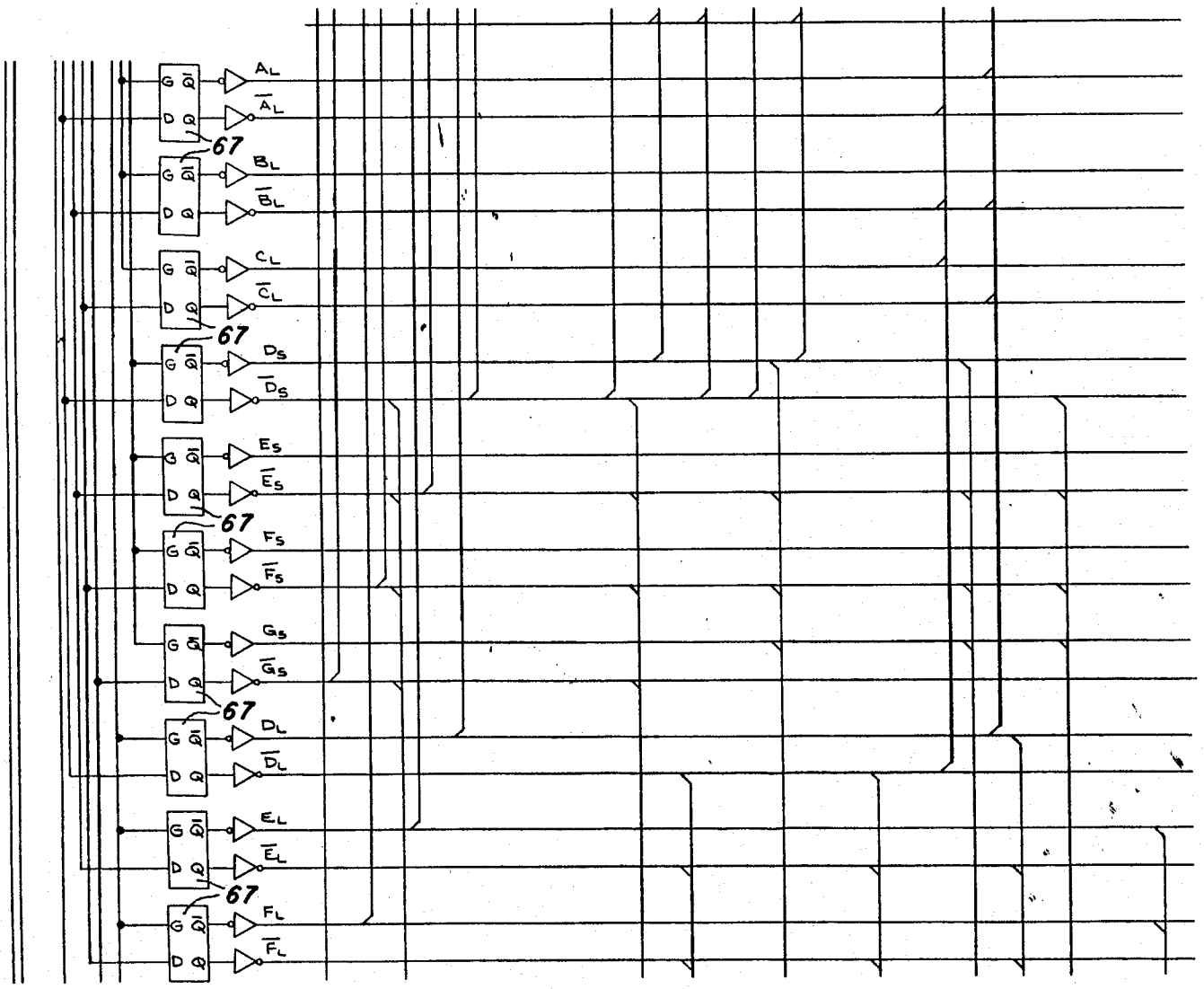
Figure 34:
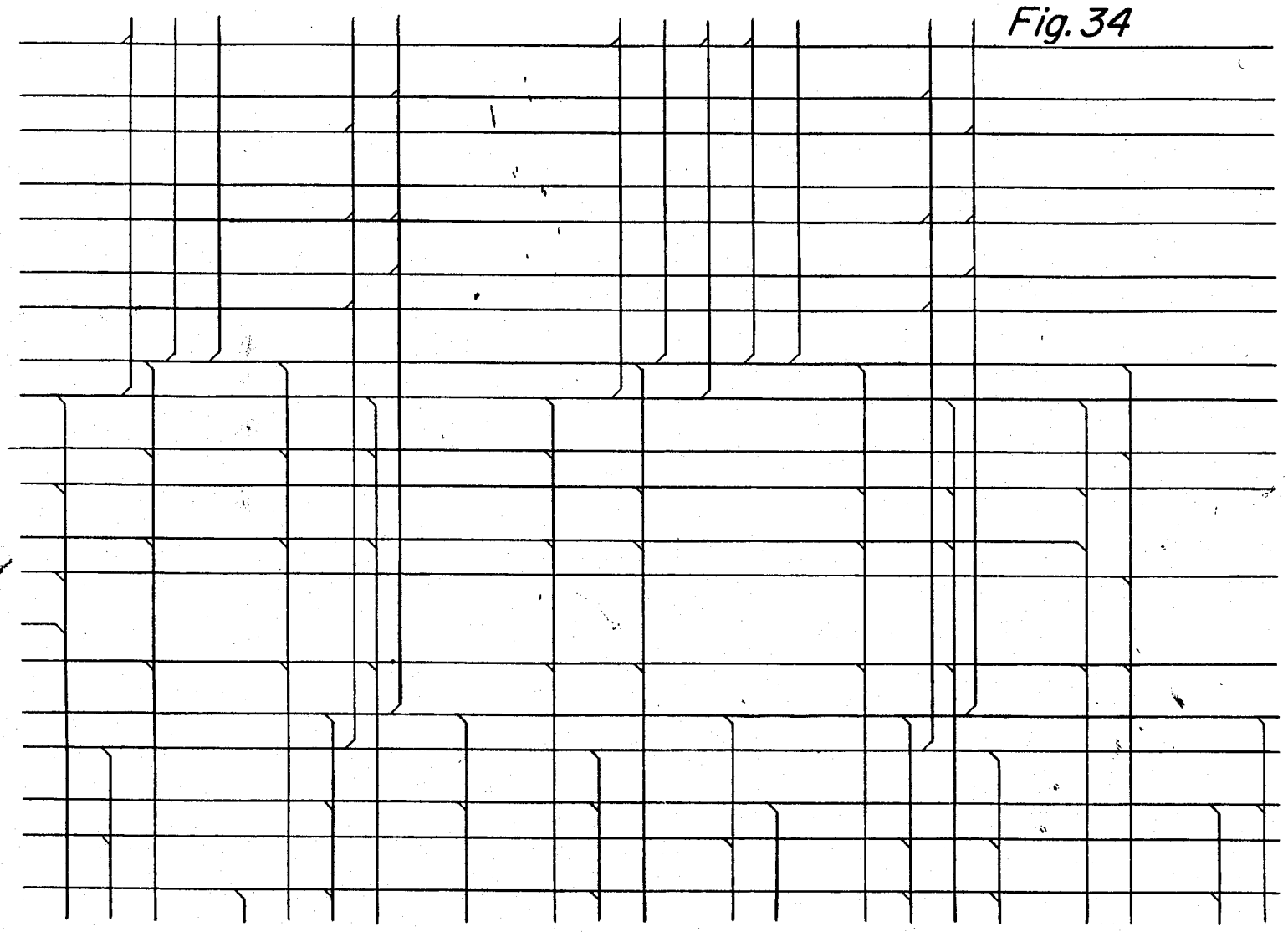
Figure 35:
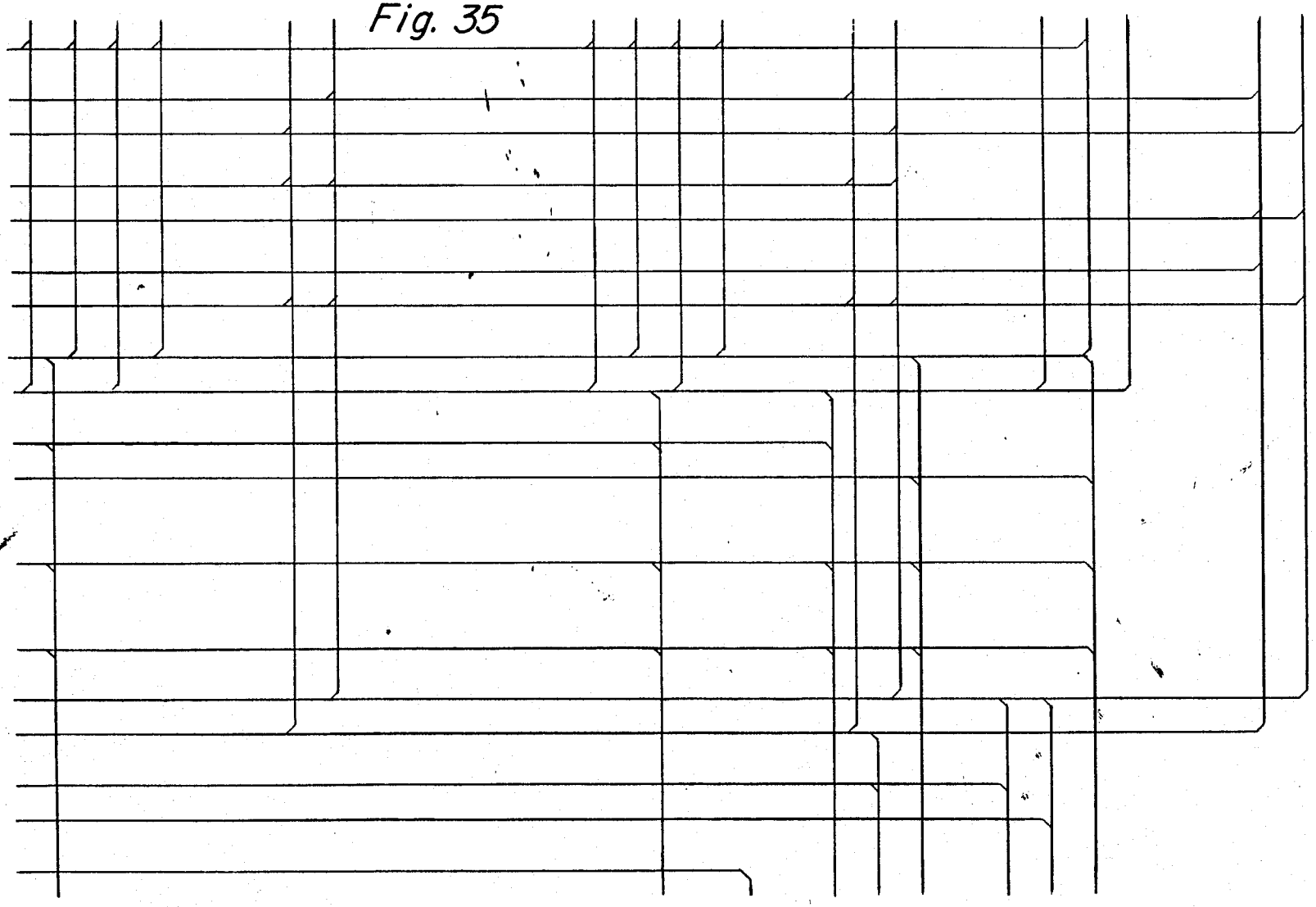
Figure 36:
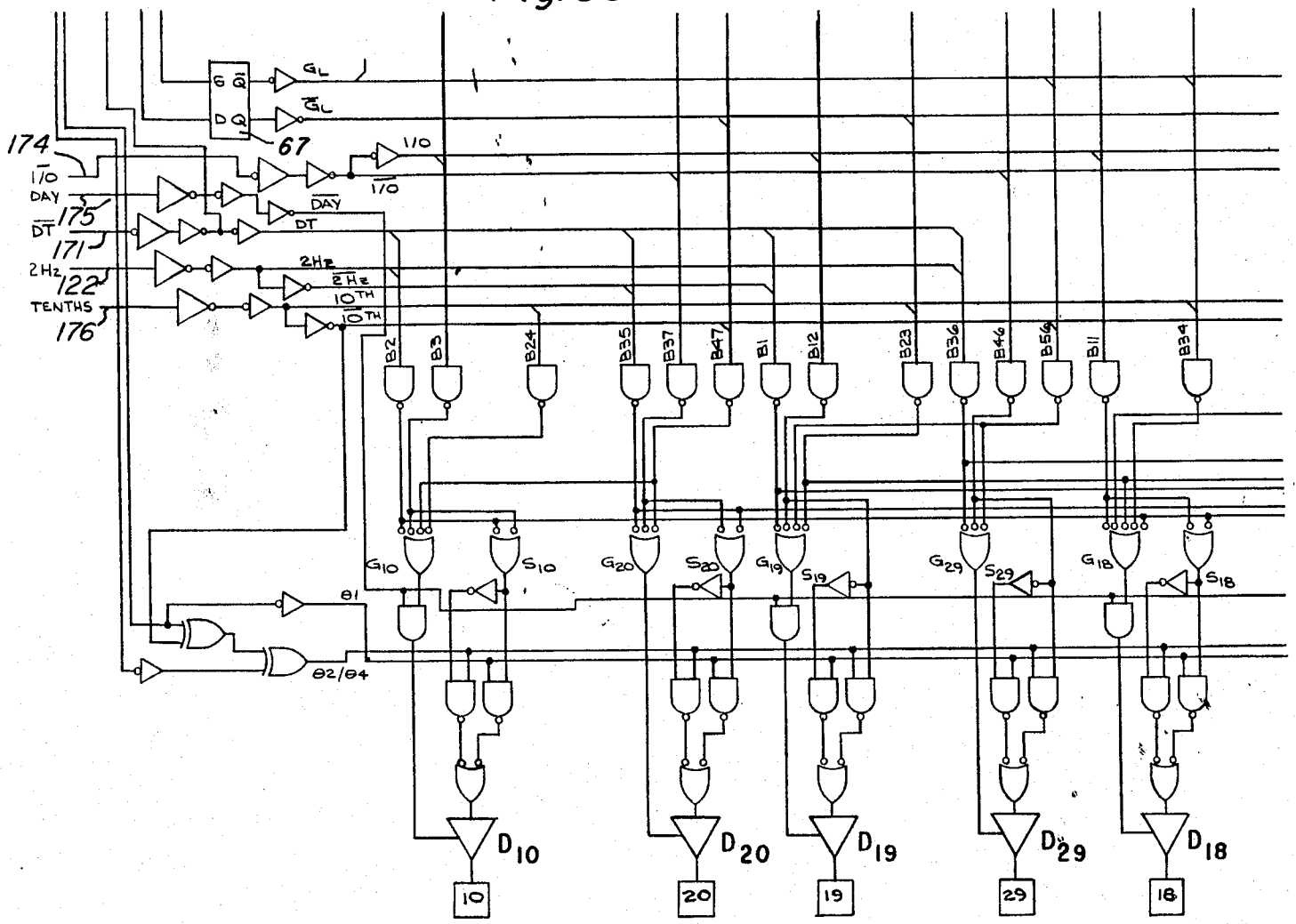
Figure 37:
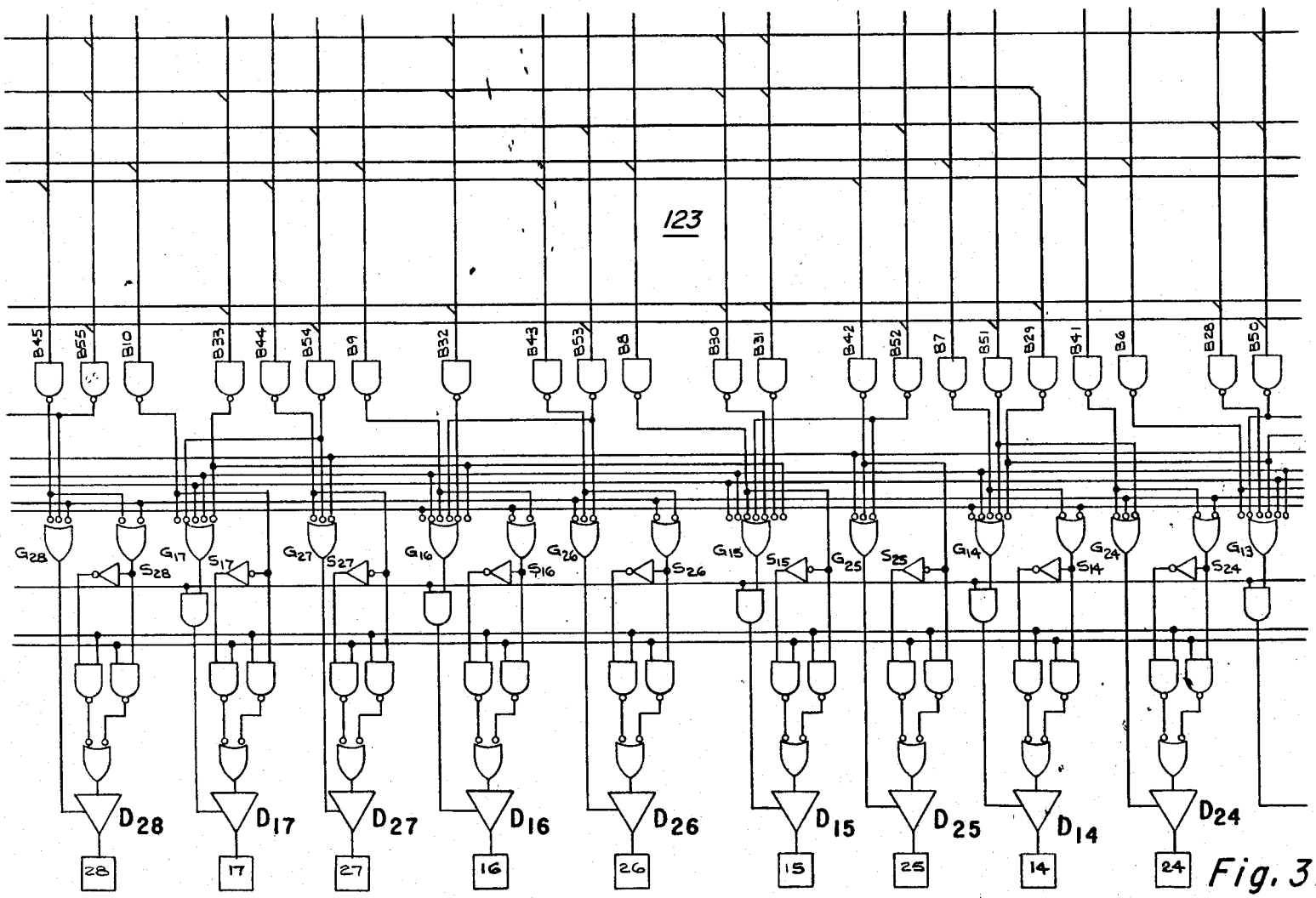
Figure 38:
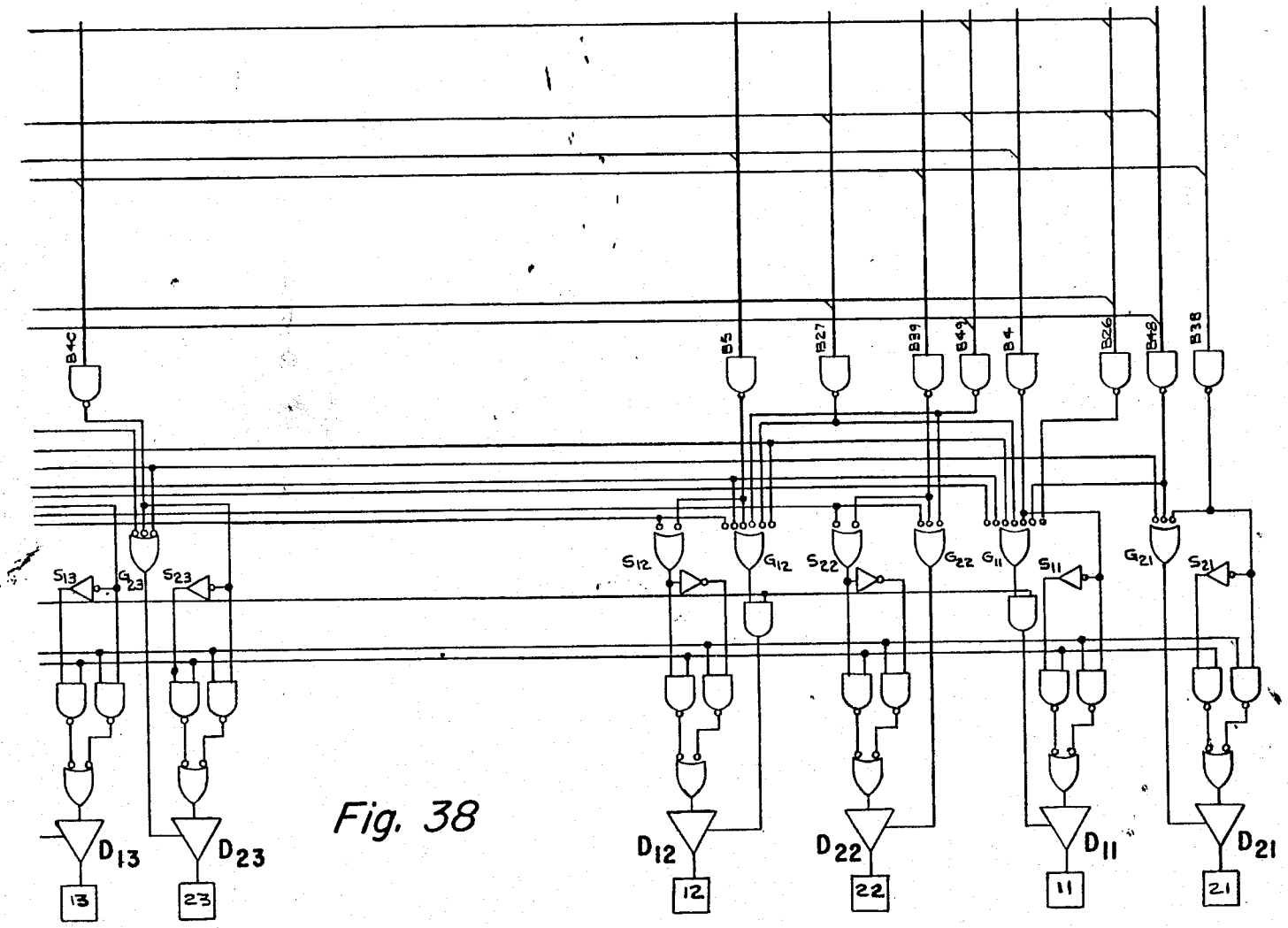
Figure 39:
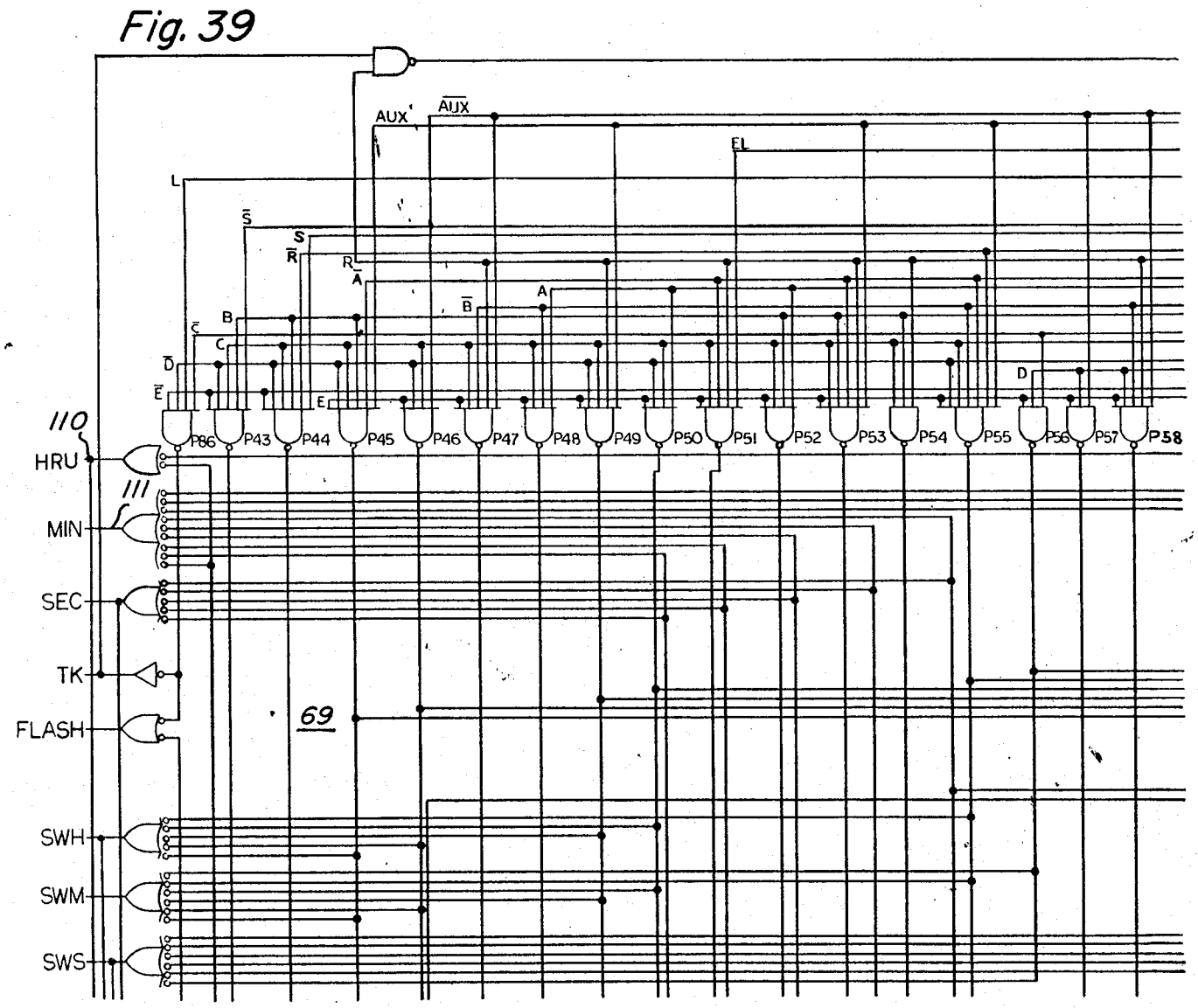
Figure 40:
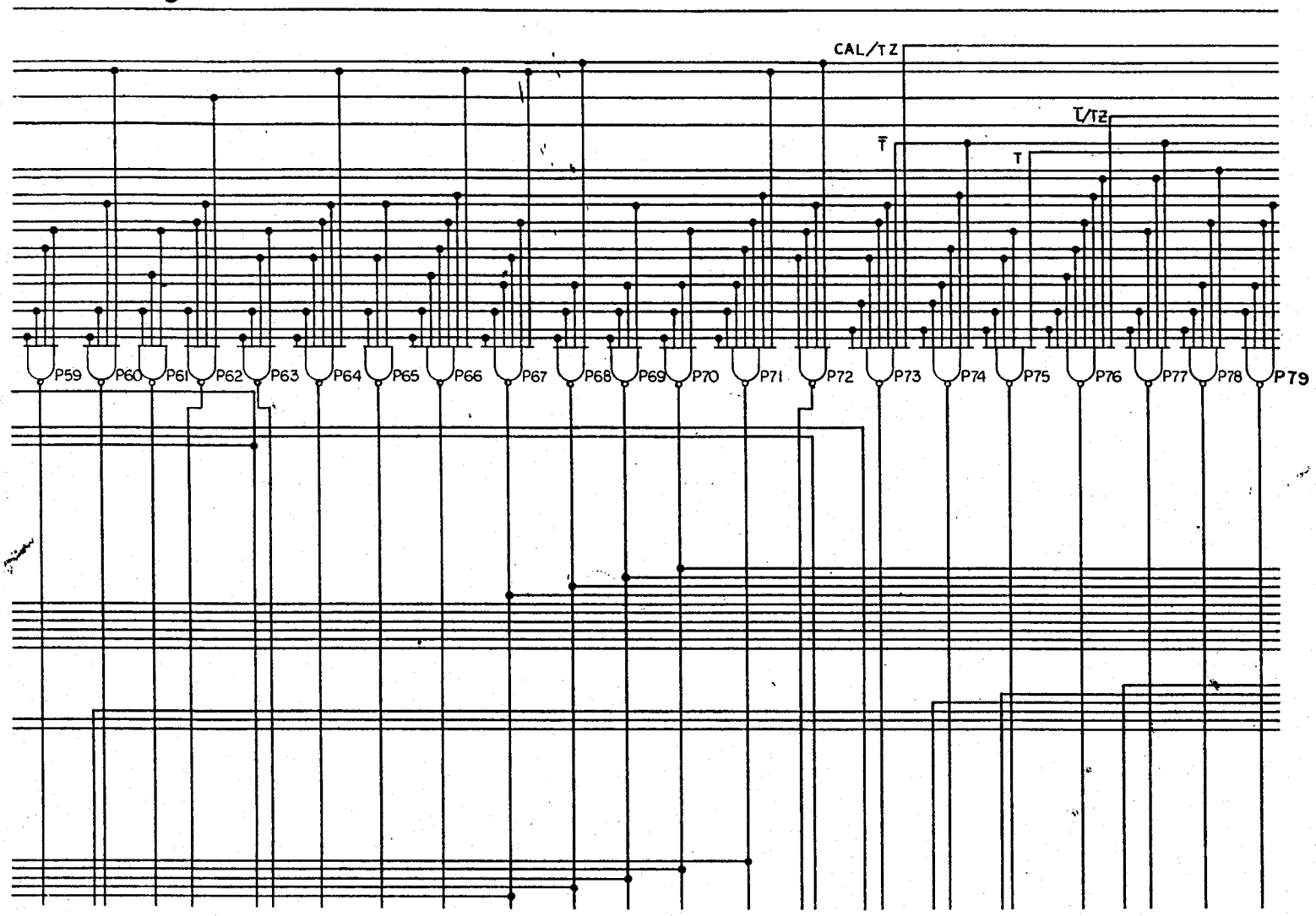
Figure 41:
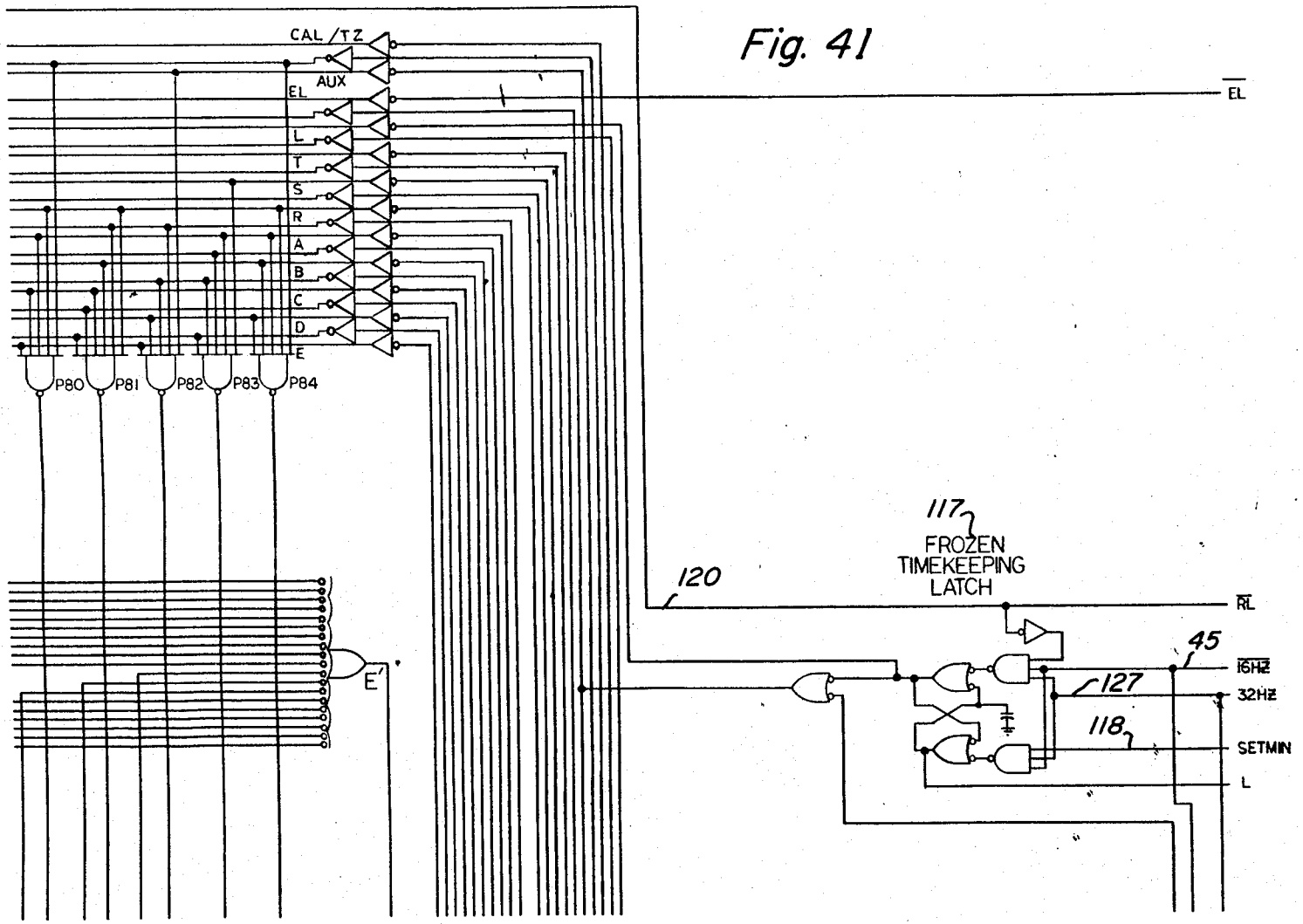
Figure 42:
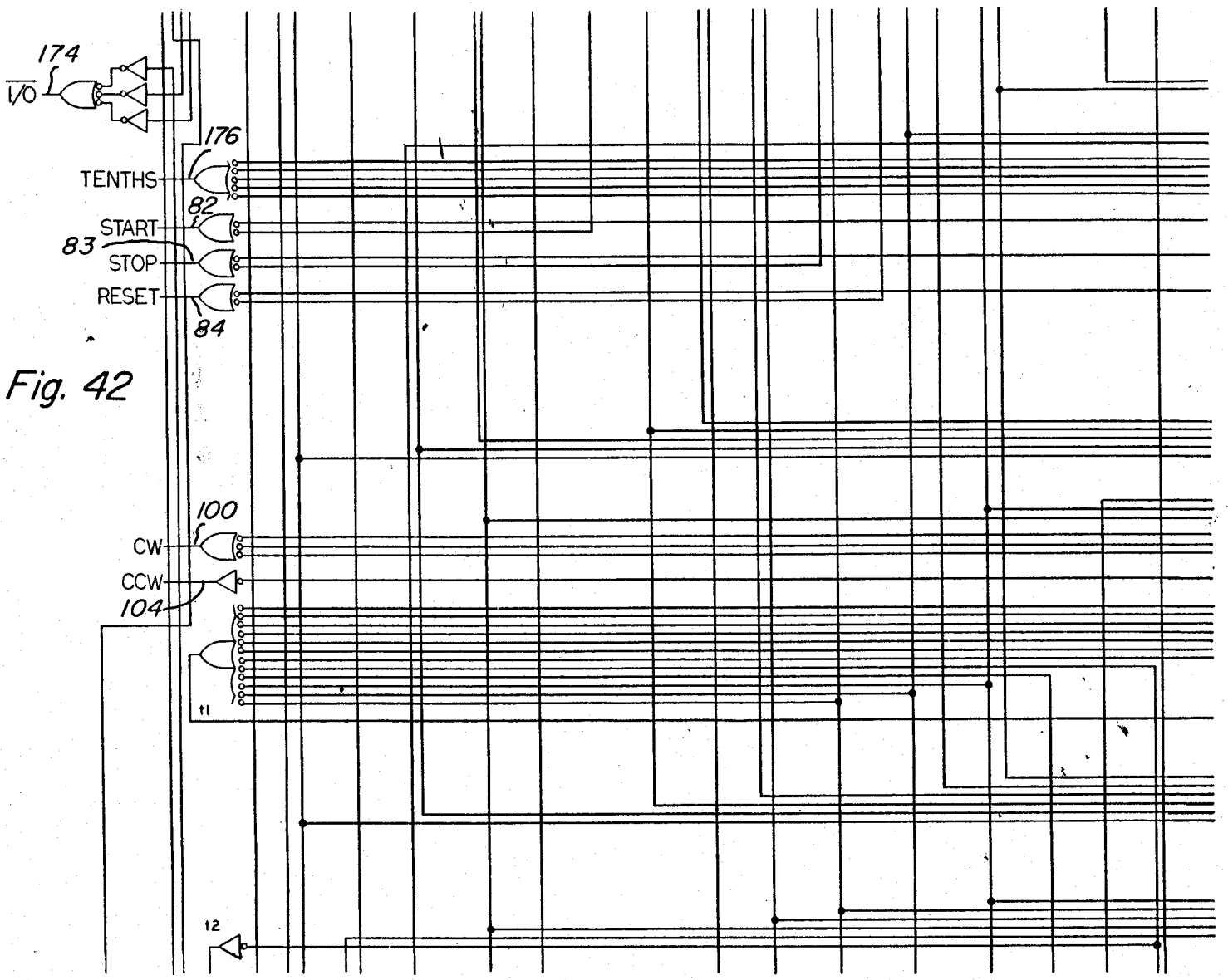
Figure 43:
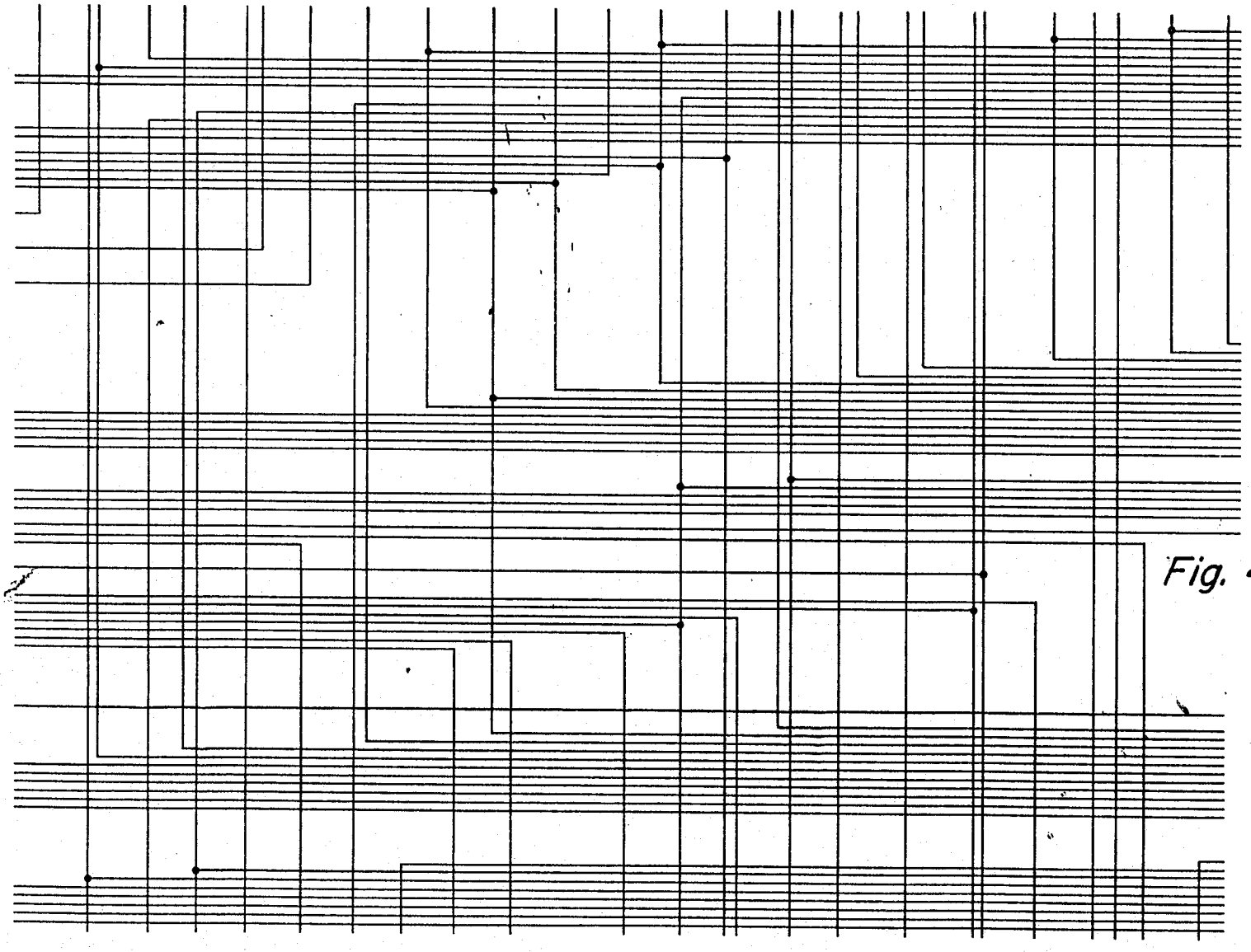
Figure 44:
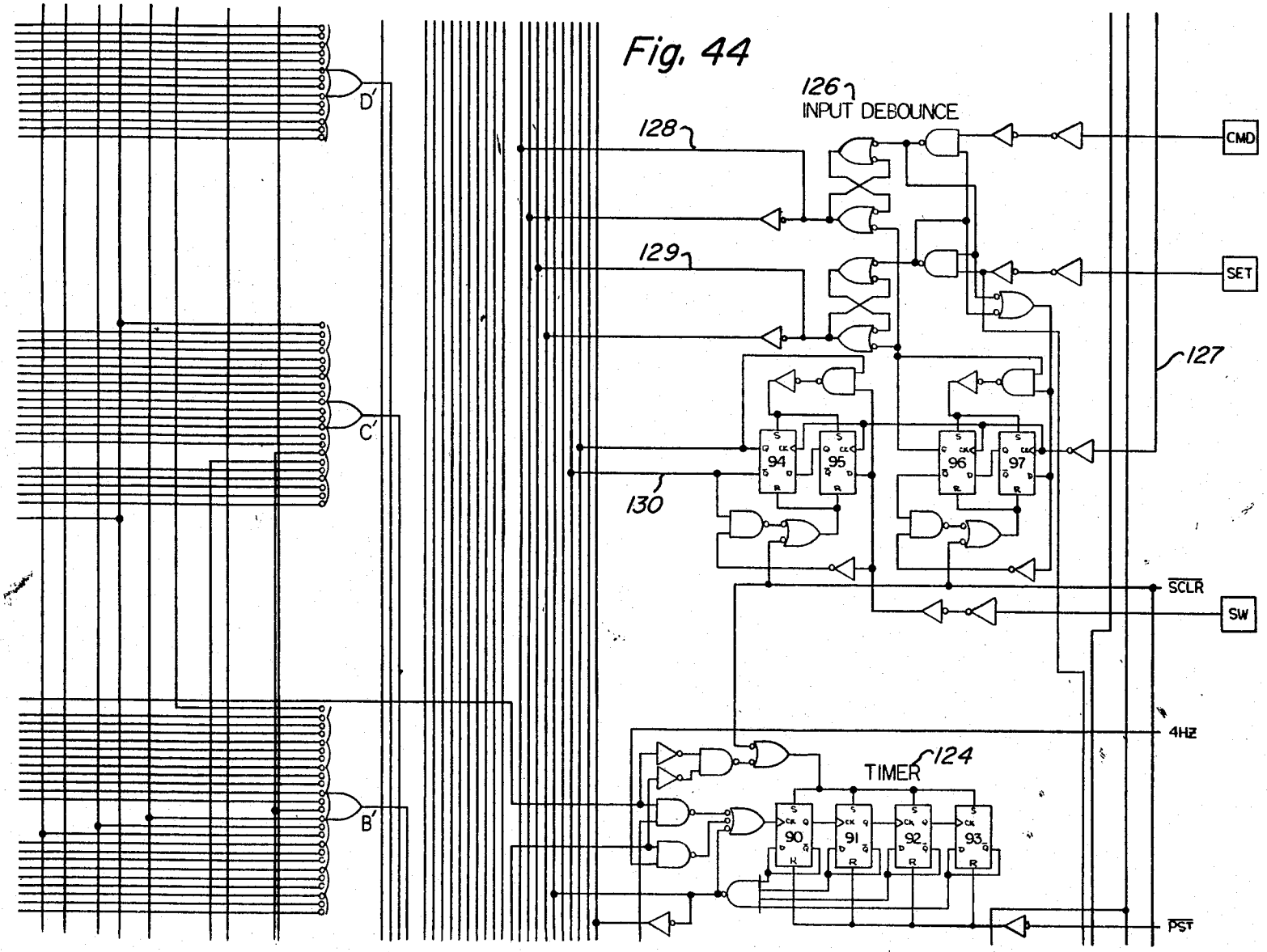
Figure 45:
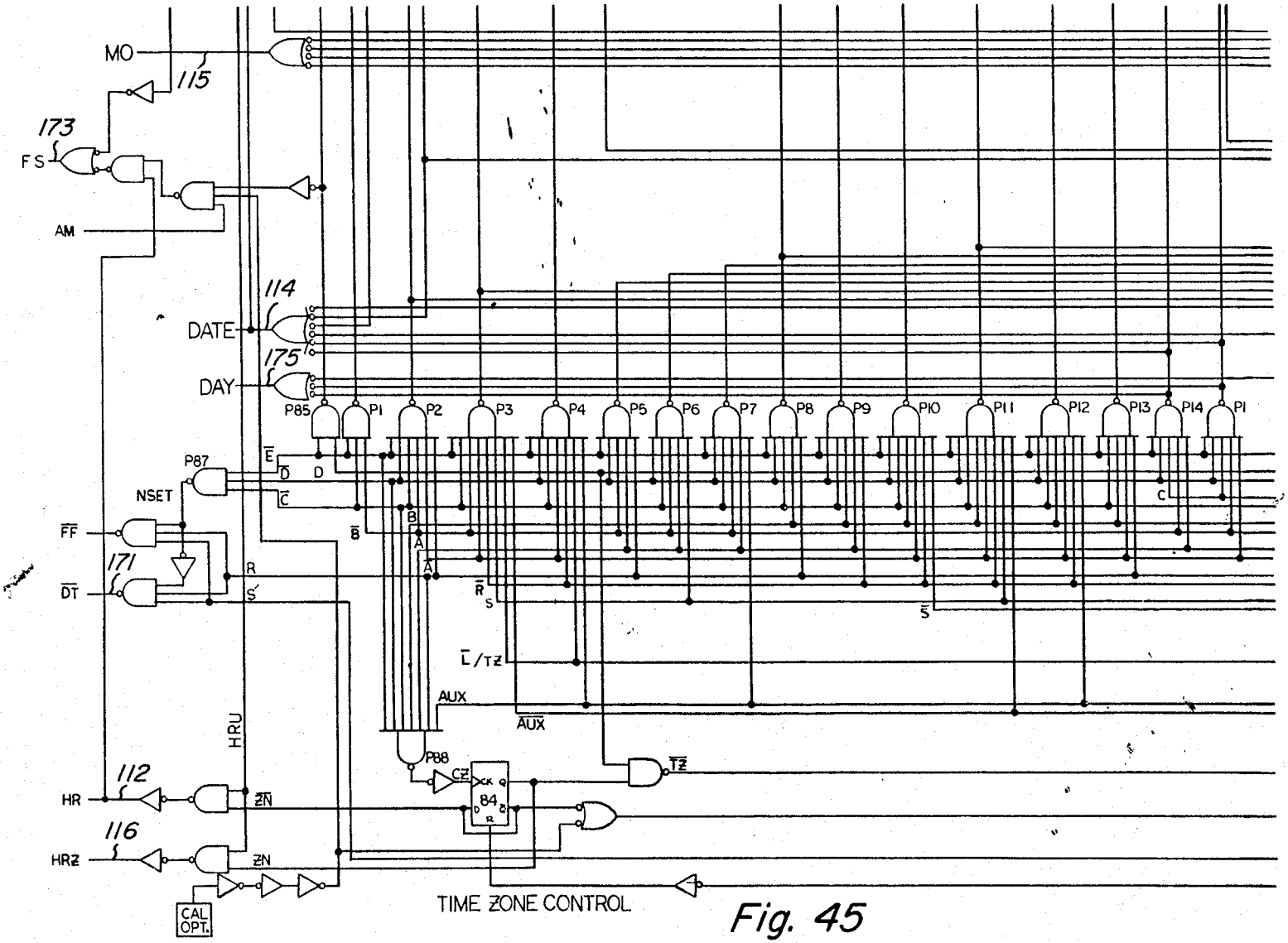
Figure 46:
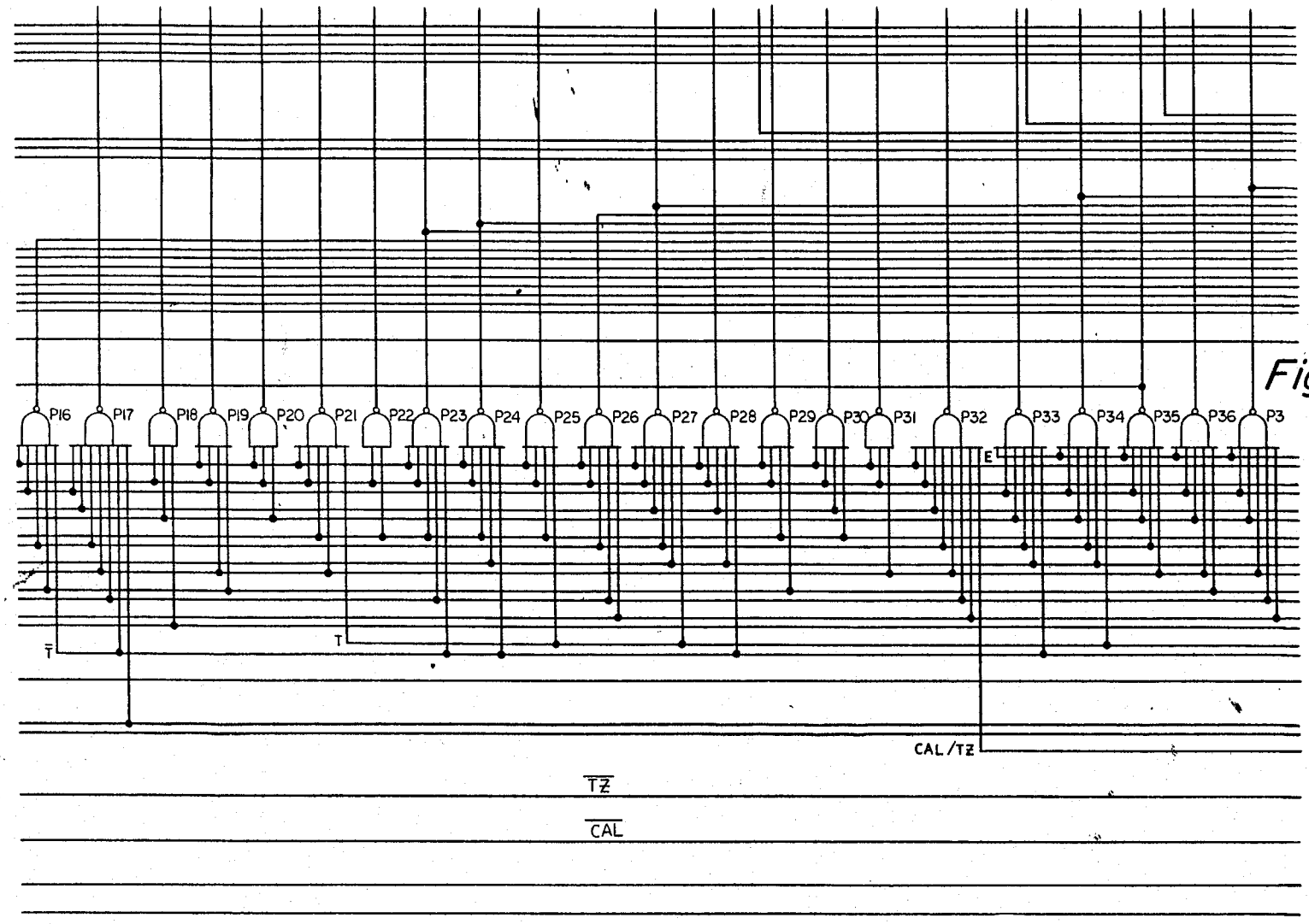
Figure 47:
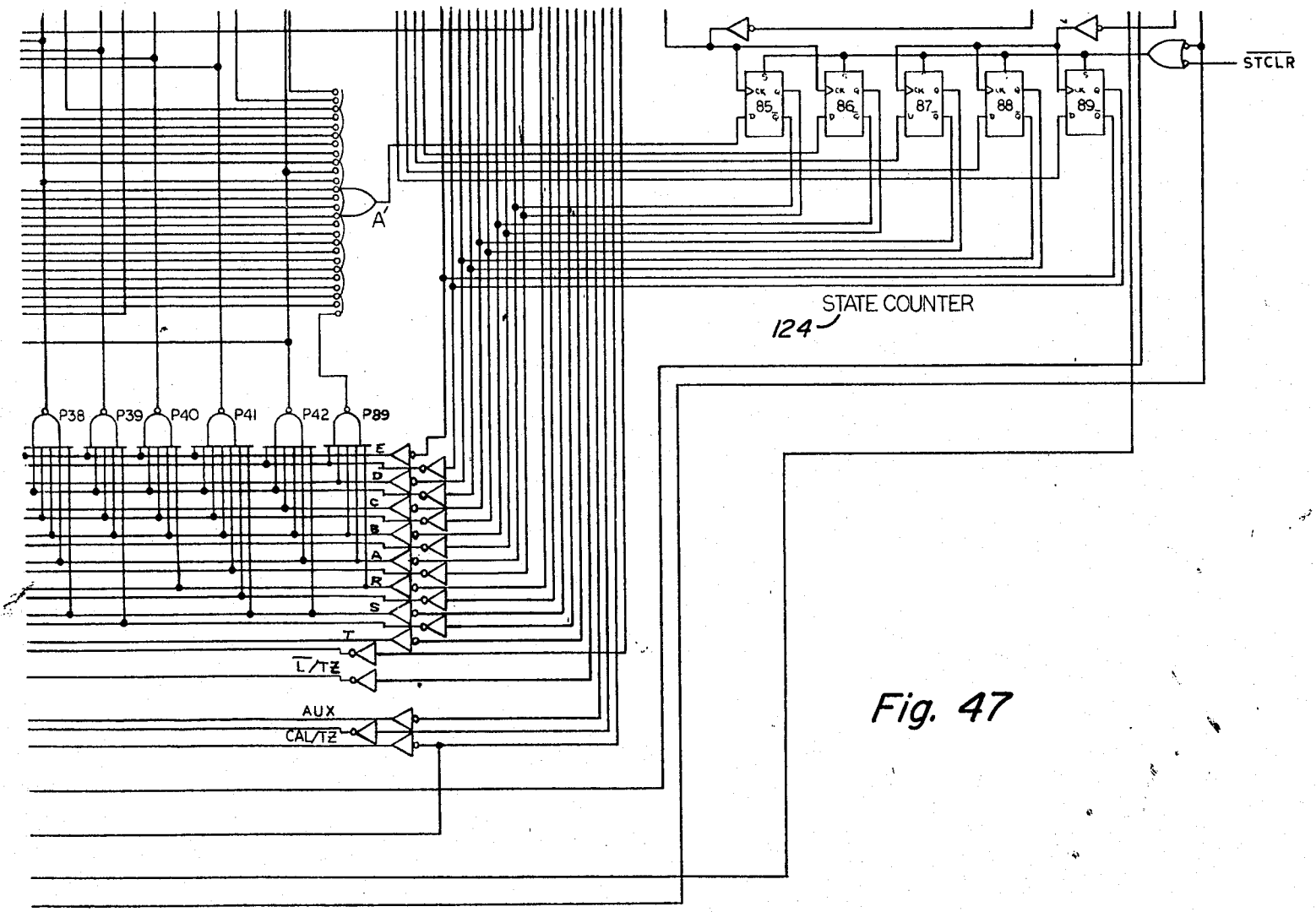
Figure 49A:
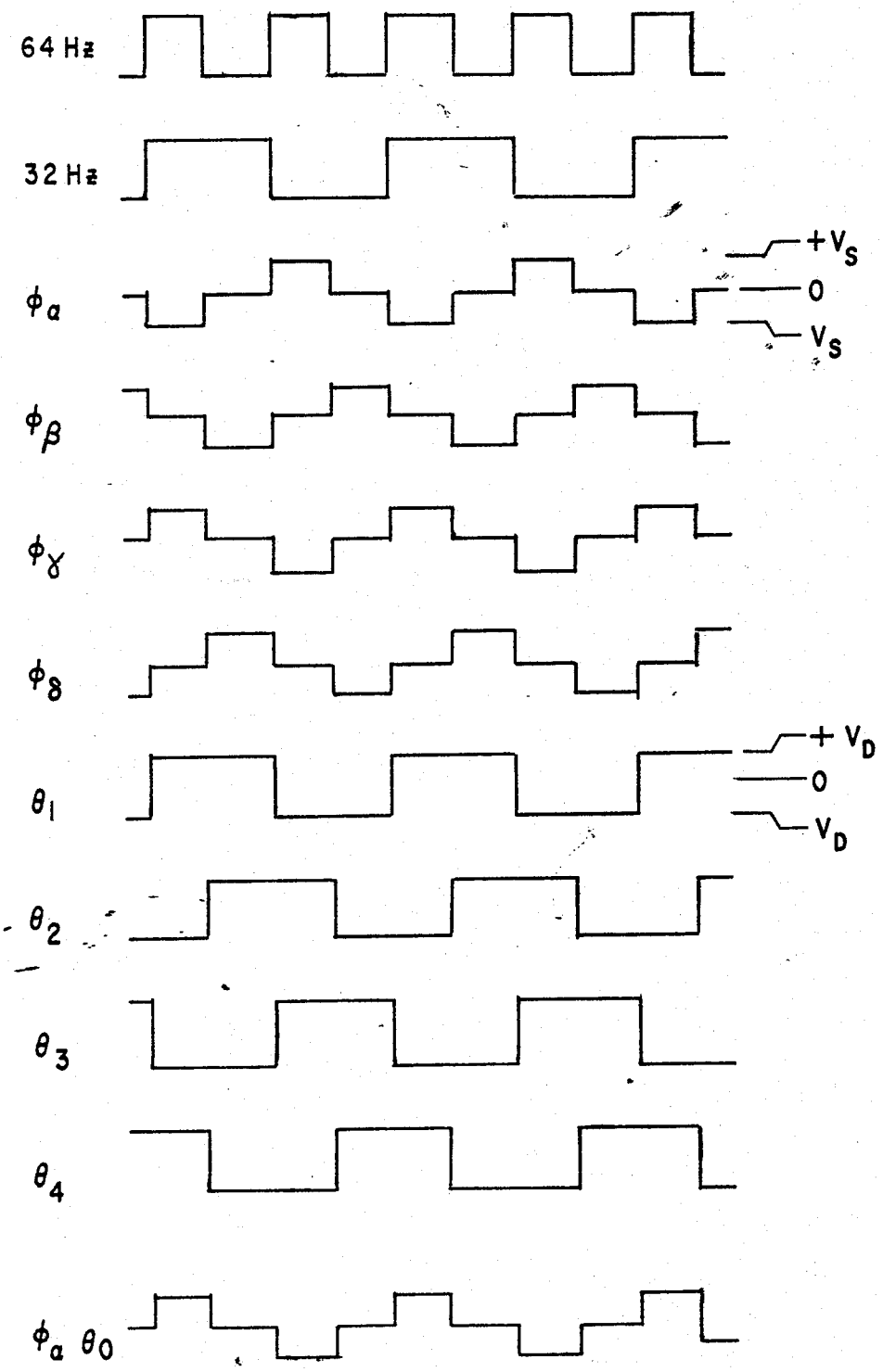
Figure 49B:
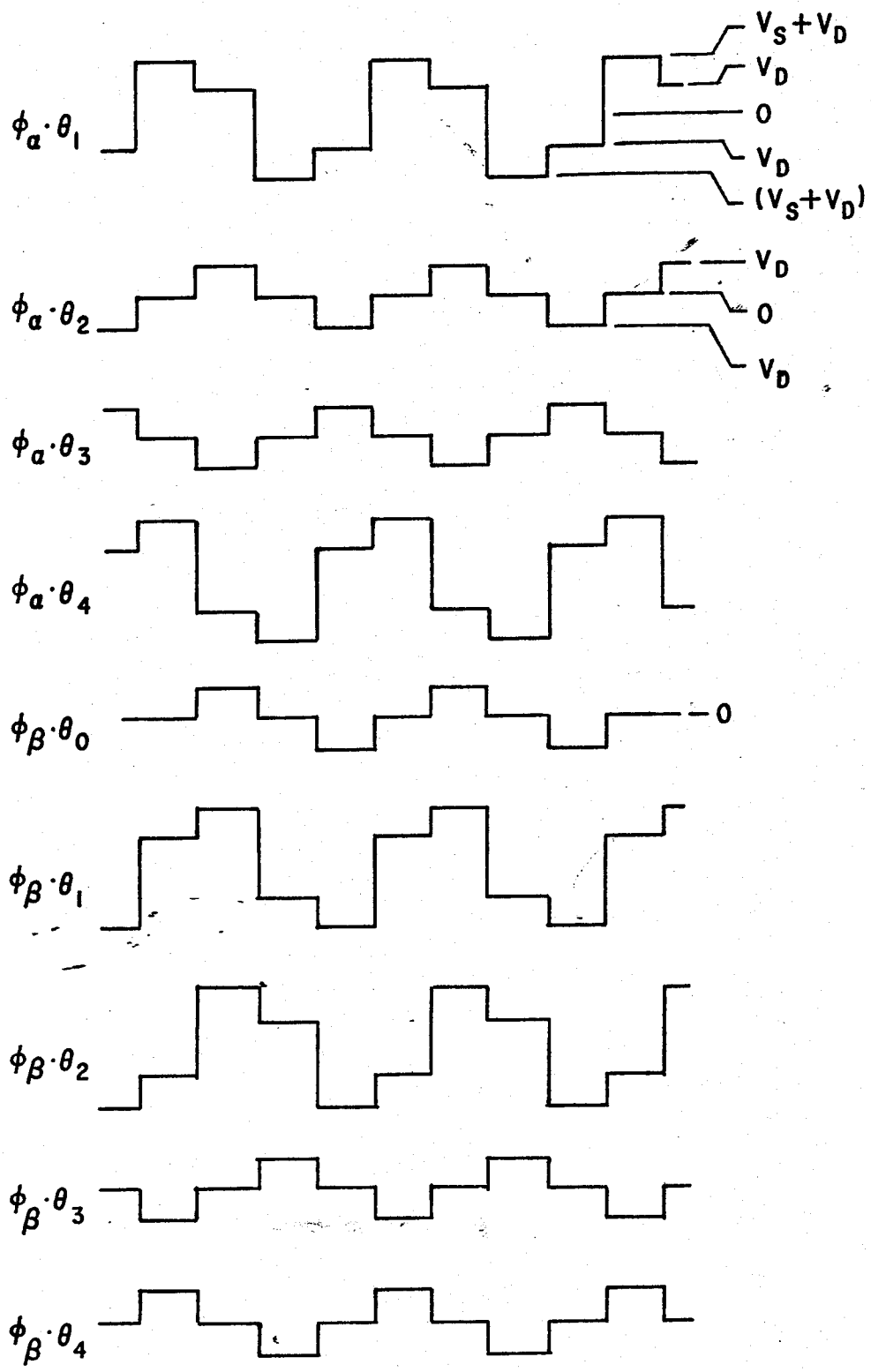
Figure 49:
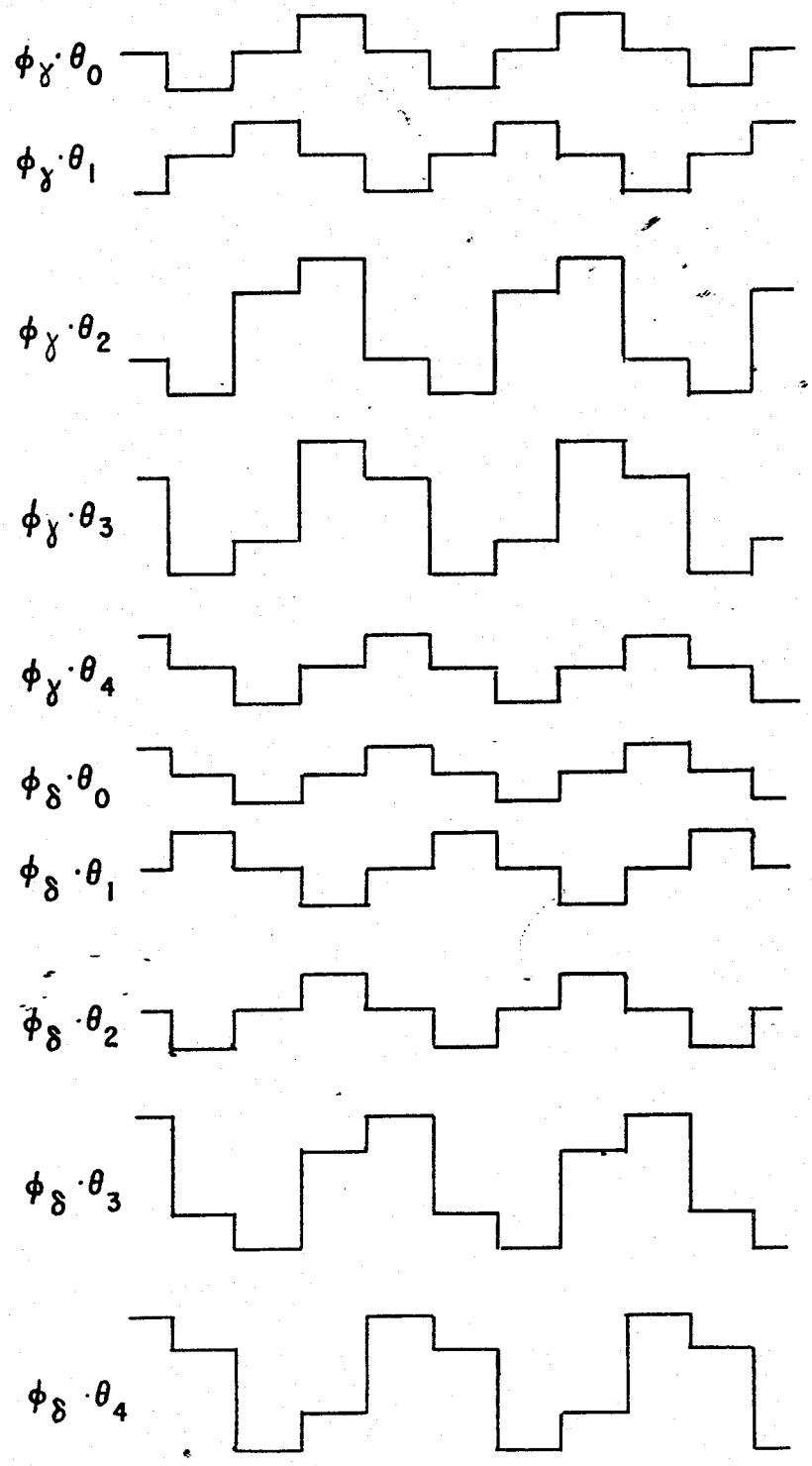

FIG. 3*a* is another similar view depicting the display when in the calendar display mode;

FIG. 3*b* is a view alternative to FIG. 3*a* and also depicting the display when in the calendar display mode;

FIG. 4 is yet another similar view depicting an indication of a time zone when in the time zone display mode;

FIG. 5 is another similar view depicting the display when in the elapsed time hours-minutes display mode;

FIG. 6 is yet another similar view depicting the display when in the elapsed time minutes-seconds display mode;

FIG. 7 is yet another similar view depicting the display when in the elapsed time seconds and tenths of seconds display mode;

FIG. 8 depicts an embodiment showing an analog display format in which any of the configurations of FIGS. 1–2 and 4–7 can be combined in a composite display;

FIG. 9 depicts a format similar to that of FIG. 8 except for a rectangular rather than circular format of the display;

FIG. 10 is a detailed plan view of an analog display embodying the principles of the invention;

FIG. 11 is a cross section through the view of FIG. 10;

FIG. 12 is a detailed plan view depicting a preferred construction for the segments of FIG. 10;

FIG. 13 is a detailed plan view depicting a preferred construction for the planes of FIG. 10;

FIG. 14 depicts typical display electrical characteristics and associated drive waveforms;

FIGS. 15 and 16 constitute a block diagram depicting circuitry in accordance with the invention;

FIG. 17 is a block diagram showing the related placing of FIGS. 15 and 16;

FIG. 18 is a block diagram showing the related placing of FIGS. 21–29 inclusive to form a logic diagram;

FIG. 19 is a block diagram showing the related placing of FIGS. 30–38 inclusive to form another logic diagram;

FIG. 20 is a block diagram showing the related placing of FIGS. 39–47 inclusive to form yet another logic diagram;

FIGS. 21–29 inclusive are partial logic diagrams which, when joined together as shown in FIG. 18, form a diagram depicting the logic circuits of those elements of the system depicted in FIGS. 15 and 16 to the left of the dashed vertical line;

FIGS. 30–38 inclusive are partial logic diagrams which, when joined together as shown in FIG. 19, form a diagram depicting the logic circuits of those elements of the system depicted within the lower right hand corner of FIGS. 15 and 16 as bounded by the dashed lines;

FIGS. 39–47 inclusive are partial logic diagrams which, when joined together as shown in FIG. 20, form a diagram depicting the logic circuits of those elements of the system depicted within the upper right hand corner of FIGS. 15 and 16 as bounded by the dashed lines;

FIG. 48 is a logic flow diagram depicting the functional activity of the control PLA of FIGS. 15 and 16;

FIG. 49 is a series of diagrams depicting typical waveforms of electrical potentials suitable for application to the display;

FIG. 50 is a matrix representation of the signal combinations of FIG. 49 as they relate to the generation of desired display responses; and FIG. 51 is a table which depicts an appropriate combination of clock signals to generate desired waveforms.

Figure 1:
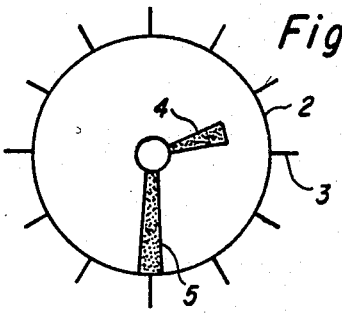
FIG. 1 is a top plan view of the display of a timepiece embodying the principles of the invention and displaying time by minutes and hours.

Now turning more particularly to the drawings, it will be observed that in FIG. 1 there is depicted the face of a conventional circular analog timepiece 1 having disposed about the circular periphery 2 thereof a plurality of marks 3 disposed at thirty degree increments and indicating the conventional locations for hours and for increments of five minutes. Also depicted are hour hand 4 and minute hand 5. Hour hand 4 is depicted as being somewhat wider and shorter than minute hand 5 for reasons given hereafter in greater detail. However, hour hand 4 could be made the same width or even narrower than minute hand 5 without departing from the spirit and scope of one preferred embodiment of the invention.

Figure 2:
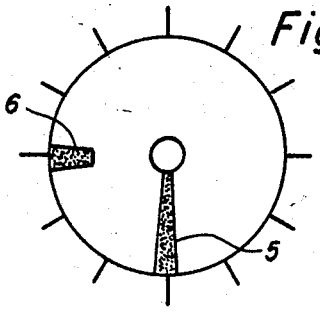
FIG. 2 is a similar plan view depicting the display when in the minutes-seconds display mode.

FIG. 2 depicts the display in the mode when presenting an indication of minutes and seconds wherein it will be observed that, in addition to minute hand 5, a visual representation of seconds is presented by the shortened segment 6.

FIG. 3*a* depicts the display when in the calendar mode wherein it indicates the day of the week and the day of the month. In the embodiment of FIG. 3*a*, days of the week are represented by the arabic numerals S M T W T F and S, and the days of the months are indicated by the respective numerical positions 1 through 31 which are also used for depicting time. Thus, in FIG. 3*a*, segment 7 which is positioned adjacent the numerical position 25 indicates the 25th day of the month; and segment 8 which is shown located at the F position indicates the day of the week to be Friday. However, the indicators could as readily be designated with different symbols or they could begin and end with different day indicators. For example, the days of the week could as readily begin with Monday and end with Sunday.

FIG. 3*b* depicts one alternative configuration according to which the days of the week are disposed radially around the upper circumference and the days of the month are disposed radially around the lower circumference of the display.

FIG. 4 shows the display in the time zone indicator mode, wherein the relatively narrow hour hand 9 indicates that the display is not depicting local but rather time zone time. Thus, in the example illustrated in FIG. 4, the display indicates that the time in the specified zone is two hours later than the local time as presented in FIG. 1.

FIGS. 5, 6 and 7 depict a display in elapsed time modes wherein symbols 4', 5' and 6' and 10 respectively denote hours, minutes, seconds and tenths of seconds. Thus, the display of FIG. 5 indicates an elapsed time of one hour, 25 minutes; FIG. 6 shows 25 minutes, 39 seconds; and FIG. 7 shows 39 3/10th seconds.

In FIG. 8, there is depicted a display embodying a circular format similar to that of the preceding figures except that the calendar and date feature of FIG. 3*a* are separately included as indicators within the rectangular openings 11 and 12. As thus depicted, the date is shown to be Friday the 23rd day of the month. However, these indications of calender information may be disposed about the perimeter of the analog format at any convenient or desired location.

FIG. 9 depicts a display similar to that of FIG. 8 except for the shape which is shown to be essentially square or rectangular instead of circular. The hands may lengthen and shorten themselves as necessary to fit the rectangular format as the hands progress around the perimeter.

The displays herein described advantageously exploit the properties of materials known in the art as liquid crystals. These are well known in the technical literature and their properties are well known to persons skilled in the horological arts. Illustrated examples of references are included in the above-identified patents. It will be evident to one skilled in the art that the principles of the invention herein described are not dependent upon any particular type of liquid crystal substance and, in fact, are applicable to other substances whose light transmissive characteristics are changed by the application of suitable electric or magnetic fields.

Now turning to FIG. 10, it will be observed that there is therein depicted a partially cut-away and partially schematic view of a display embodying the principles of the invention. While this display is shown in essentially planar form, it will be evident to one skilled in the art that it could be made curved if desired for cosmetic or other purposes without departing from the spirit or scope of the inventive concepts.

To facilitate description and ease of understanding, FIG. 10 depicts a schematic of the display as reviewed from the bottom side, where the dashed lines represent outlines of the planes and conductors thereto. In both FIG. 10 and FIG. 11, like numerical designators identify like parts. It will additionally be observed that although FIG. 10 depicts a display from the bottom and that accordingly the segments 13 are shown above the planes 14 and 15, on the display as embodied in a conventional timepiece, the planes 14 and 15 may actually overlie the segments 13 as shown in FIG. 11. However, it will be readily apparent to one skilled in the art that the converse could be readily employed. Thus, for example, the segments 13 could in actuality be at a higher level (i.e., closer to the viewer) on the timepiece than the planes 14 and 15.

Now referring in more detail to FIGS. 10 and 11 as applied to a typical liquid crystal display, it will be observed that there is therein depicted a surface 16 which constitutes one wall of the overall enclosure 17. This enclosure is fabricated from a material which is highly light transmissive, for example, glass. In addition to the bottom member 18, the display is enclosed by sealant 19 and by top member 20, thus creating an internal field chamber 21. Within the chamber 21 is disposed the aforementioned liquid crystal or other optoresponsive material 22. Also enclosed within the chamber 21 are plane elements 14 and 15, segments 13, alignment layers 23, conductors 24 and blocking layers 25. These alignment layers, conductors and blocking layers may be of any materials commonly used for liquid crystal displays. Electrical connection from one member to the other (18 and 20) is by a conductive crossover 26. For a typical liquid crystal display, polarizers 27 are attached to the top and bottom members (18 and 20). In front-lit liquid crystal displays, an opaque or partially transmitting mirror 28 is attached.

Reference again to FIG. 10 reveals that there are a total of 20 planes, ten in the outside circumferential group (designated with identifying numerals 15) and ten within the inner group (identified with identifying numerals 14). There are also a total of 60 individual indicating segments 13 which are organized into 10 sets of six. Further reference to FIG. 10 reveals that each of the plane elements is connected via its own conductor 24 to its own individual contact near the periphery of the display. These contacts, as will be observed, are identified respectively with symbols BP10 through BP29. The segments, on the other hand, are interconnected in a pattern which hereafter will be referred to as meandering lines.

Continuing with a description of the segment matrix, it will be observed that the segments are divided into 10 groups of six each. Electrical interconnections are made in accordance with the meandering line concept whereby there are six separate sets of segments, each containing 10 members which are interconnected in series by interconnections 29 and 30. Thus, it will be observed that an electrical path exists from contact member SF' via the associated conductor 24 to segment 31 and thence via conductor 32 to segment 33 whence it is further connected via conductor 34 to a segment in the next adjacent group (not shown). Such a pattern thereafter continues in like fashion throughout the segments overlying the planes until it emerges via conductor 35 to segments 36 and then via conductor 37 (which is a part of conductor bundle 30) to connect with segment 38 which in turn is connected to contact member SF.

It will now be evident to those skilled in the art that while in the particular embodiment depicted in FIG. 10 there is shown a meandering line arrangement having a combination of 20 planes and 60 segments disposed in ten groups of six each, various other combinations could readily be employed embodying the principles of the invention. Thus, for example, there could be employed five sets of 12 segments each and a corresponding group of 24 planes disposed into two groups of 12 each. Accordingly, it should be understood that the principles underlying the instant inventive concepts are not limited to the specific configurations depicted in FIG. 10. For example, surface 16 could be contained within octagonal boundaries with electrical contacts disposed on three of its edges.

As will be observed by those skilled in the art, application of suitable potentials to selected one or ones of the planes while at the same time energizing a selected segment will result in the darkening of the material in the immediate vicinity of the selected segment and plane or planes. If one plane alone is selected, then the segment will appear as a half segmented darkening, whereas if two radially related adjacent planes are selected, an entire segment length will appear darkened. Inasmuch as it has presiouvly been described that the planes are individually energizable, it will be evident that any one of the segments can either be darkened in its entirety or can be darkened along either half of its length by the suitable selection of potentials in predetermined phased relationship. As will be hereinafter described, suitable sources of electrical potential having the desired phased relationship are applied to the connecting pads BP10–29 and SA–SF'.

It should also be observed that while, for the sake of clarity in illustration, the segments 13 are shown to be substantially spaced apart, in actual practice it has been found preferable to reduce the spacing to a minimum, thus resulting in a more pleasing aesthetic appearance. Furthermore, adjacent planes 14 and 15 have been depicted as having significant spacing therebetween, also for clarity of illustration. However, in practice it has been found desirable to reduce their spacing to a minimum, consistent with maintaining electrical separation. Thus, it will be observed that desired spacings can be effected without departing from the spirit and scope of the invention.

It will also be observed that although there are a total of 12 electrical interconnecting pads to the six sets of segments, this is accomplished in order to reduce electrical resistance to the farthest segment and also to reduce other qualities of electrical impedance. Further benefits may arise from a reduction in turn-off times and reduced capacitance effects. However, it has been found that in practice, acceptable performance has been achieved with the elimination of half of these connections, and consequently all of them are not required for successful operation.

Further reference to FIGS. 9, 10 and 11 will reveal that while the planes are configured in essentially concentric circular segmental form, one alternative configuration contemplates different geometries for segments and corresponding planes. Thereby, for example, the segments and planes in the regions adjacent to those occupied by indicators for 1:30, 4:30, 7:30 and 10:30 could be made significantly longer so that in a square or non-circular design, the segment representing the minutes could be extended to the edge of the face. While it is evident that the segment representing the hour could likewise be extended, it is believed that in any event, the hour hand should remain substantially shorter than the minutes indicator so as to avoid any ambiguity therebetween.

FIG. 12 illustrates the configuration of the meandering lines that is particularly adaptable for commercial production. Advantage is taken of the central hub to make common connections, thus reducing the number of external leads required. Thus, for example, hub 39*a* provides common connections to a plurality of radially extending segments for which activating potentials may be applied via connection 39 thus reducing the number of meandering lines required. Similarly, the exterior ring may be employed (as shown in FIG. 12) to achieve common electrical connections.

FIG. 13 depicts a corresponding adaptation of the planes corresponding to planes 14 and 15 of FIG. 10 but more specifically adapted for commercial production. Thus, for example, reference to FIG. 13 reveals elements 14*a* and 15*a* which are electrically separate and to which connections are made separately via conductors 14*b* and 15*b* to electrical contacting pads 14*c* and 15*c*.

Further reference to FIG. 13 reveals that the inner planes 14*a* have substantially greater radial widths than the adjacent planes 15*a* which comprise the outer concentric ring.

From the foregoing description, it will now be evident that the horological display hereinabove described offers a number of advantages and features in accordance with those hereinbefore enumerated. Thus, for example, it will be observed that as the segments are individually energized with respect to either of their halves, it is possible to display items of horological information in accordance with those given above for FIGS. 1–9 inclusive. In order to achieve these displays, however, it is necessary that suitable activating potentials be applied to the display, and these suitable activating potentials are more particularly described in the ensuing description.

To assist in a better understanding of the operation of the circuits for the display, reference is now made to FIG. 14 where it will be observed that FIG. 14*a* depicts a graph showing contrast ratio versus activating voltage for a typical liquid crystal display material. It will be observed that as voltage is increased from zero, the liquid crystal material undergoes essentially no darkening or change until the point marked VTH is reached. AT this point, referred to as threshold voltage, further increase results in a rapid increase in the change of contrast of the material as its characteristic rises up the curve toward the point identified by the dashed line extending from VSAT (saturation voltage). At this point it will be observed that the slope of the curve flattens considerably such that other increases in voltage result in significantly less change in the contrast ratio. Thus, for example, an increase in the voltage from VSAT to VON results in only a minor change in the contrast ratio. Similarly, a further increase from VON to VB results in only a minor change in the contrast ratio.

For the purposes of illustration, VB is indicated on the graph to provide a point of reference for discussion of FIGS. 14*b*–14*e* wherein driving potentials and resultant RMS voltages are given in terms of VB. Typically, for the displays described herein, VB is in the order of 3 volts, although the value may vary substantially depending upon the type of liquid crystal material employed.

It will be recalled that the display depicted in FIG. 10 includes a total of sixty (60) radical segments and twenty (20) planes. If economy in interconnections and attendant reliability were not a consideration, these could be individually activated or deenergized in combinations to provide the desired display. However, through the advantageous utilization of time shared multiplexing and decoding, the number of connections is reduced to only a fraction of the aforementioned number, thus contributing substantially to reliability and economy.

It is a characteristic of certain liquid crystal materials that when square wave voltages are applied thereto at normally encountered repetition rates, they respond to the root-mean-square (RMS) values thereof. Accordingly, it is the RMS values of the resultant voltages across the material as illustrated in FIGS. 14*g* and 14*h* that effectively influence the liquid crystal material rather than the absolute or instantaneous values thereof.

With the foregoing considerations in mind, reference is now made to FIGS. 14*b*–14*d* wherein it will be observed that three square wave voltage patterns displaced in phase each by 90 degrees are illustrated. These voltages (together with a fourth similar voltage also displaced by 90 degrees) would be introduced to different ones of the planes so as to provide them with individually different activating voltages. Somewhat similarly, FIGS. 14*e*–14*f* depict two sets of voltage waveforms which are applied to certain of the segments. Of course, it will be observed that for the purposes of this illustration the foregoing waveforms depict only certain of the ones employed for activating the complete display, and it will be evident to one skilled in the art that an additional waveform further displaced by 90 degrees will be included with FIGS. 14*b*–14*d*. Also, two other sets of waveforms corresponding to FIGS. 14*e* and 14*f* but further displaced by consecutive intervals of 90 degrees would also be employed.

It will be recalled that it is not just the potential applied to a segment nor is it just the potential applied to a plane that activates a given portion of the display. Rather, it is the resultant voltage across the liquid crystal material that brings about the desired activation. Such typical resultant voltages are depicted in FIGS. 14*g* and 14*h* for two representative combinations of voltages on segments and planes. Thus, it will be observed that FIG. 14*g* illustrates a resultant voltage deriving from an application of the voltage waveform of FIG. 14*b* on a plane element and the voltage waveform depicted by FIG. 14*e* on a segment; and it is the RMS value of this resultant voltage which produces the change in contrast of the liquid crystal material. This RMS voltage for the waveform of FIG. 14*g* is approximately 0.79 VB. Reference to FIG. 14*a* shows that such voltage is significantly beyond the saturation voltage of the material and thus provides some degree of tolerance to ensure proper operation. FIG. 14*i* summarizes the approximate resultant RMS voltages obtainable by combinations of waveforms similar to those of FIGS. 14*b*–14*h*.

As mentioned above, certain of the figures elaborate upon certain others in greater detail. Thus, for example, the diagram of FIGS. 15 and 16 is depicted in greater detail in FIGS. 21–47. In such figures, like parts are designated with like reference numerals.

Now referring to FIGS. 15 and 16, it will be observed that they depict a block diagram showing the principal operating electronic elements of the system. As is well known in the art, many electronic timepieces include an oscillator (normally crystal controlled) which produces a basic electrical waveform usually at a frequency of 32,768 hertz. Reference to FIG. 15 reveals such an oscillator identified with the symbol 40. The details of such oscillators are well known and consequently need not be further described.

Also included with the oscillator is a prescaler count down circuit which reduces the frequency of the oscillator to some lesser usable frequency more adapted for development of clock generator pulses by clock generator 41. As will be observed, the output of the oscillator and prescaler 40 is introduced to the input of clock generator 41 via interconnection 42.

While the specific reduction in frequency by the prescaler has been selected to reduce the frequency by a factor of 64, this is not in itself critical to the instant inventions, for any other suitable reduction by a power of 2 could be readily employed. However, it has been found that reducing the oscillator frequency by a factor of 64 produces a convenient output frequency which is suitable for introduction to the clock generator. Thus, inasmuch as the circuitry of the clock generator 41 may be advantageously implemented in Integrated Injection Logic ($I^2L$), a reduction by 64 is found to be desirable. However, implementation in other forms such as, for example, CMOS, may suggest a reduction by a factor of 128 or some similarly larger reduction.

It will be observed that clock generator 41 receives impulses from oscillator-prescaler 40 and effects further reduction. Thus, for example, on line 43, there is produced an output of 64 hertz, on conductor 44 an output of 32 hertz, conductor 45 an output of 16 hertz, conductor 46 a control clock output normally of one hertz at a duty cycle of 1/16, and conductor 47 a timekeeping output of one hertz at a duty cycle of 1/16. These are conducted respectively to the subsequent counters, strobe generators and other circuitry as indicated in the drawings.

The one hertz output on conductor 47 is introduced to the input of the seconds counter 48 where it is normally effective to cause that counter to count for a total of 60 counts before completely resetting. The seconds counter is effectively divided into two subcounters, the first counting to six before resetting and the second counting to ten before resetting. The output of the first of these (i.e., the divide by six counter) is introduced to the input of the second (i.e., the divide by ten counter). Thus, the effect of the two subcounters in tandem is to effect a divide by sixty function which after counting 60 pulses introduced to its input over conductor 47 produces an output pulse which is conducted via conductor 49 to the input of minutes counter 50.

Inasmuch as pulses received by the seconds counter occur one each second, the output pulse on conductor 49 (which is produced after 60 input pulses to the seconds counter) represents a period of time of one minute.

Reference to minutes counter 50 discloses that it is somewhat similar to seconds counter 48. It also is divided into two subcounters, a divide by six and a divide by ten. However, after receiving each group of 12 pulses over conductor 49 (constituting 12 minutes or one-fifth hour) it produces an output pulse which is conducted via conductor 51 to hours counter 52.

Reference to hours counter 52 indicates it also to be similar to minutes counter 50 and seconds counter 48 in that it is divided into two subcounters, a divide by six and a divide by ten. This is accomplished in order to produce activating signals which are used to step the hour hand through a total of sixty positions on the face of the watch dial even though those sixty positions actually represent only a total of 12 hours. Moreover, there is also produced from hours counter 52 a signal to distinguish between successive groups of the said 60 positions in order to identify the time as either being a.m. or p.m. This signal is conducted via conductor 53 to the AM/PM circuitry represented by block 54.

Also connected to counters 48, 50 and 52 are certain synchronization, multiplex control and reset conductors. Synchronization signals are conducted thereto from clock generator 41 via conductor 46; multiplex control signals are conducted to seconds counter 48 from data multiplexer 55 via conductors 56 and 57, to minutes counter 50 via conductors 58 and 59, and to hours counter 52 via conductors 60 and 61.

Referring further to FIG. 15, reference is made to elapsed time tenths-of-seconds counter 62 to which it will be observed that there are introduced a 32 Hz signal via conductors 44 and 63 and a 16 Hz signal via counductors 45 and 64. The 32 Hz input is a controller synchronizing signal, whereas the 16 Hz input is the basic counting signal. Tenths of seconds counter 62 is basically a divide by 16 counter which produces binary representations of the number 0–15 which are conducted via conductor bundle 65 and data bus 66 to data latch circuits 67. An output is also conducted via conductor 68 to the $\overline{EL}$ input to the control programmable logic array (PLA) 69. As will be subsequently discussed, the control PLA and the data latch circuits are effective to ultimately produce signals from the aforementioned 0–15 inputs which are representative of tenths of seconds in the watch display.

After the tenths of seconds circuits 62 have counted through a total of 16 input pulses (thereby completing an elapsed time of one second), a signal is produced and conducted over conductor 70 to the input of elapsed time seconds counter 71. Counter 71 is similar to counters 48, 50 and 52 in that it basically is a divide by 6 and a divide by 10 counter connected in tandem. Accordingly, upon the expiration of 60 seconds, it produces an electrical signal which is conducted via conductor 72 to the input of elapsed time minutes counter 73. Counter 73, also being basically a divide by 6 and divide by 10 counter connected in tandem, counts these input pulses and upon the expiration of each group of elapsed 12 minutes, produces an output signal which is conducted via conductor 74 to the input of elapsed time hours counter 75.

Reference to counters 71, 73, 75 reveals that electrical signals are conducted therefrom via conductor bundles 76, 77, 78, 79, 80 and 81 to data bus 66 whence they are introduced into the input of data latch circuits 67. In addition, it will be observed that start and stop signals are conducted from the control PLA 69 via conductors 82 and 83 respectively to the elapsed time tenths counter 62; clear and reset signals are conducted to counters 62, 71, 73 and 75 from control PLA 69 via conductor 84; and data multiplexing synchronization signals are conducted thereto via conductor bundle 85.

Reference to FIG. 15 also reveals day, data, month and zone circuits 86, 87, 88 and 89, respectively. Inputs to day and data counters 86 and 87 are seen to be conducted via conductors 90 and 91 from the output of AM/PM circuits 54. When the AM/PM circuits 54 switch from PM to AM (thereby indicating the attainment of 12:00 midnight), a pulse is developed and communicated over conductor 90 to the inputs of the day and date counters 86 and 87. This electrical signal is effective to advance the counters within day and date circuits 86 and 87 by one, so as to advance the day and date correspondingly. Corresponding signals are thereupon produced and impressed upon data bus 66 over conductor bundles 92, 93, 94 and 95. Appropriate multiplexing instructions are conducted from data multiplexer 55 via conductors 96, 97, 98 and 99. In addition, it will be observed that provision is made for setting counters 86, 87, 88 and 89 via electrical signals that are conducted from control PLA 69 via conductor 100 and conductors 101, 102 and 103. Provision is also made for reverse setting zone counter 59 via pulses which are conducted from control PLA 69 via conductors 104 and 105.

Moreover, multiplexing instructions are conducted from data multiplexer 55 to months counter 88 and time zone counter 89 via conductors 106, 107, 108 and 109. These multiplexing instructions impart the respective data from the counters onto the data bus 66 in the proper time shared relationship.

Further reference to minutes and hours counters 50 and 52 reveals connections via conductor 100 from control PLA 69 for transmission of set signals to set the counters when desired. These signals are effective to step the counters in the forward direction. The feature of setting by reverse stepping is provided by signals transmitted over conductor 104.

Furthermore, it may be observed that the setting signals conducted via conductors 100 and 104 are common to several counters. Therefore, additional signals are provided from the control PLA 69 for the purpose of controlling which counter responds to the setting signals 100 and 104. These control signals are conducted via conductors 110, 111, and 112 to minutes counter 50 and hours counter 52 and via 113, 114, 115, and 116 to Day, Date, Month and time zone counters 86, 87, 88, and 89 respectively.

When minutes counter 50 is set, a set-to-zero signal is conducted from Frozen Timekeeping Circuits 117 to seconds counter 48 via conductor 118.

Operation of the frozen timekeeping circuits can be more clearly understood by recognizing that when the minutes counter 50 is changed in setting, a signal is conducted therefrom over conductor 119 to the set minute terminal of the frozen timekeeping circuit. The frozen timekeeping circuit in response thereto extend a signal over conductor 118 to the seconds counter circuits 48 to reset them to zero. Subsequently, the frozen timekeeping circuits retain the seconds counters in a reset condition pending receipt of a deactivating signal transmitted from the control PLA 69 via conductor 120 to the RL input terminal of the frozen timekeeping circuits.

Further reference to clock generator 41 reveals the existence of three conductors 121, 122 and 47' emerging from the right hand side. Conductor 121 connects to the four Hz input of state counter and timer 124; conductor 122 connects to the plane decoder PLA 123 directly and via conductor 122' to the data multiplexer 55; and conductor 47' connects to segment decoder PLA 125. These conductors provide needed clock signals to the circuits to which they are introduced. Thus, for example, the signal conducted over conductor 121 to the state counter and timer 124 is for a timing function. The signal conducted over conductor 122 to plane decoder 123 is for a display and test function; and the signals conducted via conductors 47' is for display and test function for the segment decoder PLA 125.

DESCRIPTION OF CONTROL PLA AND ASSOCIATED CIRCUITS

Reference to FIG. 16 and the corresponding drawings in FIGS. 39–47 reveal operative details of the control PLA 69, the state counter and timer 124, the frozen timekeeping circuits 117 and the input debounce circuits 126. Input debounce circuits 126 are effective to prevent false response by the system when one of the input buttons designated CMD, SET or SW is depressed. This delays activation of the input debounce output circuits until at least two complete pulses have been received over the 32 hertz input which is extended from the clock generator 41 via conductor 44 and conductor 127. Accordingly, transients or incomplete contact resulting when the input buttons are depressed are prevented from influencing the control.

When one of the three aforementioned input buttons is depressed, and after the expiration of the two consecutive pulses received over conductor 127, a corresponding output signal is extended from input debounce circuits 126 over the corresponding conductor R, S or AUX via conductor 128, 129 or 130 to control PLA 69.

The symbols for FIG. 48 are defined as follows:

R=CMD Button Activation
S=Set Button Activation
AUX=SW Button Activation
L=Frozen Timekeeping
t1=1 sec timer
t2=2 sec timer
EL=Elapsed Time Running
T=Time Out has Occurred
CW=Clockwise Set
CCW=Counterclockwise Set
CAL=Calendar Feature
TZ=Time Zone Activated
CZ=Change To or From Time Zone
R', R'', R''', etc.=Subsequent Activation of CMD Button
S', S'', S''', etc.=Subsequent Activation of Set Button
AUX', AUX'', AUX''', etc.=Subsequent Activation of SW Button Control PLA 69 and associated state counter and timer 124 can best be understood from reference to FIG. 48 which illustrates conditions of the horological display in response to various conditions of the command, set and stop watch buttons CMD, SET and SW. This FIG. 48 is a flow diagram which not only depicts conditions existing on the face of the horological display but additionally identifies the sequence in which they follow upon depression of selected ones of the aforementioned buttons.

Now referring to FIG. 48, it will be observed that it depicts horological displays 131–143 in different alternative states in which they may exist when each of the individual options available within the herein described circuitry is employed. In this connection, it should be noted that in certain commercial embodiments of the herein described circuitry, selected ones of the hereinafter described options may not be chosen. Thus, for example, in certain more simplified commercial embodiments it may be desired to provide only the basic timekeeping functions which include hours, minutes, and seconds displays. With these considerations, reference is again made to FIG. 48 and horological display condition depicted by display 131. Here, it will be observed that the display is in the basic function which is displaying hours and minutes. It will be observed that the minute hand extends to the perimeter of the circular display in the conventional fashion whereas the hour hand is significantly shorter and somewhat thicker than the minute hand. In the event one wishes to change the display to the next mode, this is accomplished by a momentary depression of the command button and is portrayed by the arrow 144 which extends to display 132. Display 132 is seen to show the minutes as in display 131 but instead of showing the hour, an indication of seconds is given by segment 145. If, instead of merely depressing the command button once, it is depressed twice within a one second time interval, the display will proceed from the condition shown at 131 to that shown in 133 via path 146 where it will be observed there is an indication near the top of the dial of the days of the week and near the bottom of the dial of the date of the month. This corresponds to the display shown in FIG. 3b. As mentioned above, the positions of these two indicators could of course be changed without departing from the spirit and scope of the invention.

If instead of depressing the command button twice within the one second period it is depressed once and then again depressed after the expiration of the one second interval, the display will return to the original condition shown in display 131. This is represented by the arrow and lines 147 and 148.

If instead of the foregoing, the command button is depressed for a period of time and while it is held depressed the auxiliary button (sw) is also depressed, the display will move from the condition of 131 through the condition of 132 and into an alternative condition representative of the time in a predetermined time zone as depicted by path 149. The activity of this path changes the display of 131 to a time zone indication or back to normal timekeeping, depending upon whether it was previously displaying time or time zone information, for the state represented by 131 is for either normal timekeeping or time zone display. As will be recalled from the aforementioned description, in time zone, the hours hand is no longer wider than the minutes hand but is of the same width. It should also be observed, that the simultaneous extended depression of the command and auxiliary buttons will not be effective to change the display to the time zone indication unless at the time they are depressed the display is in the condition shown in 131. Thus, if the display is in the condition shown in 132 or 133, such simultaneous depression will merely return the display to the original condition depicted by 131.

Further reference to FIG. 48 and display 133 will reveal that there are two ways in which the display can be returned from conditions shown by 133 to the original condition of 131. These are depicted by arrows and lines 150 and 151. The first of these will occur upon the occurrence of a subsequent depression of the command button following the depression which was responsible for changing the display from that of 132 to that of 133. The other occurs after the passage of a predetermined interval of time, e.g., two seconds, and this timeout path is represented by arrow and lines 151 and 148.

Arrows and lines symbolized by 152 and 153 identify paths for transferance of the display from either the hours and minutes condition of 131 or the minutes and seconds condition of 132 to a set mode depicted at 134. Thus, if the display is in either of the states depicted by 131 or 132, depression of only the set button results in the display transferring to the set condition of 134. This, of course, is depicted as occurring over the aforementioned arrows and lines 152 and 153.

Further reference reveals that the set condition depicted by 134 is characterized by a regularly flashing hour hand. Accordingly, there will be a visual indication that the display is no longer the original condition and is in a state in which the indication of time can be set. If the set button is now momentarily depressed again (i.e., for less than a one second interval) the mode is transferred as shown by arrow 154 to a blank condition 135 and almost immediately further transferred to a condition shown at 136 as indicated by arrow 155. In the condition of 136, the display is now available for setting of minutes.

If the set button is again depressed momentarily (i.e., for less than a one second interval) the display is further transferred from the condition of 136 through the blank condition of 137 and almost immediately to the condition depicted by 138 via paths 156 and 157. This condition is one in which the days of the week can be set. Further successive depressions of the set button will cause the display to move sequentially to the condition of 139 via path 158 in which it may now be set for months or further over path 159 to the condition of 140 in which it may be set for days of the month. From this condition, the display is returned to the original condition of 131 via paths 160 and 148 by one further depression of the set button.

Before proceeding further to a discussion of the hours set condition as depicted by 134, it should be noted that the display of 134 will indicate either normal hours set or time zone set depending upon whether display 131 was in the normal time condition or in the time zone condition at the time the set button was depressed. If display 131 is in the time zone condition at the time the set button was depressed and thereby the display was transferred via path symbolized by 152 to the condition depicted by 134, then display 134 will be in a time zone hours set mode and not in the normal hours set mode. In such event, a subsequent depression of the set button will result in a direct return of the display via the path symbolized by 161 and 148 to the time zone hours indicating mode. On the other hand, if when the set button was depressed, the display mode of 131 was for normal time and the display was transferred from the condition of 131 via the path symbolized by 152 to the hours set mode symbolized at 134, then a depression of the set button for a period equal to or longer than one second will result in a transferral of its condition through the blank mode symbolized at 135 and then via the path of 162 and 148 for a return to the original normal timekeeping condition of 131. This latter sequence is normally called "fast exit".

It will be recalled that in transferral from the condition of 134 when such condition is not in the time zone mode but in the normal hours set mode and when such depression is for a period less than one second, the display will be transferred through the blank mode condition of 134 to the minsutes set mode of 136.

Path 163 depicts a condition which exists if the calendar feature is not included in the particular commercial embodiment involved. In such event, the mode depicted at 138, 139 and 140 will not exist (or if they do exist, may not be accessible) and then a path for direct return to the condition of 131 is provided via path 163. Such return is activated upon a depression of the set button as indicated.

Path 164 is provided in embodiments having the calendar feature in order to provide a path for return of the display rather than requiring sequentially stepping through the condition depicted by 138, 139 and 140. If a direct return is desired, a longer depression of the set button (i.e., for one second or more) will result in a return of the display from the condition of 136 through that of 137 and back to the original condition of 131. Having now described the method of transferring the display from an original timekeeping condition to any one of a plurality of desired conditions in which different displays can be set or reset, a discussion of the setting mode will now be given.

Turning to the condition depicted by 134, a change in the setting of the hour hand can be accomplished by stepping it either forward clockwise or backward, counterclockwise, depending upon the way in which the command button is depressed. If it is depressed and held for a period of time longer than one second, then the hour hand will begin to step forward, that is, clockwise, and move thereafter one hour increment (30 degrees, or five segment positions) each second so long as the command button continues to be depressed. On the other hand, if the command button is depressed momentarily and then within one second after it is released depressed again and held, then the hours hand will be stepped backward, i.e., in a counterclockwise direction, one hour increment (30 degrees or five segment positions) each second that the command button continues to be held. Upon release of the command button, further setting of the hours hand is discontinued.

In accordance with another feature of the invention, if while in the set mode the command button is depressed to effect either of the above-described setting changes, and if while the command button is held depressed the set button is also depressed, stepping of the setting is accelerated by a factor of eight times.

At this point it should be observed that while the particular times involved in the sequences herein described are set forth with specific quantities, other quantities could as well be employed. Thus, for example, in some embodiments, the time interval between successive positions of the hours hand could be one half second or some other suitable period of time. All of such are deemed to be within the spirit and scope of the inventive concepts herein described.

Now considering setting of the minutes, reference is made to display condition 136. When the display is in such condition, the minutes can be set either counterclockwise or clockwise by a sequence of depressions of the command buttons identical to those herein above-described for the hours counter in connection with display 134. However, the actual stepping of the indication is from segment to segment rather than from one segment position to a location five segments displaced therefrom. Accordingly, it will be observed that each sequential stepping of the segment is equivalent to approximately six degrees of arc.

Now referring to display mode 138, the days of the week may be set by depression of the command button. However, there is no time delay or sequential depression sequence required, for the display will immediately begin stepping upon depression of the command button.

Likewise, in the mode depicted by 139, the months may be set by depressing the command button. In this example, it will be recalled that as there are 12 months distributed uniformly about the face of the display, the months indicator will displace approximately 30 degrees each time it is set.

Setting of the days of the month as depicted in display condition 140 also occurs immediately upon depression of the command button and the day of the month advances incrementally in a manner similar to that described above.

When considering the condition depicted to display condition 134, it should be further noted that it provides a useful piece of information in addition to that described above. Thus, when it depicts normal time setting (as contrasted with time zone setting) the hour hand will be either fat or slim depending upon whether the time of day is then AM or PM. In the particular example selected for this descriptive embodiment, the use of a slim hour hand has been selected to indicate AM and the fat hour hand to indicate PM. However, it will be evident that the converse could be readily obtained. This condition is coordinated with the AM/PM Circuits 54 of FIG. 15 and with others of the counter circuits in order than when time is reset that the corresponding indicators for days and dates are appropriately coordinated.

In light of the display conditions depicted in FIG. 48 and hereinabove described, together with the aforementioned description of the circuits of FIG. 15, it will be evident that the control PLA 69 extends signals over the indicated conductors to accomplish the setting of the various counters to reflect the setting conditions described for FIG. 48.

Note should be taken of the fact that when the minutes are being set, the circuitry of FIG. 15 operates in a coordinated fashion such that the position of the hours hand correspondingly moves in a fashion appropriate to the movement of the minutes hand unless and until the minute hand sweeps around to the position denoting 60 minutes. Thereupon, the hours hand repositions so as to retain the hour indication within the same hour span in which it was located at the time the minutes resetting began. This is a particularly advantageous feature to ensure that the hour position does not become inadvertently advanced or retarded when the minutes hand is being reset.

It will contribute to a more complete understanding of the circuitry herein described to now refer again to the frozen timekeeping circuits 117 and their interconnections with certain of the counters in FIG. 15. As previously mentioned, when the minutes are set, an appropriate signal is transmitted to the seconds counters 48 whereby the seconds counter is reset to 0 and the frozen timekeeping circuits are placed in the frozen mode. This results in a condition whereby when the display is returned to the condition represented by 131 both the hours and minutes indicators will be flashing in synchronism. Thereafter, as will be recalled, depression of the command button will transfer the display to the mode depicted at 132 and subsequent depression of the command button will return the display to the normal condition of 131 with no flashing present. Also occurring upon the first depression of the command button and at the time that the display is transferred from the flashing condition at 131 to the condition of 132, the frozen timekeeping circuits are returned to a condition whereupon normal timekeeping resumes.

Reference is now made to the display conditions represented by symbols 141, 142 and 143 of FIG. 48. These modes respectively depict the display when in the elapsed time (stopwatch) condition. Mode 141 depicts the elapsed time indicator when in the hours and minutes mode; 142 when in the minutes and seconds mode, and 143 when in the minutes and tenths of minutes mode.

Reference again to FIG. 48 reveals that the elapsed time indicator may be activated from any one of the three conditions represented by 131, 132 and 133 provided that the frozen timekeeping circuits 117 of FIG. 16 are not activated. Thus, depression of the auxiliary button will result in transfer of the display from either of the conditions 131, 132 or 133 to the condition represented by 141 via path 165, 166, or 167. When in this condition, depression of the command button initiates elapsed-time timing which then occurs through movement of the hands to indicate elapsed time in minutes and hours. A subsequent depression of the command button will stop further timing of elapsed time. This starting and stopping of elapsed time is identical for any one of the three display modes 141, 142 and 143, and an indication according to the display of 142 ofr 143 can be achieved without interrupting the counting of displayed time by moving over the path indicated by symbol 168 or 169 which occurs in response to depression of the auxiliary button.

As will be observed, the display as shown at 142 displays minutes and seconds. A subsequent depression of the auxiliary button will transfer the display from the condition of 142 to that of 143 via the path symbolized by 169. There, it will be observed that elapsed time is displayed in seconds and tenths of seconds. Thereafter, a further depression of the auxiliary button will result in a return of the display via the path indicated by 170 to the original normal timekeeping condition exemplified by 131.

At this point it may be helpful to recall that the elapsed time counters and the normal timekeeping counters are separate and distinct and provide for counting entirely independent of each other. This provides important advantages as, for example, that the normal timekeeping counters continue to maintain a record of actual time while the display mode may be in the elapsed time function. Conversely, the elapsed time counters may be set to continue counting independent of whether or not their condition in being displayed on the display so that, for example, the elapsed time counters can be initiated and the display thereafter returned to the normal timekeeping mode for an indefinite period of time during which the elapsed timekeeping counters will continue to count the elapsed time. When it is desired to determine the extent of elapsed time, the display may be returned in the manner mentioned above to one of the three elapsed time modes depicted at 141, 142 and 143 and the elapsed time read therefrom. Of course, to start the elapsed time counters running, to stop them or to reset them, it is necessary that they be in one of the conditions 141, 142 or 143.

Elapsed time counters are started, stopped and reset in a similar manner irrespective of which of the three states they are in. Starting the elapsed time counter occurs upon depression of the command button after the display is in one of the elapsed time display conditions 141, 142, or 143. Thereafter, if while the display is in one of these three conditions, the command button is subsequently depressed, timekeeping will temporarily halt and the counters will remain frozen in that condition until they are either reset or restarted. A subsequent depression of the command button will restart counting of the elapsed time counters and continue them on until they are subsequently again stopped or until they are reset. Depression of the command button and the auxiliary button simultaneously will reset the counters to zero irrespective of whether they are running or stopped. However, in either event, reset of the counters will terminate counting by the counters and result in their remaining in the reset state until restarted.

It will now be evident that the circuits and display features of the instant inventions offer numerous and varied advantages which have not heretofore been embodied in horological displays.

Referring now again to FIG. 16 and to the state counter and timer 124, it may be helpful to understand that it is the state counter and timer circuits which provide the timing functions described above in respect to FIG. 48 and also maintain an electrical indication therein of the conditions of the various display modes. These electrical quantities are exchanged appropriately with the control PLA cicuits 69 so as to provide control PLA 69 with information necessary to permit it to extend appropriate electrical signals over the circuits hereinbefore described extending to the various counters and attendant circuitry.

DATA LATCH, SEGMENT DECODER AND PLANE DECODER CIRCUITS

It will be recalled from the above mentioned description that data from the various counters of FIG. 15 are introduced onto the common data bus 66 in a time shared relationship. When these electrical signals are received at the input of the data latch circuits 67, they are stored therein under the direction of signals which are introduced thereto at the $\overline{32}$ hertz and $\overline{64}$ hertz inputs. The $\overline{128}$ hertz input is provided in order that the circuits may be appropriately synchronized. When information is needed by the plane decoders and segment decoders, it is transmitted from the data latch circuits over the indicated conductors to the respective inputs which are designated with the symbols AS-DS, AL-DL for the segment decoder PLA 125 and DS-GS and DL-GL for the plane decoder PLA 123. In this connection, it will be helpful to understand that although in order to achieve economy of interconnections it was desirable to conduct electrical signals over the data bus 66 in a multiplex time shared relationship, the particular form of time sharing therein employed is significantly different from the time sharing required to activate the display elements themselves. Accordingly, the data latch 67, segment decoder 125 and plane decoder 123 circuits are provided in order to translate this information into electrical form which is coordinated with and is effective to activate the display elements themselves in the predetermined desired relationship.

Now turning again to the segment decoder and plane decoder circuits, it will be further helpful to understand that in the particular descriptive embodiment herein, it is necessary for both the segment decoder and the plane decoder circuits to recognize information introduced thereinto as being for either a long hand or a short hand representation. Circuits effective to accomplish this are designated with the second letter "s" or "S" for short hand information and the second letter "l" or "L" for long hand information. For example, in respect of segment decoder PLA 125, the AS input indicates information relating to a short hand condition whereas AL indicates information relating to a long hand condition.

Further reference to segment and plane decoders 125 and 123 reveals existence of inputs identified by $\overline{DT}$. These will be observed to be connected by an appropriate input into the circuits over a path identified as 171. The interchange of electrical quantities between the segment decoder, plane decoder and data latch circuits is effective to provide an advantageous feature which is described as follows. When the display of FIG. 48 is in the condition shown at 131 or 132 and the command button is depressed and held depressed while the set button is depressed, the display mode will move into a condition which, for the purposes of this description, is identified as a display test condition. While this condition may be any type of display which would provide a visual opportunity to inspect operability of each of the segments, the particular pattern herein selected provides an alternation between four display modes in sequence, each of the four modes continuing for a duration of about ½ second. Characteristically, each of these display modes activates a different pattern of half segments in such a way as to advantageously provide clear visibility for shorts or open circuits by activating only every other half segment at any one time. This, of course, has the intended advantage of insuring operability and distinction between the various planes as well as the segments. It will be further helpful in understanding of these circuits to note that the one hertz and two hertz inputs respectively to the segment decoders 125 and plane decoders 123 operate in cooperative relationship with the electrical quantities of the $\overline{DT}$ circuits to accomplish the foregoing display and test function.

It will also be observed that there are $\overline{32}$ hertz and $\overline{64}$ hertz inputs at the top and bottom respectively of the segment decoder circuits 125 and the plane decoder circuits 123. These inputs are conducted from the clock generator 41 via conductors 172 and 43, respectively, and they provide clock signals which are necessary for production of the desired outputs at the output terminals SA–SF and BP10–BP29.

The FS input to segment decoder PLA 125 is seen to extend via conductor 173 from the control PLA 69. It is over this conductor that an electrical signal is transmitted which is effective to distinguish between the fat hour hand and the slim hour hand hereinabove described in connection with the display. The segment decoder recognizes this signal and is effective to produce appropriate outputs at the outputs SA–SF depending upon whether a fat hour hand or slim hour hand is to be displayed.

Reference to plane decoder PLA 123 reveals three inputs in the upper left hand corner thereof severally identified as $\overline{I/O}$, Day and Tenths. The signal received at the $\overline{I/O}$ input via conductor 174, permits the plane decoder circuits to distinguish between information indicative of a short hand in order that it may designate whether that short hand shall be displayed as an inner short hand or an outer short hand. Thus, for example, in order to achieve simplicity in the data bus 66 signals, certain inputs to the data latch circuits are identified merely as short hand information without distinction as to whether the short hand will be an inner short hand or an outer short hand. It is the $\overline{I/O}$ input signal which permits the plane decoder PLA circuits 123 to distinguish between the condition of whether the short hand is an inner short hand or an outer short hand and thereby to produce appropriate potentials on the output conductors BP10–BP29.

The signal received via conductor 175 and introduced to the Day input for plane decoder PLA also provides a distinguishing feature. However, here the distinction is between data introduced to the plane decoder indicative of long hand information. Here, the day signal is effective to truncate one of the inputs otherwise indicative of long hand information so as to provide an appropriate short hand indication of day.

The signal introduced over conductor 176 to the Tenths input is effective to change the internal decoding relationships within the plane decoder so as to produce outputs on the terminals BP10–BP29 which are indicative of elapsed time in tenths of seconds and provide the type of display presented in display 143 of FIG. 48.

Before proceeding further, it will be helpful to an understanding of the overall horological display system to again recall the fact that different selectable portions of the display are activated upon the development of a predetermined threshold RMS voltage across desired portions. This is in the nature of a matrix which involves appropriate combinations of segments, planes, and voltage waveforms therebetween. It will be further helpful to again recall that each path meandering through the segments of the display actually connects ten such segments serially so that when a voltage is applied to the input, it correspondingly is conducted to all ten of such serially connected segments. However, in the displays herein described, except when displaying tenths of seconds, no more than three halves of such segments are ever turned on simultaneously and consequently the combination of potentials which are introduced to the segments and the planes is critical, especially in the circuits fastened herein which advantageously provide such needed distinction with only a two level of multiplexing. Of course, three and four levels or higher levels of multiplexing could be employed to provide distinction such as those involved here. However, there are advantages in simpler levels of multiplexing, and through the implementation of advantageous techniques, it is possible to provide displays with a high level of contrast and high reliability, together with a relatively small number of interconnections.

Now referring to FIGS. 49 and 50, it will be observed that there are therein depicted various combinations of waveforms which may be applied to the segments and planes. Recollection of the discussion with regard to the waveforms of FIG. 14 brings to mind the fact that the segments are influenced by the RMS rather than the absolute values of the potentials applied thereto. Certain of the waveforms depicted in FIG. 49 are therefore seen to have RMS values that are equal to or greater than those required in accordance with the discussion relating to FIG. 14. Others or course, do not. Applying potentials to segments and planes in accordance with the chart of FIG. 50 is effective to bring about the necessary combinations.

Now examining FIG. 49 in more detail, it will be observed that in the upper left hand corner thereof, there is a representative square wave waveform with the repetition rate at the rate of 64 hertz. Immediately therebelow is a similar waveform at the repetition rate of 32 hertz. Following below down the left hand side of FIG. 49 in sequence are waveforms designated as $\phi_\alpha$, $\phi_\beta$, $\phi_\Delta$, and $\phi_\delta$ which it will be observed are three-level waveforms at a repetition rate of 32 hertz and severally displaced from each other by 90 degrees. Following these are somewhat similar but square waved waveforms designated $\theta_1$, $\theta_2$, $\theta_3$ and $\theta_4$, which again are seen to be displaced therebetween by successive displacements of 90 degrees. Proceeding further down the left side of FIG. 49, it will be observed that there are shown waveforms of voltages which are the algebraic differences of the combinations therein indicated. Thus, for example, $\phi_\alpha - \theta_1$ is the algebraic difference of the voltage waveforms shown above for $\theta_1$ and $\theta_\alpha$ individually. Successive waveforms depict the algebraic differences between the waveforms designated therefor. Although not depicted on these waveforms of FIG. 49, $\theta_o$ would be a steady state direct current potential which would be a center tap or datum zero potential reference.

Proceeding further, it should again be emphasized that certain of these resultant waveforms have sufficiently high RMS content to be effective to turn the display on as was recalled from the description of FIG. 14. Others, evidently do not. By appropriately selecting these combinations in accordance with the chart of FIG. 50, the desired segments can be activated to display information as hereinabove described.

Now considering FIG. 50 in more detail, in will be observed that along the top thereof are the designators for voltage waveforms to be applied to the planes, whereas along the vertical left side are designators indicting voltage waveforms to be applied to the segments. Accordingly, at a point of confluence between a column and a row, there will be an X in the position indicative of the resultant voltage adequate to turn on the display. For example, if a short hand only display is to occur, the concurrence of a $\phi_\alpha$ on the segment and a $\theta_1$ on the plane will produce the desired darkening of the short portion, i.e., one half of the segment. Correspondingly, if a long only indication is desired, application of a $\phi_\gamma$ waveform to a segment and a $\theta_2$ waveform to the planes will produce the long segment darkening. Positions where there are no "Xs" on the chart of FIG. 50 are indicative of conditions where the resultant RMS voltage are insufficient to turn on the display.

Before proceeding beyond FIG. 50, note should be made of distinction between the "short and long" symbols and "long and OLP" symbols in the designation of rows. By "short and long" is meant a condition in which there is to be both a short hand and a long hand display effected by the same segment driver. "Long and OLP", on the other hand, identify a condition in which a single plane is to contain both a short hand and its portion of a long hand, thus imposing the added requirement that the plane which has a short segment driven by $\theta_1$ also be effective to activate its portion of the long hand.

Reference is now once again made to the segment decoder 125 and plane decoder of 123 of FIG. 16. Having the foregoing requirements in mind with respect to waveforms of voltages individually appearing on the output terminals SA–SF and BP10–BP29, it is helpful to understand that decoding takes place in sequential steps. This involves decoding of information which is applied to the inputs of the segment decoder to determine the combinations of long and short hands.

The interaction of the $\overline{32\text{ hertz}}$ and $\overline{64\text{ hertz}}$ signals together with the inputs AS–DS, AL–DL, DS–GS and DL–GL are effective to develop intermediate signals which when applied to the gating drivers DA–DF, and D10–D29, in turn are effective to produce at the output terminals the hereinabove described combinations of waveforms. The way in which this is accomplished will be more evident from the following detailed discussion.

For each of the plane drivers BP10–BP29 there is a control signal designated as a "G" coming from the PLA to selectively gate the output element driver on or off. At the signal input to each output driver is a select gate network which selects between a $\theta_1$ or $\theta_2$ phased signal depending on whether there is an appropriate "S" signal coming from the PLA decoder. That is, if "S" is a logic zero, then it selects $\theta_2$ and if "S" is a logic one then it selects $\theta_1$.

The "G" and "S" signals come from a PLA decoder which has binary inputs designated DS through GS and DL through GL. This binary information is derived from the information conducted via the data bus 66 by the data latches 67 of FIGS. 15 and 16 in the following manner. When the information is multiplexed onto the data bus from the respective counters, the information is grouped into pairs in a manner in which one pair will always contain short hand information (for example, the seconds counter or hours counter) and the second pair long hand information (for example, the minutes counter or a day counter). The latches, in turn, since they are strobed by a generator which is synchronized with the data multiplexer control, will retrieve that information from the data bus into pairs such that it stores the information as short hand data (AS–GS) and long hand data (AL–GL). On the logic diagrams, FIGS. 15, 16 and 30–38, the short hand information is designated by the letter "S" and the long hand information is designated by the letter "L".

Considering specifically the Plane PLA Decoder, use is made only of DS–GS and DL–GL because that is the information from the divide by ten counters from the timekeeping counters. As mentioned above, each timekeeping counter, for example, the seconds counter, is divided into a divide-by-six and a divide-by-ten counter. The divide-by-six counter produces three bits of information A through C, and the divide-by-ten produces four bits of information D through G. The divide by ten counter has the purpose of sequentially counting through the planes as the hand moves around the full circumference of the display. And the divide by six counter counts sequentially through the six segments. This information from the divide by ten counters, DS–GS and DL–GL, is decoded by the PLA decoder in such manner that depending upon their particular counts a gate designated as "G" and a signal select designated by "S" will be generated to control the respective plane output drivers.

To describe how the PLA decodes the "G" and "S" control signals, reference is made to an example. If the DS, ES, FS, and GS signals have a logic state 0000, that indicates that there is a short hand in the 12 to 1 o'clock plane. At that point there is no information there to tell whether it is an inner plane or an outer plane, which is determined by another input called the $\overline{I/O}$ input. If that input is a logic zero then it is intended for the inner plane and the controls would go to plane output driver D10. If the $\overline{I/O}$ input is a logic one it is intended for the outer plane and it will direct the PLA to apply its gate and signal select controls to plane driver D20. Now if DL, EL, FL, and GL have a logic state 1000, that indicates that there is a long hand in the plane BP11 and the plane BP21. Thus the PLA will correspondingly apply "G" and "S" control signals to both the D11 and D21 output drivers. It will be observed in the above example, that there are three separate planes. Thus the short hand has its own individual plane and the long hand has another pair of planes.

To develop the concepts further, reference is made to the matrix of FIG. 50. Determination is made that the one which has the short hand in it, that is, plane BP10, should have a $\theta_1$ phase drive. Thus, the PLA recognizes the particular combination and would output a logic one to the "G10" input to turn on the output driver to plane driver D10. It also recognizes that because, for a short hand, there should be a $\theta_1$, it will output a logic one to the "S10" signal to select a $\theta_1$ phase.

It may be observed here that $\theta_2$ is in some sense a default case. That is, if there is not a logic one on the "S" signal, it will remain in $\theta_2$. In such a case, the PLA looks for a situation where there is a short hand required in that plane, and if there is, it puts a logic one on the corresponding "S" output.

In the case of the long hand planes which would be planes BP11 and BP21 in the example, reference is made to the matrix of FIG. 50 where it is observed that since there is only a long hand in those two planes a $\theta_2$ signal is chosen to drive BP11 and BP21. Therefore, the PLA produces a "G" signal to the gate of those plane drivers which turns them on. Because $\theta_2$ phase is desired, the "S" signals remain on those drivers at a logic zero and they are allowed to operate in their default state $\theta_2$. Thus, for a case where there is no sharing of long hand and short hands the drive is simple. Many other combinations could be selected and very similar results would occur. The only difference is that different plane drivers are selected. If a truth table were prepared, it would present a very ordered pattern in the relationship between the binary inputs to the decoder and the corresponding output signals.

Now consider a case in which the long hand is to share a plane with a short hand; for example, suppose the long hand is to be in plane BP10 and BP20, and in addition in BP10 there is also a short hand. The preferred embodiment of this invention includes a priority system of decoding such that if there is a short hand in a plane, regardless of whether there is a long hand or not, that plane should have a $\theta_1$ phase signal, whereas a plane occupied only by a long hand should have a $\theta_2$ phase signal. So in this particular example where long hand and short hand information is to be in BP10 and the long hand extends into BP20 then a $\theta_1$ signal would be applied to plane BP10 and a $\theta_2$ signal to the plane BP20. Then, the PLA would apply a logic one "G" signal to the plane driver D10 to turn it on, and because a $\theta_1$ is desired, the PLA would apply a logic one to the "s" input of the signal select of driver D10 to select $\theta_1$. Plane BP20 which only has a long hand element, would receive a logic one to "G20" input of driver D20, whereas the "S20" signal input would be a logic zero to leave that signal select at $\theta_2$. All other planes which are not being activated or having any elements activated in them will have logic zeros on their respective gate signal inputs. A logic zero applied to the "G" input will cause the respective output driver to seek a center tap voltage and ragardless of what segment drives are on the opposite side of the display from that plane the resultant voltage will be a low RMS voltage and those elements will not turn on. Furthermore, when the "G" input is a logic zero, it does not matter what is on the "S" input.

In the case of tenths of a second, there is also a short segment in the outer planes (display of seconds), which of course would receive $\theta_1$ for those particular planes. However, the inner plane decoders are activated by a signal called "tenths" indicating tenths of a second. The tenths of a second signal activates entire planes for each tenth of a second. The $\theta_2$ input to the phase select circuits is changed to a $\theta_4$ input by simply inverting or changing the phase by 180 degrees of the $\theta_2$ signal for that special case of tenths. The PLA decoder outputs "G" and "S" reflect the same response as if that information were long hand information; that is, the PLA interprets tenths of a second as being a long hand except that it truncates that long hand at the outer perimeter of the inner planes. Thus the hand does not extend into the outer planes as it is prevented from doing so by another input to the PLA called "tenths". Moreover, the PLA rounds off the divide by 16 count from the tenths of seconds counter to a divide by 10.

For the segment drivers selection is made between an alpha, beta, gamma, and delta signal to decode for various cases of long and short hands. Since the segments meander throughout the entire display, there are many combinations of long and short hands which may be driven by the same segment driver. The PLA tracks this requirement and a substantial portion of the PLA circuitry is thus employed.

Further reference to FIG. 50 indicates that the preferred embodiment of this invention selects between the various phases in the following manner. If a segment is only used to illuminate one short element of the display, then an alpha phase signal ($\phi_\alpha$) is selected. The particular alpha phase can be identified by reference to the timing diagrams, FIG. 49. If there is only a long element, then gamma ($\phi_\gamma$) is chosen, and if a segment is to drive both a long and a short segment, then a beta ($\phi_\beta$) is chosen. Also, if a segment is to drive a long segment but there is an overlap condition then beta ($\phi_\beta$) is also chosen. However, if a segment is not intended to illuminate anything then it is driven with delta ($\phi_\delta$).

Reference to the matrix of FIG. 50 reveals that $\theta_1$ and $\theta_2$ have been chosen for normally activated planes and $\theta_1$ for those that are not activated. Disregarding monentarily the tenths of a second case, the delta ($\phi_\delta$) condition will not result in the illumination of anything that has $\theta_1$, $\theta_2$ or $\theta_0$ in their planes. So. therefore, it is desirable as a turn off condition, and it will be the most active display drive inasmuch as only a maximum of three out of six of the segments are on at any one time.

Of course, in the case of the tenths, it is necessary to provide for lighting an entire back plane, regardless of whether a short outer segment is being driven. $\theta_4$ fulfills that need because in the case of tenths of seconds, seconds is also being displayed and that is a short hand only situation. Thus there would be an alpha on that particular segment and all other segments would have a delta on them. Then those inner planes which are to be turned on, are driven with $\theta_4$, regardless if the segments with alpha or delta are driven, which in that particular activity of the display are the only two segment choices. Thus those respective whole planes would be turned on.

Now to consider the aforementioned overlap condition, which is one of those conditions under which beta would be chosen, overlap is defined as that case in which both a long hand and a short hand are to be shared in the same plane. It will be recalled from previous discussions on "planes", that the second example was this case. There is a decoder that decodes for that very purpose. It is called an overlap decoder (OLP) and it looks for cases where the count for both short and long exists coincidently. The decoder, depicted in the logic diagram of FIGS. 30–38, utilizes four "exclusive-or" circuits and an "or" function. The overlap decoder interrogates the DS through GS and DL through GL for cases where the respective binary numbers are equal. Where equality exists, the circuits produce an overlap output (OLP) and in that case the segment decoder looks for long information and overlap. The preferred embodiment detects the boolean equivalent, which is the product of a short or overlap and a long. So, essentially it looks at all possible cases of the DS through GS and overlap and if a long also occurs coincidently then it calls up $\phi_\beta$.

It should be noted that the DS through GS and DL through GL have a certain number of valid states and all other states are invalid. The invalid states are interpreted to be nothing; that is, they are interpreted to be the off condition. For example, the D through G, "L" and "S" subcases, have counts 0 0 0 0 through 1 0 0 1 and if it is desired to turn off a particular counter those outputs may be all driven "high" so that there will be logic 1 1 1 1. The decoder, of course, searches for known states and it does not recognize the state 1 1 1 1. Thus it will not command any drivers to respond to it and consequently would default into an off state.

The generation of $\phi_\alpha$ through $\phi_\delta$ is similar in many respects to the generation for the plane drivers. As will be recalled for the plane drivers, there is a signal select circuit for each signal input, where there is an "S" signal output from the PLA decoder which selects between $\theta_1$ and $\theta_2$ signals. Such a selection circuit is provided for the signal input to the segment driver, except that it selects between 32 Hz and $\overline{32\ \text{Hz}}$. However, in contrast to the plane decoders the gate input to the segment driver also goes through a signal select. The gate signal selects between $\overline{64\ \text{Hz}}$ and 64 Hz. $\overline{64\ \text{hertz}}$ and $\overline{32\ \text{hertz}}$ are 180 degrees out of phase with 64 hertz and 32 hertz respectively. By combination of these $\overline{32}$ hertz or 32 hertz on the signal input and 64 hertz or $\overline{64}$ hertz on the gate input, the three level signals $\phi_\alpha$ through $\phi_\delta$ may be achieved as shown in FIG. 49.

Observation of the timing diagram (FIG. 49) reveals that for half the time the segment driver is actually turned off as it returns to the center tap voltage; and in the other half of the time it is either high or low. It is high or low depending upon whether the signal input is high or low at that particular time. If $\phi_\alpha$, for example, is desired, a $\overline{32}$ hertz is applied to the signal input and a 64 hertz to the gate input. Thus, when 64 hertz is high, the driver is turned on and the output either goes low or high depending on whether the $\overline{32}$ hertz is high or low. However, when the 64 hertz goes low then the trace returns to a zero volts, which is the center tap voltage. Thusly, the three level signals are generated to driver the display segments.

A similar analysis can be made for $\phi_\beta$. For $\phi_\beta$, the gate would be driven with $\overline{64}$ hertz and the signal input would be driven with $\overline{32}$ hertz. From this description, a chart can be generated in which the requirements for the signal inputs and the gate inputs are determined in order to achieve the required alpha, beta, gamma and delta signals. FIG. 51 more fully develops the required signal combinations to achieve the desired outputs for both segments and planes.

Consideration will now be given to those conditions that are required to call up those particular selections. Alpha occurs only when we have a short element to be lighted by that signal. Beta occurs for a short and a long or a long and an overlap. Gamma occurs when there is only a long, and delta occurs when there is nothing. A relatively simple means of selecting our output drives derives from recognition of the fact that $\overline{32}$ hertz occurs on the signal input to the segment drivers whenever there is a short (alpha and beta case) of if there is a long and an overlap. All other cases have 32 hertz. Likewise, $\overline{64}$ hertz occurs on the gate input to segment driver whenever there is a short and long or long and overlap or neither a short or long hand. All other cases have a 64 hertz.

For the segment decoder there are AS through CS and AL through CL as the primary inputs. Also, there are DS and DL which are also used in the plane decoders. These latter double duty inputs are used in the segment decoder for the purpose of simulating the count-up and count-down phenomena required which will be explained later. The PLA interrogates AS through CS for short information and if it sees a count binary between 0 0 0 and 1 0 1 it will cause a select of $\overline{32}$ hertz to the appropriate driver corresponding to the particular binary count.

Of course there is one other condition for selecting $\overline{32}$ hertz on a signal input and that is for a long and overlap condition. As mentioned previously the preferred embodiment combines the above two conditions into the boolean equivalent, which is the boolean product of a long condition and the combination of a short or overlap plus simply a short.

To describe the impact of the DS and DL input to the segment decoder, examination is made of an orderly progression of counts of AS through CS, for example, of binary count 0 0 0 through 1 0 1, wherein it may be noticed that there is an orderly progression of controls to outputs SA through SF respectively, if the count on the DS input is a zero; or, in other words, in an even count for the planes (the inner planes would either be a BP10, BP12, BP16, etc.). If the DS input is a one, which indicates an odd count in the plane decoders, (planes BP11, BP13, BP15, BP17, etc.) the counts AS through CS of 0 0 0 through 1 0 1 would in this case cause an orderly progression of control signals to segment drivers F through A respectively. This is a reverse order. This is how an up count and down count phenomenon is achieved to get an orderly progression of hands around the display without having to build in up-down counters. In the preferred embodiment it has been preferred not to use up-down counters because of their complexity except in the case of the minutes and hours counters where it is desired to pre-set the counters either clockwise or counterclockwise.

To further elaborate, one should recognize that the meandering path which interconnects the segments dictate that there be a reversal in counter progression in every other plane in order for the hands to progress in a non reversing orderly manner. That is the binary counts may be decoded such that there is a progressive activation of segments A–F for certain planes of activation, but reverse order; i.e., F–A for others. Two means achieve this phenomenon. One is to use an up-down divide by 6 counter which is controlled by the first flip-flop of the divide by 10 counter, such that the divide by 6 counter counts up on even counts of the divide by 10 counter and down on odd counts. For example, if the divide by 10 counter has a D output equal to a logic zero, the divide by 6 counter would count sequentially from 0 0 0 to 1 0 1. However, if the divide by 10 counter has a D output equal to the logic one, the divide by 6 counter would count sequentially from 1 0 1 to 0 0 0. Or the converse may be used. However, for economy of circuits, it is preferred to use all up-counters (except for the minutes and hours as described above) and effect the up-down phenomenon with the output decoder PLA.

To accommodate the up-down phenomena, the outputs of the PLA are programmed to respond in the particular progression of either A to F or F to A by modifying the input counts AS through CS with the count DS. This is also the same with the long hand information AL through DL, modified with the input DL. To compare for identity whether there is both a short and a long, comparison is made using the input DL and $\overline{DL}$ also. Comparison must also be made to ascertain if there is an up count and a down count that both intersect in order to establish the proper output drive signals.

Decode states A2 through A7 represent the case of a short hand counting up as just described. States A8 through A13 are down states. The DS is zero for up and DS is one for down and in both cases the AS through CS count up 0 0 0 to 1 0 1. The decode outputs for GA, SA and SLA through GF, SF and SLF progress up from A to F and then progress down. A62 through A63 are up and down for a long hand.

A fat hand can occur for the same counts as mentioned before. Where there is a fat hand input, called FS, there is also a call up of the appropriate signals for one adjacent driver, appropriately ensuring retention in the same plane. Thus there is an orderly progression of the adjacent fat member until arrival at either boundary of the plane (either segment A or F) and then it momentarily reverses in its progression such that the fat hand is retained in the same plane. Once the primary indicator enters another plane, the original progression resumes. This momentary reversal is required to prevent the requirement of additional levels of multiplexing.

A14 through A19 involve an up count for a fat hand. For the same binary count, the fat hand marker is in the clockwise adjacent segment, except for count 0 1 0 1 (DS–AS) where the boundary conditions are met. A20 through A25 are similar, except for a down count. The inner and and outer plane decoders are very similar, except there is always an upcount. The different occurs when the tenths input is a logic one. In this case decoding occurs in a different manner with regard to the binary counts in order to round off the divide by 16 counter into an effective tenths indicator on the display. Those particular counts are represented by B23 through B34. Finally, states B35, B36, B1 and B2 are display test conditions which light up alternate planes with alternate phases and alternate between each other at a 2 hertz rate. In the segment decoder section, A0 and A1 cause alternate segments to light in a dynamic manner such that both shorts and opens may be tested at any stage of module or watch assembly with either manual or automated test methods.

Although the aforementioned example illustrates the invention as involving a liquid crystal display, it will be evident to those skilled in the art that other materials could readily be employed without departing from the scope and principles of the invention.

The words and expressions employed are intended as terms of description and not of limitation, and there is no intention in the use thereof of including any equivalents, but on the contrary, it is intended to include any and all equivalents, adaptations and modifications that may be employed without departing from the scope of the invention.

What is claimed is:

1. An electro-optic display having a first layer of display elements disposed in configuration radiating from near the central point of the display and defining radial bars, a second layer of elements disposed in cooperative relationship with said first layer, said second layer of elements being disposed in a plurality of annular concentric groups operatively associated with said radial bars, a first plurality of individually separate electrical paths interconnecting said elements of said first layer into predetermined serially connected groups, each group containing at least two of said radial bars, and a second plurality of electrical conductors separately connected to the elements of said second layer and providing means for individually applying electrical potentials thereto, said first plurality of individually separate electrical paths including a common electrical hub at the central point of said display to effect electrical connections between a predetermined plurality of said radial bars.

2. A display in accordance with claim 1 further including at the periphery thereof, a truncated ring providing a common connection to a different predetermined plurality of said radial bars.

3. A display according to claim 1 wherein the radial dimensions of the elements of the innermost of said plurality of annular concentric groups is greater than the radial dimensions of the elements of the outermost of said plurality of annular concentric groups.

4. A display according to claim 2 wherein the radial dimensions of the elements of the innermost of said plurality of annular concentric groups is greater than the radial dimensions of the elements of the outermost of said plurality of annular concentric groups.

5. A display according to claim 1 wherein said predetermined plurality of radial bars are connected in adjacent pairs.

6. A display according to claim 5 wherein the elements of said adjacent pairs are severally associated with different ones of said second layer of elements.

7. A display according to claim 2 wherein said different predetermined plurality of said radial bars are connected in adjacent pairs.

8. A display according to claim 7 wherein the elements of said adjacent pairs are severally associated with different ones of said second layer of elements.

* * * * *